US010821736B2

(12) United States Patent
Okushima et al.

(10) Patent No.: US 10,821,736 B2
(45) Date of Patent: Nov. 3, 2020

(54) LIQUID DISCHARGE HEAD AND LIQUID DISCHARGE APPARATUS

(71) Applicant: CANON KABUSHIKI KAISHA, Tokyo (JP)

(72) Inventors: Shingo Okushima, Kawasaki (JP); Yoshiyuki Nakagawa, Kawasaki (JP); Kazuhiro Yamada, Yokohama (JP); Yasuhiko Osaki, Kamakura (JP); Naozumi Nabeshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/589,745

(22) Filed: Oct. 1, 2019

(65) Prior Publication Data

US 2020/0108615 A1 Apr. 9, 2020

(30) Foreign Application Priority Data

Oct. 5, 2018 (JP) ..... 2018-190399

(51) Int. Cl.
*B41J 2/175* (2006.01)
*B41J 2/14* (2006.01)

(52) U.S. Cl.
CPC ..... *B41J 2/175* (2013.01); *B41J 2/1433* (2013.01); *B41J 2002/14419* (2013.01)

(58) Field of Classification Search
CPC ..... B41J 2/175; B41J 2/1433
See application file for complete search history.

(56) References Cited

U.S. PATENT DOCUMENTS 5,670,997 A * 9/1997 Sugimoto ..... B41J 2/16508 347/30
2009/0244579 A1* 10/2009 Inoue ..... B41J 2/2139 358/1.9

FOREIGN PATENT DOCUMENTS

JP 2002-355973 A 12/2002

* cited by examiner

*Primary Examiner* — Lamson D Nguyen
(74) *Attorney, Agent, or Firm* — Canon U.S.A., Inc. IP Division

(57) ABSTRACT

A liquid discharge head includes a discharge port; a flow passage; a discharge port part; a supply flow passage; and a recovery flow passage. The flow passage, the supply flow passage, and the recovery flow passage are configured such that the liquid inside the flow passage is capable of being circulated between the inside of the flow passage and the outside of the flow passage. An opening of the discharge port is configured such that a liquid surface of the liquid within the opening of the discharge port has a first region and that a second region, and a viscosity of the liquid in the first region is 1.2 or more times higher than a viscosity of the liquid in the second region.

14 Claims, 47 Drawing Sheets

LIQUID DISCHARGE HEAD AND LIQUID DISCHARGE APPARATUS

BACKGROUND

Field of the Disclosure

The present disclosure generally relates to a liquid discharge head and a liquid discharge apparatus that discharge a liquid.

Description of the Related Art

In liquid discharge heads used for an ink jet recording apparatus that discharges an ink to form an image, a volatile component in the ink evaporates from the discharge port and the ink in the vicinity of the discharge port is increased in viscosity. Accordingly, there is a problem that the discharge speed of discharged droplets changes or landing accuracy is affected. Particularly, in a case where the pause time after the discharge is performed is long, there are also cases where an increase in the viscosity of the ink becomes remarkable, and the solid component of the ink adheres in the vicinity of the discharge port. This then causes the flow resistance of the ink to be increased by this solid component, which can result in discharge failure.

As one of the measures against such a viscosity increase of the ink, a method of circulating the ink supplied to a liquid discharge head through a circulation path is known. Japanese Patent Application Laid-Open No. 2002-355973 discloses a liquid discharge head that prevents clogging of a discharge port from evaporation of the ink from the discharge port, by circulating the ink within a flow passage formed between a member in which the discharge port is formed, and a substrate in which a heating resistor is formed.

SUMMARY OF THE INVENTION

The disclosure is specifically related to a liquid discharge head including a discharge port for discharging a liquid; a flow passage in which an energy generating element, which generates an energy used for discharging the liquid, is disposed; a discharge port part that allows the discharge port and the flow passage to communicate with each other; a supply flow passage for supplying the liquid from outside of the flow passage to inside of the flow passage; and a recovery flow passage for recovering the liquid from the inside of the flow passage to the outside of the flow passage. The flow passage, the supply flow passage, and the recovery flow passage are configured such that the liquid inside the flow passage is capable of being circulated between the inside of the flow passage and the outside of the flow passage by supplying the liquid from the supply flow passage to the inside of the flow passage, causing the fluid to flow through the inside of the flow passage, and recovering the liquid from the inside of the flow passage to the outside of the flow passage through the recovery flow passage. An opening of the discharge port is configured such that a liquid surface of the liquid within the opening of the discharge port has a first region and a second region, and that a viscosity of the liquid in the first region is equal to or greater than 1.2 times a viscosity of the liquid in the second region.

Further features of the present disclosure will become apparent from the following description of exemplary embodiments with reference to the attached drawings.

DESCRIPTION OF THE EMBODIMENTS

According to the method described in Japanese Patent Application Laid-Open No. 2002-355973, there is a certain effect that only ink within a flow passage is increased in viscosity by circulating ink to supply fresh ink into the flow passage. However, according to the present inventors' study, it has been determined that the evaporation of moisture or a volatile component in the ink from a discharge port due to the circulation is more likely than in a case where the ink is not circulated. If the ink in which the viscosity has increased, due to the evaporation, flows through the circulation path, the increase in viscosity of the ink may increase through the entire system of the circulation path, and may affect discharge characteristics, recording density, or the like.

Therefore, an object of the disclosure is to provide a liquid discharge head in which the influence on the ink discharge resulting from the evaporation of a component in the ink from the discharge port is suppressed.

Hereinafter, embodiments of the disclosure will be described with reference to the drawings.

(Ink Jet Recording Apparatus of First Form)

Figure 1:
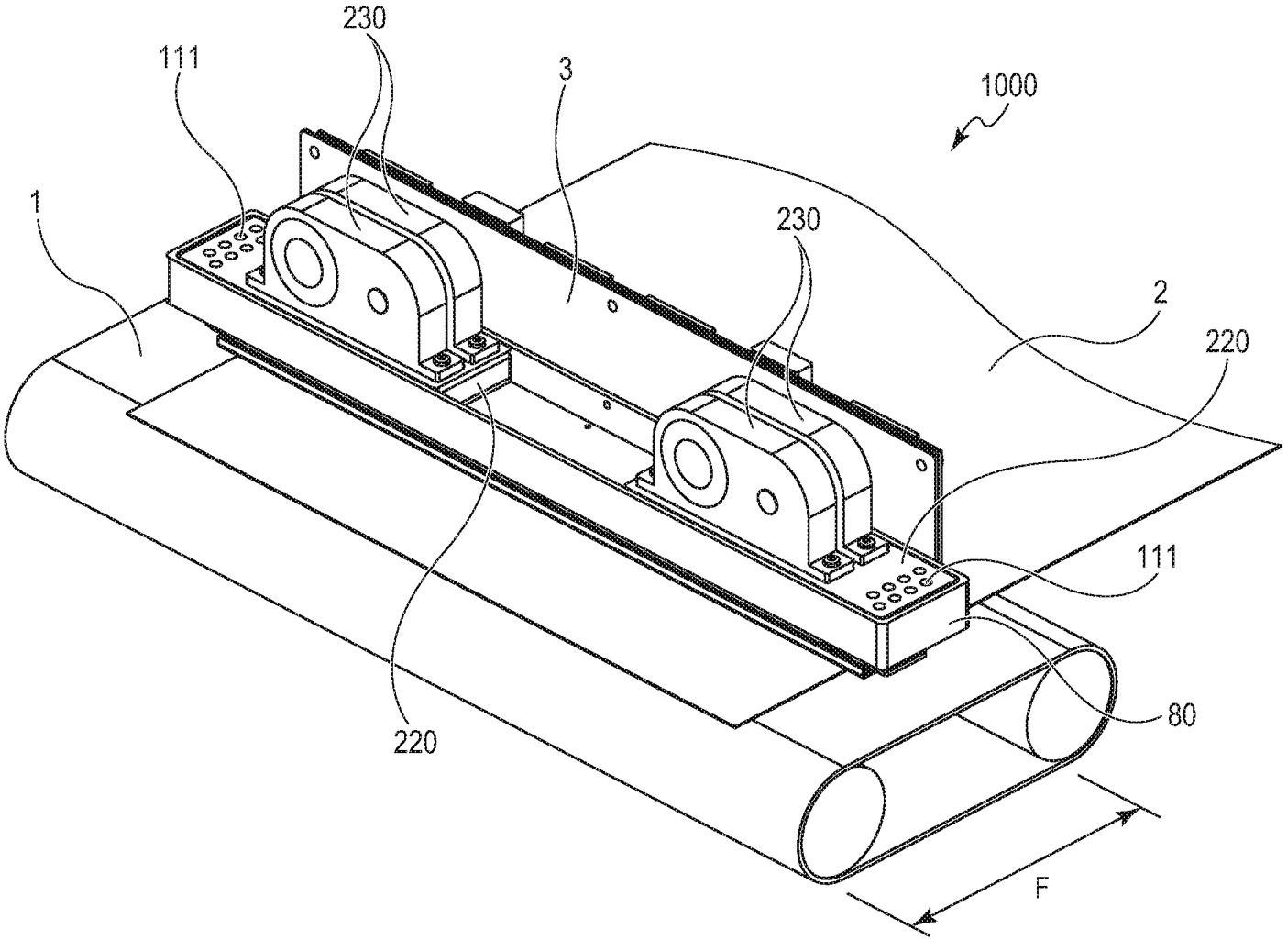
FIG. 1 is a perspective view illustrating a schematic configuration of an ink jet recording apparatus.

FIG. 1 is a view illustrating a schematic configuration of a liquid discharge apparatus of the disclosure that discharges a liquid, especially an ink jet recording apparatus (hereinafter also referred to as a "recording apparatus") 1000 that discharges ink to perform recording. The recording apparatus 1000 is a line-type recording apparatus that includes a conveying unit 1 that conveys a recording medium 2, and a line-type liquid discharge head 3 that is disposed to be substantially orthogonal to a conveying direction of the recording medium 2, and performs one-pass continuous recording while continuously or intermittently conveying a plurality of the recording medium 2. In addition, the recording medium 2 is not limited to a cut sheet, and may be a continuous roll medium. The liquid discharge head 3 includes a negative-pressure control unit 230 that controls the pressure (negative pressure) within the circulation path, a liquid supply unit 220 that makes a fluid communication with the negative-pressure control unit 230, a liquid connection unit 111 serving as a supply and ejection port for the ink to/from the liquid supply unit 220, and a housing 80. The liquid discharge head 3 of the present form includes discharge port lines for discharging inks of cyan C, magenta M, yellow Y and black K, respectively, and is capable of performing full-color recording. As will be described below in FIG. 2, a liquid supply mechanism that is a supply path for supplying the liquid to the liquid discharge head 3, a main tank and a buffer tank (refer to FIG. 2 to be described below) are fluidly connected to the liquid discharge head 3. Also, four negative-pressure control units 230 and four liquid supply units 220 are provided in correspondence with respective inks of four colors. Additionally, an electrical control unit, which transmits electrical power and a discharge control signal to the liquid discharge head 3, is electrically connected to the liquid discharge head 3. A fluid path and an electrical-signal path within the liquid discharge head 3 will be described below.

The recording apparatus 1000 is an ink jet recording apparatus of a form in which the liquid, such as the ink, is circulated between a tank to be described below and the liquid discharge head 3. The ink jet recording apparatus of the present embodiment adopts a first circulation form or a second circulation form as a mode (configuration) of the circulation. The first circulation form is a mode in which circulation is made by operating two circulation pumps (for high pressure and for low pressure) on a downstream side of the liquid discharge head 3. The second circulation form is a mode in which circulation is made by operating the two circulation pumps (for high pressure and for low pressure) on an upstream side of the liquid discharge head 3. Hereinafter, the first circulation form and the second circulation form of this circulation will be described.

<Description of the First Circulation Form>

Figure 2:
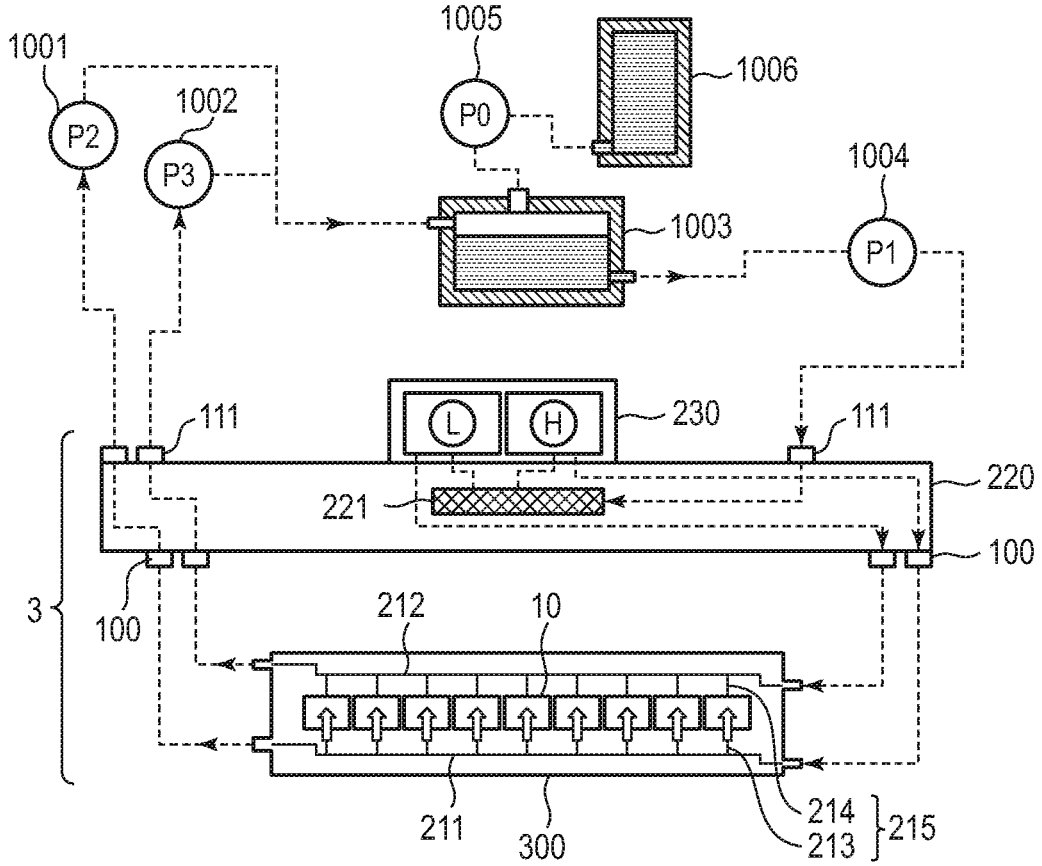
FIG. 2 is a schematic view illustrating a first circulation form of a circulation path.

FIG. 2 is a schematic view illustrating the first circulation form of the circulation path to be applied to the recording apparatus 1000 of the present embodiment. In order to simplify the description, only a path along which one color ink within the inks of the cyan C, the magenta M, the yellow Y and the black K flows is illustrated. However, circulation paths corresponding to the four colors are provided in practice in the liquid discharge head 3 and a recording apparatus body.

In the first circulation form, the ink within a main tank 1006 is supplied to the buffer tank 1003 by a replenishment pump 1005, and then, is supplied to the liquid supply unit 220 of the liquid discharge head 3 via the liquid connection unit 111. Then, the ink, adjusted to two different negative pressures (high pressure and low pressure) by the negative-pressure control unit 230 connected to the liquid supply unit 220, is divided into two flow passages on the high-pressure side and the low-pressure side, and is circulated. The ink within the liquid discharge head 3 is circulated through the liquid discharge head due to the action of the first circulation pump (high-pressure side) 1001 and the first circulation pump (low-pressure side) 1002 located downstream of the liquid discharge head 3. Then, the ink exits from the liquid discharge head 3 via the liquid connection unit 111 and returns to the buffer tank 1003.

The buffer tank 1003, which is a subtank, is connected to the main tank 1006, has an ambient air communication port (not illustrated) that allows the inside and the outside of the tank to communicate with each other, and is capable of ejecting the bubbles in the ink to the outside. The replenishment pump 1005 is provided between the buffer tank 1003 and the main tank 1006.

The two first circulation pumps 1001 and 1002 draw out the liquid from the liquid connection unit 111 of the liquid discharge head 3 to cause the liquid to flow to the buffer tank 1003. A positive-displacement pump can be a first circulation pump having a quantitative liquid delivery capability. Specifically, the first circulation pumps can be a tube pump, a gear pump, a diaphragm pump, a syringe pump, or the like. Additionally, the first circulation pumps may have, a general constant flow rate valve or a general relief valve disposed in a pump outlet which secures a constant flow rate. When the liquid discharge head 3 is driven, a predetermined flow rate of ink flows through a common supply flow passage 211 and a common recovery flow passage 212 by operating the first circulation pump (high-pressure side) 1001 and the first circulation pump (low-pressure side) 1002, respectively. By causing the ink to flow in this way, the temperature of the liquid discharge head 3 at the time of recording is maintained at an optimal temperature. The predetermined flow rate when the liquid discharge head 3 is driven can be set to be equal to or more than a flow rate capable of being maintained such that a temperature difference between respective recording element substrates 10 within the liquid discharge head 3 does not influence recording image quality. If the flow rate is set to an excessively large value, however, due to influence of the pressure loss of the flow passage within the liquid discharge unit 300, a negative pressure difference may be large between the respective recording element substrates 10, and the density unevenness of an image may occur. For that reason, the flow rate can be set while taking into consideration the temperature difference and negative pressure difference between the respective recording element substrates 10.

The negative-pressure control unit 230 is provided in the path between the second circulation pump 1004 and the liquid discharge unit 300 and operates so as to maintain the pressure on a downstream side (that is, the liquid discharge unit 300 side) of the negative-pressure control unit 230 at a preset pressure even in a case where the flow rate of the ink in the circulation system fluctuates due to a difference in the discharge amount per unit area, or the like. Consisting of two pressure adjusting mechanisms, a high-pressure side H and a low-pressure side (L), which constitute the negative-pressure control unit 230, any mechanisms may be used as long as the pressure downstream of the negative-pressure control unit 230 can be controlled with a fluctuation equal to or lower than a certain range around a desired set pressure. As an example, the same mechanism as the so-called "pressure-reducing regulator" can be adopted. In a circulation flow passage in the present embodiment, an upstream side of the negative-pressure control unit 230 is pressurized via the liquid supply unit 220 by the second circulation pump 1004. By doing so, the influence of the head pressure of the liquid discharge head 3 with respect to the buffer tank 1003 can be suppressed. Thus, the degree of freedom of the layout of the buffer tank 1003 in the recording apparatus 1000 can be extended.

As the second circulation pump 1004, a turbo type pump, a positive-displacement pump, or the like can be used as long as a head pressure equal to or more than a certain pressure is provided within a range of an ink circulation flow rate to be used when the liquid discharge head 3 is driven.

Specifically, a diaphragm pump or the like is applicable. Additionally, instead of the second circulation pump 1004, for example, a head tank disposed with a certain head difference with respect to the negative-pressure control unit 230 is also applicable.

As illustrated in FIG. 2, the negative-pressure control unit 230 includes the two pressure adjusting mechanisms H and L that are respectively set to have mutually different control pressures. A higher-pressure setting side (denoted by H in FIG. 2) and a lower-pressure side (denoted by L in FIG. 2) of the two negative-pressure adjusting mechanisms are respectively connected to the common supply flow passage 211 and the common recovery flow passage 212 within the liquid discharge unit 300 via the inside of the liquid supply unit 220. The liquid discharge unit 300 is provided with the common supply flow passage 211, the common recovery flow passage 212, and individual flow passages 215 (an individual supply flow passage 213 and an individual recovery flow passage 214) that communicate with each recording element substrate. A pressure difference is caused between the two common flow passages by connecting the pressure adjusting mechanism H to the common supply flow passage 211 and connecting the pressure adjusting mechanism L to the common recovery flow passage 212. Also, since each of the individual flow passages 215 communicate with the common supply flow passage 211 and the common recovery flow passage 212, a flow (arrow of FIG. 2) in which a portion of the liquid passes through the internal flow passage of the recording element substrate 10 from the common supply flow passage 211 and flows into the common recovery flow passage 212 is generated. In addition, the two negative-pressure adjusting mechanisms H and L are respectively connected to the path from the liquid connection unit 111 via a filter 221.

In this way, in the liquid discharge unit 300, such a flow that a portion of the liquid passes through each recording element substrate 10 while causing the liquid so as to pass through the common supply flow passage 211 and the common recovery flow passage 212, respectively, is generated. For this reason, the heat generated in each recording element substrate 10 can be ejected to the outside of the recording element substrate 10 due to the ink that flows through the common supply flow passage 211 and the common recovery flow passage 212. Additionally, by virtue of such a configuration, the flow of the ink can be caused even in the discharge port or a pressure chamber that does not perform discharge, when recording is performed by the liquid discharge head 3. Accordingly, the increase in viscosity of the ink can be suppressed by lowering the viscosity of the ink that is viscosity-increased within the discharge port. Additionally, the viscosity-increased ink or foreign matter in the ink can be ejected to the common recovery flow passage 212. For this reason, the liquid discharge head 3 of the present embodiment enables high-speed and high-quality recording.

<Description of the Second Circulation Form>

Figure 3:
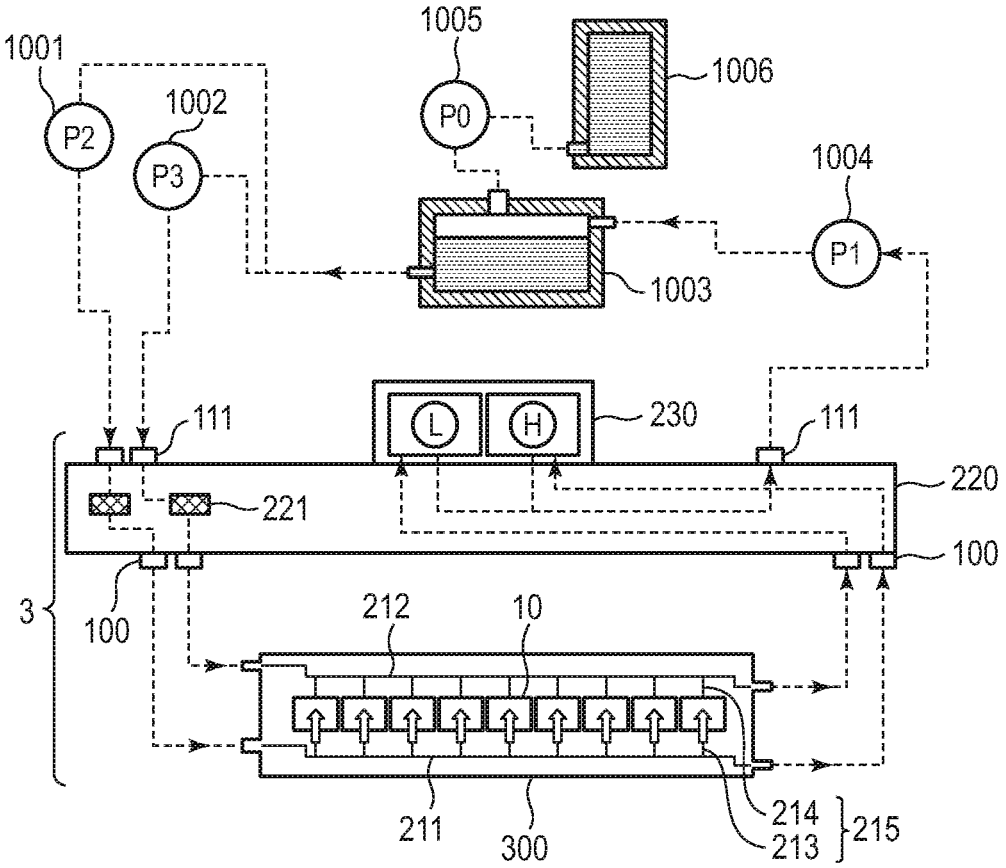
FIG. 3 is a schematic view illustrating a second circulation form of the circulation path.

FIG. 3 is a schematic view illustrating a second circulation form that is a circulation form different from the above-described first circulation form in the circulation path to be applied to the recording apparatus of the present embodiment. A main difference from the aforementioned first circulation form is that both the two pressure adjusting mechanisms, which constitute the negative-pressure control unit 230, control the pressure upstream of the negative-pressure control unit 230 with a fluctuation within a certain range around a desired set pressure. Another main difference from the first circulation form is that the second circulation pump 1004 functions as a negative pressure source that decompresses the downstream side of the negative-pressure control unit 230. Moreover, another difference is that the first circulation pump (high-pressure side) 1001 and the first circulation pump (low-pressure side) 1002 are disposed on the upstream side of the liquid discharge head 3, and the negative-pressure control unit 230 is disposed on the downstream side of the liquid discharge head 3.

In the second circulation form, as illustrated in FIG. 3, the ink within the main tank 1006 is supplied to the buffer tank 1003 by the replenishment pump 1005. Thereafter, the ink is divided into two flow passages, and circulates via two flow passages of a high-pressure side and a low-pressure side due to the action of the negative-pressure control unit 230 provided in the liquid discharge head 3. The ink, which is divided into the two flow passages of the high-pressure side and the low-pressure side, is supplied to the liquid discharge head 3 via the liquid connection unit 111 of the liquid discharge head 3 due to the action of the first circulation pump (high-pressure side) 1001 and the first circulation pump (low-pressure side) 1002. Thereafter, the ink, which is circulated through the liquid discharge unit 300 due to the action of the first circulation pump (high-pressure side) 1001 and the first circulation pump (low-pressure side) 1002, exits from the liquid discharge head 3 via the liquid connection unit 111 through the negative-pressure control unit 230. The ink is returned to the buffer tank 1003 by the second circulation pump 1004.

Meanwhile, there is a case where the fluctuation of the flow rate is caused due to a change in the discharge amount per unit area. Even in this case, the negative-pressure control unit 230 of the second circulation form functions to stabilize a pressure fluctuation on the upstream side (that is, the liquid discharge unit 300 side) of the negative-pressure control unit 230 within a certain range around a preset pressure. In the circulation flow passage of the present embodiment, the downstream side of the negative-pressure control unit 230 is pressurized via the liquid supply unit 220 by the second circulation pump 1004. In this way, since the influence of the head pressure of the buffer tank 1003 on the liquid discharge head 3 can be suppressed, the range of choice of the layout of the buffer tank 1003 in the recording apparatus 1000 can be widened. Instead of the second circulation pump 1004, for example, a head tank disposed with a predetermined head difference with respect to the negative-pressure control unit 230 is also applicable. In the second circulation form, similarly to the above-described first circulation form, the negative-pressure control unit 230 includes the two pressure adjusting mechanisms H and L that are respectively set to have mutually different control pressures. The higher-pressure setting side (denoted by H in FIG. 3) and the lower-pressure side (denoted by L in FIG. 3) of the two negative-pressure adjusting mechanisms H and L are respectively connected to the common supply flow passage 211 and the common recovery flow passage 212 within the liquid discharge unit 300 via the inside of the liquid supply unit 220. By making the pressure of the common supply flow passage 211 relatively higher than the pressure of the common recovery flow passage 212 by the two negative-pressure adjusting mechanisms, an ink flow that flows from the common supply flow passage 211 via the individual flow passage 213 and the internal flow passage of each recording element substrate 10 to the common recovery flow passage 212 is generated.

In such a second circulation form, the same ink flow state as that of the first circulation form is obtained within the liquid discharge unit 300. However, there are two advantages different from those in the case of the first circulation form. Firstly, in the second circulation form, the negative-pressure control unit 230 is disposed on the downstream side of the liquid discharge head 3. Thus, there is little concern that dust or foreign matter generated from the negative-pressure control unit 230 flows into the liquid discharge head 3. Secondly, in the second circulation form, the maximum value of a required flow rate to be supplied from the buffer tank 1003 to the liquid discharge head 3 is smaller than that in the case of the first circulation form. The reason is as follows.

The sum of flow rates within the common supply flow passage 211 and the common recovery flow passage 212 in a case where the ink is circulated in a recording standby mode is referred to as a flow rate A. The value of the flow rate A is defined as, for example, a minimum flow rate required in order to keep a temperature difference within the liquid discharge unit 300 within a required range in the temperature adjustment of the liquid discharge head 3 during recording standby. Additionally, the discharge flow rate in a case where the ink is discharged from all the discharge ports of the liquid discharge unit 300 (full discharge mode) is defined as a flow rate F (discharge amount per one discharge port×discharge frequency per unit time×number of discharge ports).

Figure 4:
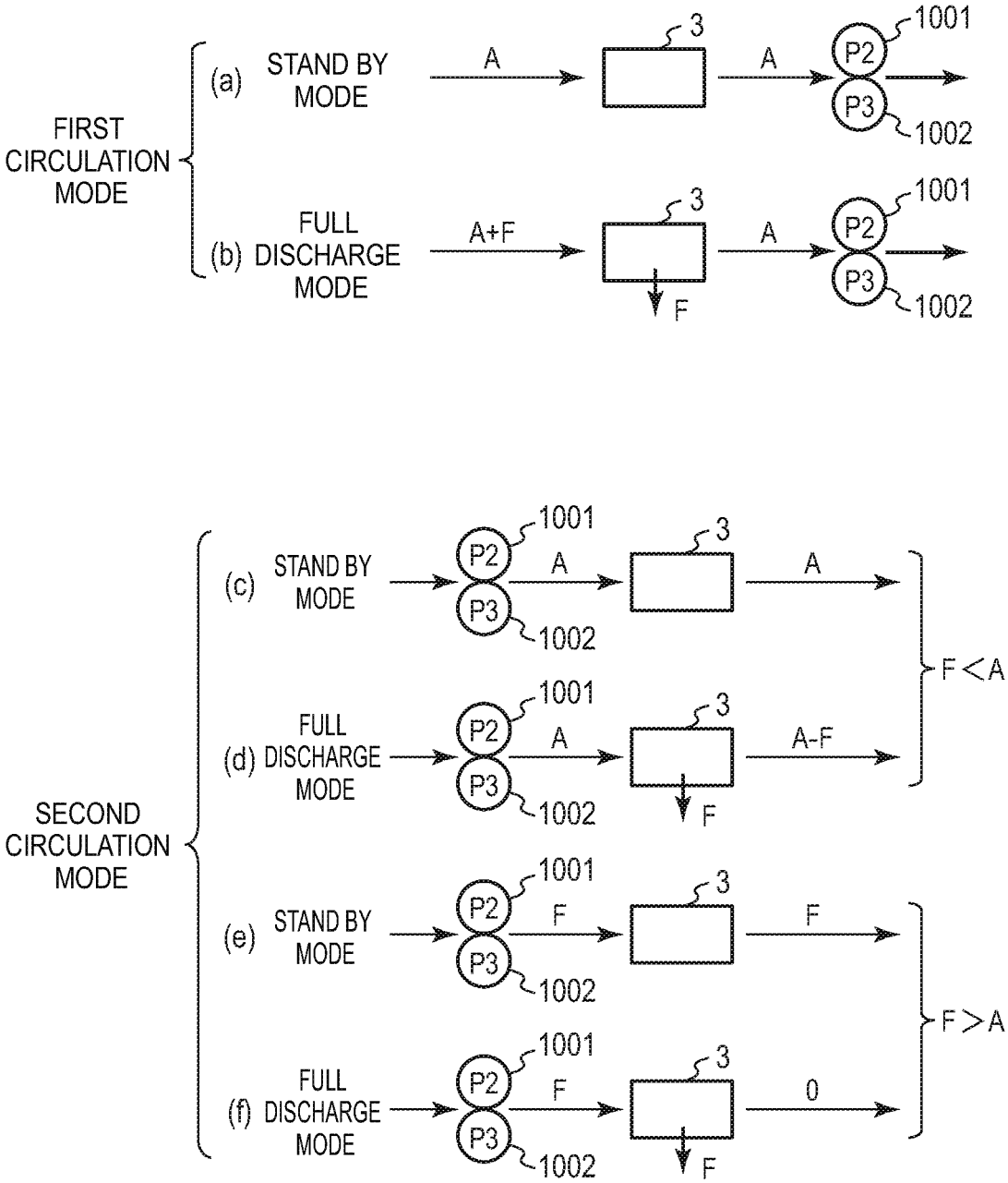
FIG. 4 is a view illustrating differences in the inflow rate of ink between the first circulation form and the second circulation form.

FIG. 4 is a view illustrating differences in the inflow rate of the ink to the liquid discharge head 3 in the first circulation form and the second circulation form. (a) of FIG. 4 illustrates a standby mode in the first circulation form, and (b) of FIG. 4 illustrates a full discharge mode in the first circulation form. (c) to (f) of FIG. 4 illustrate the flow rate in the case of a second circulation flow passage, (c) and (d) of FIG. 4 illustrate flow rates in the standby mode and the full discharge mode in the case of flow rate F<flow rate A, and (e) and (f) of FIG. 4 illustrate flow rates in the standby mode and the full discharge mode in the case of flow rate F>flow rate A.

In the case of the first circulation form, the first circulation pump (high-pressure side) 1001 and the first circulation pump (low-pressure side) 1002, which have quantitative liquid delivery capabilities, are disposed on the downstream side of the liquid discharge head 3 ((a) and (b) of FIG. 4). The total set flow rate of the first circulation pump 1001 and the first circulation pump 1002 becomes the flow rate A ((a) of FIG. 4). Due to the flow rate A, it is possible to manage the temperature within the liquid discharge unit 300 in the standby mode. In a case where the full discharge is performed by the liquid discharge head 3, the total set flow rate of the first circulation pump 1001 and the first circulation pump 1002 is still the flow rate A. However, as for a maximum flow rate at which the ink is supplied to the liquid discharge head 3 as a negative pressure caused by the discharge in the liquid discharge head 3 acts, a consumed portion (flow rate F) resulting from the full discharge is added to the flow rate A of the total set flow rate. Therefore, the maximum value of the amount of supply to the liquid discharge head 3 becomes flow rate A+flow rate F because the flow rate F is added to the flow rate A ((b) of FIG. 4).

On the other hand, in the case of the second circulation form in which the first circulation pump 1001 and the first circulation pump 1002 are disposed on the upstream side of the liquid discharge head 3 ((c) to (f) of FIG. 4), the amount of supply to the liquid discharge head 3 required in the recording standby mode is the flow rate A similarly to the first circulation form. Therefore, in the second circulation form in which the first circulation pump 1001 and the first circulation pump 1002 are disposed on the upstream side of the liquid discharge head 3 in a case where the flow rate A is larger than the flow rate F ((c) and (d) of FIG. 4), the amount of supply to the liquid discharge head 3 is sufficient at the flow rate A even in the full discharge mode. In that case, the ejection flow rate from the liquid discharge head 3 becomes flow rate A−flow rate F ((d) of FIG. 4). However, in a case where the flow rate F is larger than the flow rate A ((e) and (f) of FIG. 4), in the full discharge mode, the flow rate may be insufficient if the flow rate of supply to the liquid discharge head 3 is set to the flow rate A. For that reason, in a case where the flow rate F is larger than the flow rate A, it is necessary to set the amount of supply to the liquid discharge head 3 to the flow rate F. In that case, if the full discharge is performed, the flow rate F is consumed in the liquid discharge head 3. Therefore, the ejection flow rate from the liquid discharge head 3 is brought into a state where most thereof is not ejected ((f) of FIG. 4). In addition, in a case where the flow rate F is larger than the flow rate A and discharge is performed but is not the full discharge, the amount obtained by subtracting a portion consumed by the discharge from the flow rate F is ejected from the liquid discharge head 3.

In this way, in the case of the second circulation form, a total value of the set flow rates of the first circulation pump 1001 and the first circulation pump 1002, that is, a maximum value of a required supply flow rate, becomes a larger value of the flow rate A or the flow rate F. For this reason, as long as the liquid discharge unit 300 having the same configuration is used, the maximum value (flow rate A or the flow rate F) of the required amount of supply in the second circulation form becomes smaller than the maximum value (the flow rate A+the flow rate F) of the required supply flow rate in the first circulation form.

For that reason, in the case of the second circulation form, there are advantages that the degree of freedom of an applicable circulation pump can be increased, for example, a low-cost circulation pump having a simple configuration can be used or the load of a cooler (not illustrated) installed in a body-side path can be reduced, and the cost of the recording apparatus can be reduced. These advantages are greater for a line head in which the value of the flow rate A or the flow rate F becomes relatively larger and is useful for a line head of which the length in a longitudinal direction is longer among line heads.

However, on the other hand, there is also a point that the first circulation form is more advantageous than the second circulation form. That is, in the second circulation form, a flow rate that flows through the inside of the liquid discharge unit 300 is the maximum in the recording standby mode. Therefore, an image (hereinafter also referred to as a low-duty image) in which the discharge amount per unit area is smaller is brought into a state where a high negative pressure is applied to each discharge port. For this reason, in the case of a negative pressure in which the flow path width is narrow and high, a high negative pressure is applied to a discharge port in the low-duty image of which the unevenness is easily visible. Therefore, there is a concern that so-called satellite droplets to be discharged together with a main droplet of the ink may be generated and recording quality may degrade. On the other hand, in the case of the first circulation form, a high negative pressure is applied to a discharge port when an image (hereinafter also referred to as a high-duty image) in which the discharge amount per unit area is large is formed. Therefore, there are advantages that visual recognition is not easy even if the satellite droplets are generated, and the influence on the image is small. As the selection of these two circulation forms, a preferable selection can be adopted in the light of the specification (the discharge flow rate F, the minimum circulation flow rate A, and the flow passage resistance within the head) of the liquid discharge head and the recording apparatus body.

<Description of Configuration of Liquid Discharge Head>

Figure 5A:
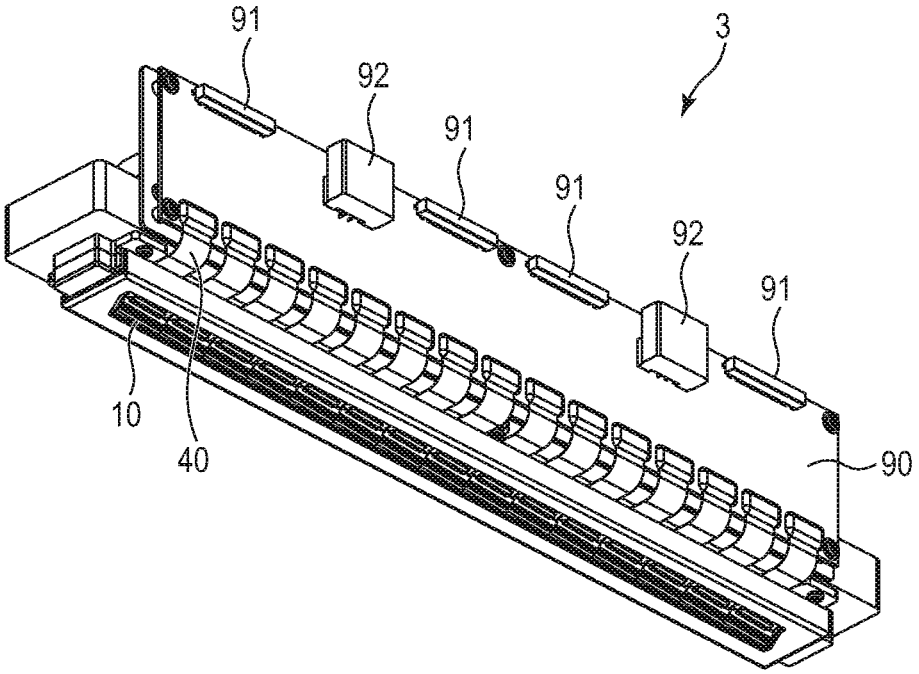
FIG. 5A and FIG. 5B are perspective views illustrating a liquid discharge head.
Figure 5B:
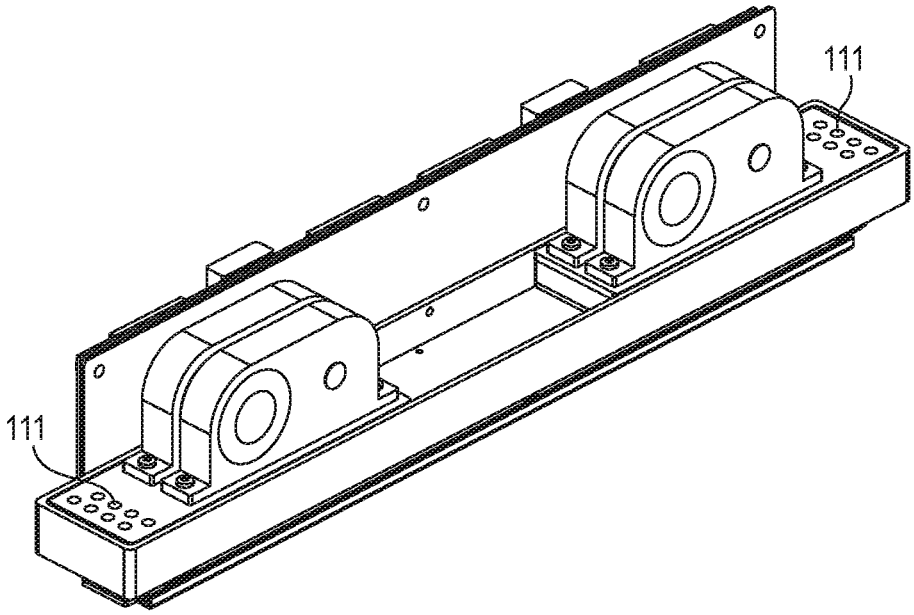

The configuration of the liquid discharge head 3 related to a first embodiment will be described. FIGS. 5A and 5B are perspective views illustrating the liquid discharge head 3 related to the present embodiment. The liquid discharge head 3 is a line-type liquid discharge head in which fifteen recording element substrates 10 capable of discharging the inks of the four colors of the cyan C, the magenta M, the yellow Y and the black K with one recording element substrate 10 are arranged (disposed in in-line) on a straight line. As illustrated in FIG. 5A, the liquid discharge head 3 includes a signal input terminal 91 and an electrical power supply terminal 92 that are electrically connected to each recording element substrate 10 via a flexible wiring substrate 40 and an electrical wiring substrate 90. The signal input terminal 91 and the electrical power supply terminal 92 are electrically connected to the control unit of the recording apparatus 1000, and respectively supply a discharge drive signal and electrical power required for discharge to the recording element substrate 10. By concentrating wiring lines by an electric circuit within the electrical wiring substrate 90, the number of signal output terminals 91 and the number of electrical power supply terminals 92 can be reduced compared to the number of recording element substrates 10. Accordingly, when the liquid discharge head 3 is assembled to the recording apparatus 1000 or when the liquid discharge head is replaced, the number of electrical connection parts that need to be removed is reduced. As illustrated in FIG. 5B, the liquid connection units 111 provided at both end parts of the liquid discharge head 3 are connected to the liquid supply system of the recording apparatus 1000 described above in FIGS. 2 and 3. Accordingly, the inks of the four colors of the cyan C, the magenta M, the yellow Y and the black K are supplied from the supply system of the recording apparatus 1000 to the liquid discharge head 3. Additionally, the ink, which has passed through the liquid discharge head 3, is recovered to the supply system of the recording apparatus 1000. In this way, the inks of the respective colors are capable of being circulated via the path of the recording apparatus 1000, and the path of the liquid discharge head 3.

Figure 6:
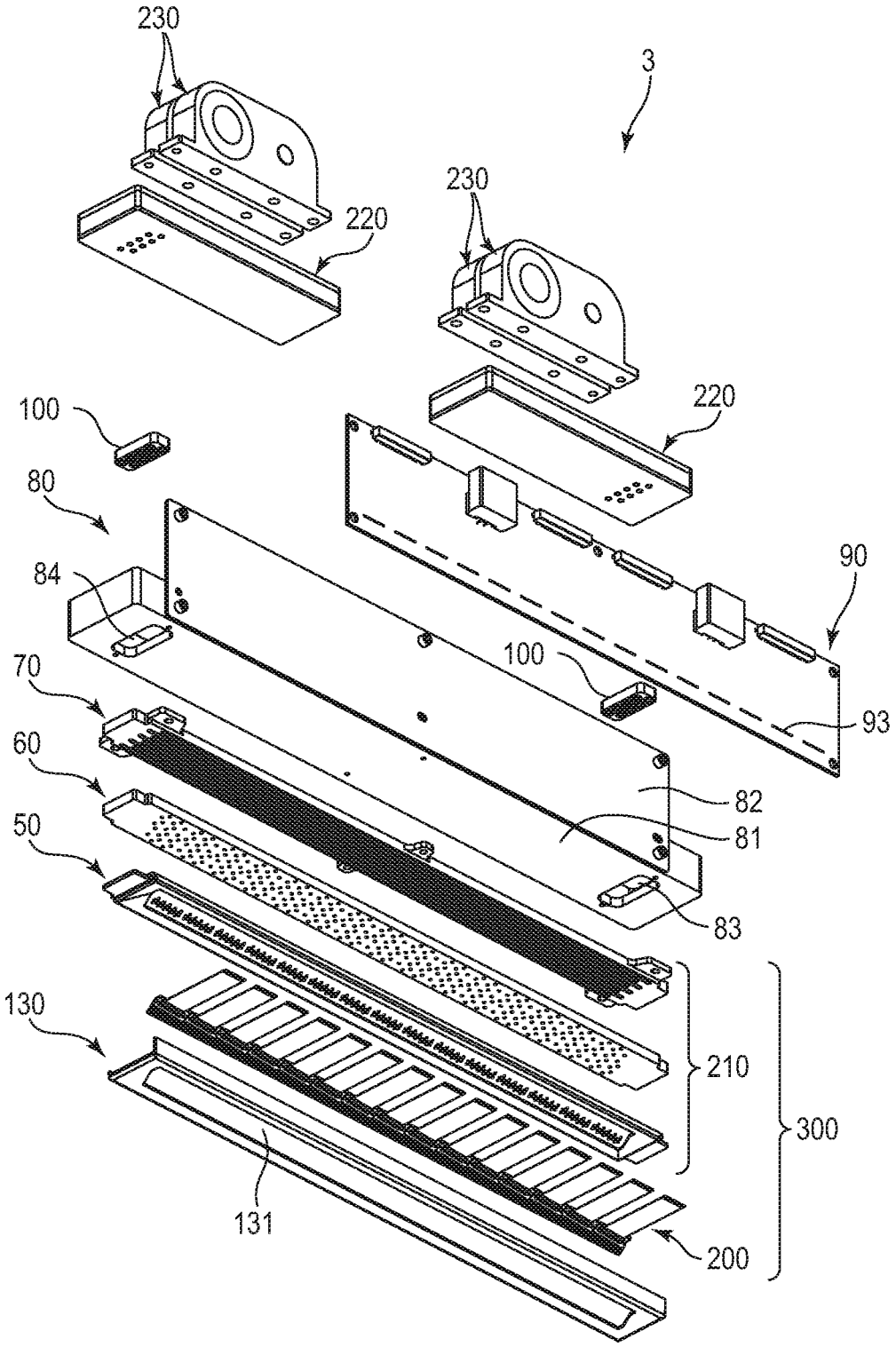
FIG. 6 is an exploded perspective view illustrating respective components or units that constitute the liquid discharge head.

FIG. 6 is an exploded perspective view illustrating respective components or units that constitute the liquid discharge head 3. The liquid discharge unit 300, the liquid supply unit 220, and the electrical wiring substrate 90 are attached to the housing 80. The liquid supply unit 220 is provided with the liquid connection unit 111 (refer to FIG. 3). Moreover, the filter 221 (refer to FIG. 2 and FIG. 3) for each color, which communicates with each opening of the liquid connection unit 111, is provided inside the liquid supply unit 220 in order to remove the foreign matter in the ink to be supplied. Each of two liquid supply units 220 is provided with color filters 221 equivalent to two colors. The liquid, which has passed through the filter 221, is supplied to the negative-pressure control unit 230 disposed on the liquid supply unit 220 in correspondence with each color. The negative-pressure control unit 230 is a unit including a pressure adjusting valve for each color, and a pressure loss change within the supply system (a supply system on the upstream side of the liquid discharge head 3) of the recording apparatus 1000 caused by the fluctuation of the flow rate of the liquid is markedly damped by the operation of a valve, a spring member, or the like provided inside each unit. Accordingly, the negative-pressure control unit 230 is capable of stabilizing a negative-pressure change on the downstream side (liquid discharge unit 300 side) of the negative-pressure control unit 230 to be within a certain range. As illustrated in FIG. 2, two pressure adjusting valves for each color are built within the negative-pressure control unit 230 for each color. The two pressure adjusting valves are set to have different control pressures, respectively, a high-pressure side thereof communicates with the common supply flow passage 211 (refer to FIG. 2) within the liquid discharge unit 300, and a low-pressure side thereof communicates with the common recovery flow passage 212 (refer to FIG. 2) and the liquid supply unit 220.

The housing 80 includes a liquid discharge unit support part 81 and an electrical wiring substrate support part 82, supports the liquid discharge unit 300 and the electrical wiring substrate 90, and secures the rigidity of the liquid discharge head 3. The electrical wiring substrate support part 82 is for supporting the electrical wiring substrate 90, and is fixed to the liquid discharge unit support part 81 by screw fastening. The liquid discharge unit support part 81 has a role of correcting the warpage or deformation of the liquid discharge unit 300, to secure the relative position accuracy of a plurality of recording element substrates 10, and thereby, suppresses warpage or unevenness in a recorded material. For that reason, the liquid discharge unit support part 81 can have sufficient rigidity and as the material thereof, a metallic material, such as SUS or aluminum, or ceramic, such as alumina, is suitable. The liquid discharge unit support part 81 is provided with openings 83 and 84 into which joint rubbers 100 are inserted. The liquid supplied from the liquid supply unit 220 is guided to a third flow passage member 70 that constitutes the liquid discharge unit 300 via the joint rubbers.

The liquid discharge unit 300 includes a plurality of discharge modules 200 and a flow passage member 210, and a cover member 130 is attached to the surface of the liquid discharge unit 300 on the recording medium side. Here, the cover member 130 is a member having a frame-shaped front surface provided with an elongated opening 131 as illustrated in FIG. 6, and each recording element substrate 10 and a sealing material 110 (refer to FIG. 10A and FIG. 10B to be described below), which are included in each discharge module 200, are exposed from the opening 131. A frame part around the opening 131 has a function as an abutting surface of a cap member that caps the liquid discharge head 3 in the recording standby mode. For this reason, a closed space can be formed at the time of the capping by applying an adhesive, a sealing material, a filler material, or the like along the periphery of the opening 131, and filling irregularities or gaps on a discharge port surface of the liquid discharge unit 300.

Next, the configuration of the flow passage member 210 included in the liquid discharge unit 300 will be described. As illustrated in FIG. 6, the flow passage member 210 is obtained by laminating a first flow passage member 50, a second flow passage member 60, and the third flow passage member 70, and distributes the liquid, which is supplied from the liquid supply unit 220, to the respective discharge modules 200. Additionally, the flow passage member 210 is a flow passage member for returning the liquid, which is recirculated from the discharge modules 200, to the liquid supply unit 220. The flow passage member 210 is fixed to the liquid discharge unit support part 81 by screw fastening, and thereby, the warpage or deformation of the flow passage member 210 is suppressed.

Figure 7A:
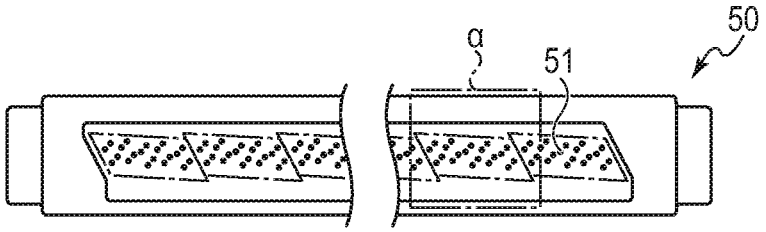
FIG. 7A, FIG. 7B, FIG. 7C, FIG. 7D, FIG. 7E and FIG. 7F are views illustrating a front surface and a back surface of each of first, second, and third flow passage members.
Figure 7B:
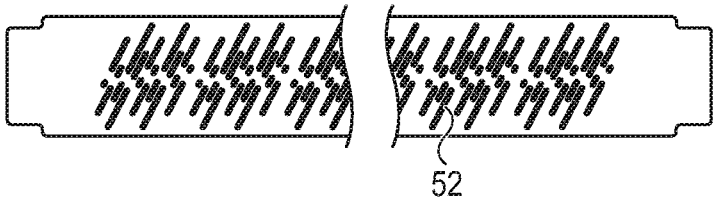
Figure 7C:
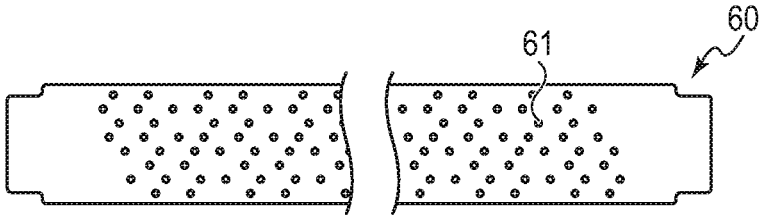
Figure 7D:
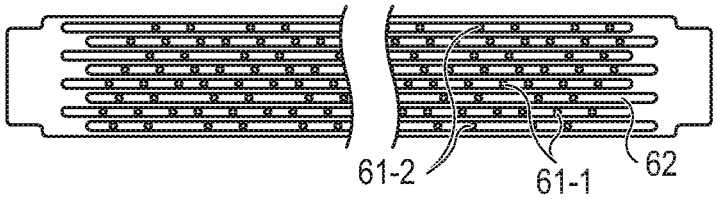
Figure 7E:
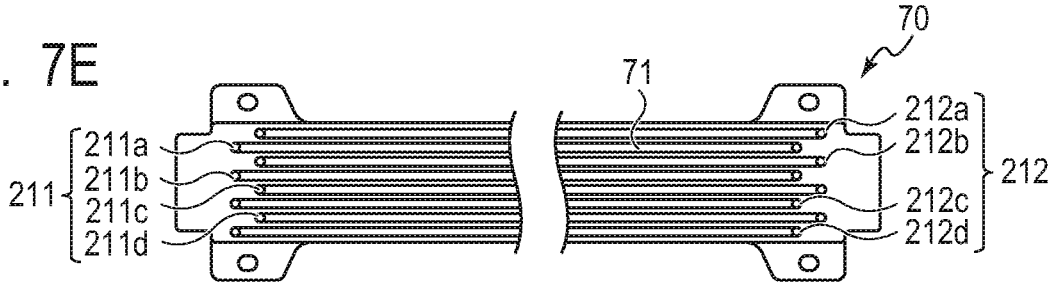
Figure 7F:
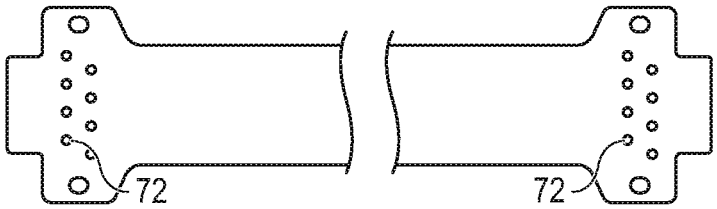

FIGS. 7A to 7F are views illustrating a front surface and a back surface of each flow passage member of the first to third flow passage members. FIG. 7A illustrates the surface of the first flow passage member 50 on which the discharge modules 200 are mounted, and FIG. 7F illustrates the surface of the third flow passage member 70 that abuts against the liquid discharge unit support part 81. Additionally, the first flow passage member 50 and the second flow passage member 60 are joined to each other such that FIG. 7B and FIG. 7C illustrating abutting surfaces of the respective flow passage members face each other, and the second flow passage member and the third flow passage member are joined to each other such that FIG. 7D and FIG. 7E illustrating abutting surfaces of the respective flow passage members face each other. By joining the second flow passage member 60 and the third flow passage member 70 to each other, eight common flow passages (211*a*, 211*b*, 211*c*, 211*d*, 212*a*, 212*b*, 212*c*, and 212*d*), which extend in a longitudinal direction of each flow passage member, are formed from common flow passage grooves 62 and 71 formed in the respective flow passage members. Accordingly, a set of a common supply flow passage 211 and a common recovery flow passage 212 is formed within the flow passage member 210 for each color. The ink is supplied from the common supply flow passage 211 to the liquid discharge head 3, and the ink supplied to the liquid discharge head 3 is recovered by the common recovery flow passage 212. Communication ports 72 (refer to FIG. 7F) of the third flow passage member 70 communicate with respective holes of the joint rubber 100, and fluidly communicate with the liquid supply unit 220 (refer to FIG. 6). A plurality of the communication ports 61 (a communication port 61-1 that communicates with the common supply flow passages 211, and a communication port 61-2 that communicates with the common recovery flow passages 212) is formed in bottom surfaces of the common flow passage grooves 62 of the second flow passage member 60, and communicates with the one-end parts of individual flow passage grooves 52 of the first flow passage member 50. Communication ports 51 are formed at other-end parts of the individual flow passage grooves 52 of the first flow passage member 50, and fluidly communicate with the plurality of discharge modules 200 via the communication ports 51. The individual flow passage grooves 52 allow a flow passage to be concentrated to a central side of a flow passage member.

The first to third flow passage members can have corrosion resistance against the liquid and is made of a material with a low coefficient of linear expansion. As the material, for example, it is possible to preferably use a composite material (resin material) to which an inorganic filler, such as silica particulates or fibers, are added by using alumina, liquid crystal polymer (LCP), polyphensyl sulfide (PPS), or polysulfone (PSF) as a base material. As a method of forming the flow passage member 210, the three flow passage members may be laminated and bonded to each other, or in a case where a composite resin material is selected as the material, a joining method by welding may be used.

Figure 8:
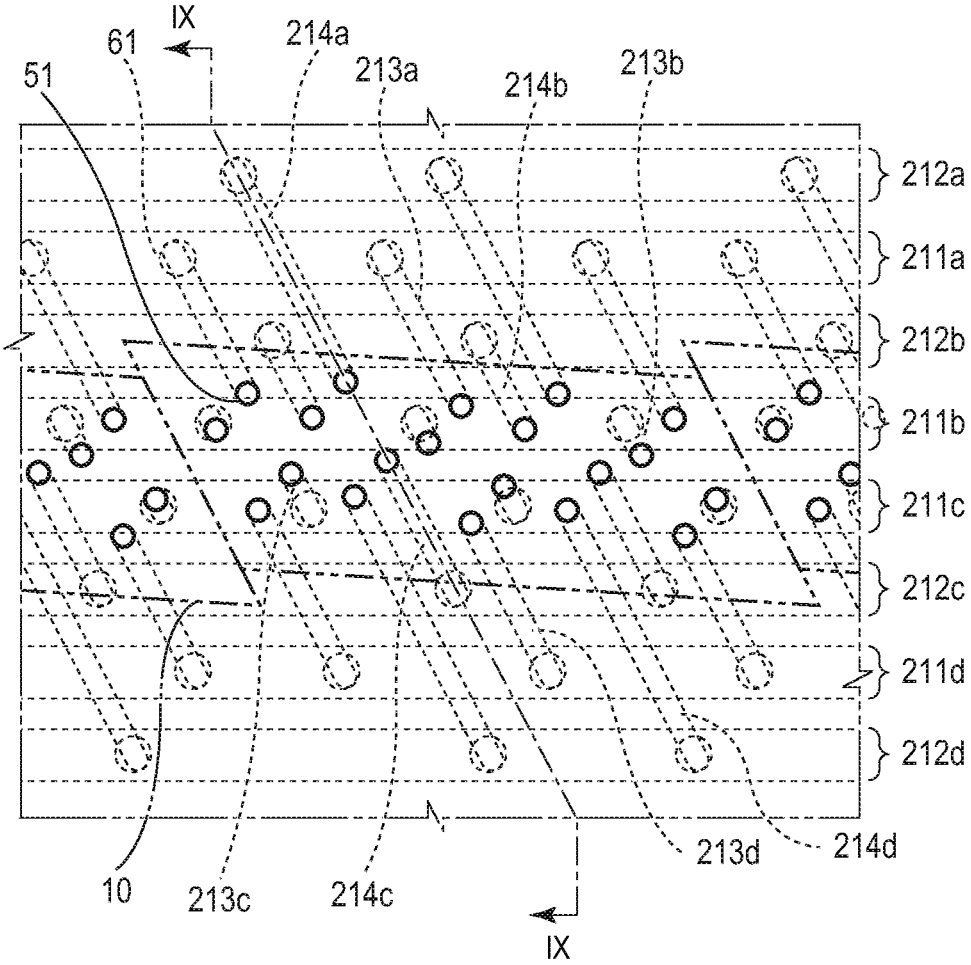
FIG. 8 is a perspective view illustrating a portion of FIG. 7A, and illustrating flow passages within the flow passage member in an enlarged manner.

FIG. 8 illustrates an α portion of FIG. 7A, and is a perspective view illustrating flow passages within the flow passage member 210 formed by joining the first to third flow passage members in a partially enlarged manner from a surface side of the first flow passage member 50 on which the discharge modules 200 are mounted. As for the common supply flow passages 211 and the common recovery flow passages 212, a common supply flow passage 211 and a common recovery flow passage 212 are alternatively disposed from the flow passages at both end parts, respectively. Here, a connection relationship between respective flow passages within the flow passage member 210 will be described.

The flow passage member 210 is provided with the common supply flow passages 211 (211*a*, 211*b*, 211*c*, 211*d*) and the common recovery flow passages 212 (212*a*, 212*b*, 212*c*, 212*d*) that extend in the longitudinal direction of the liquid discharge head 3 for the respective colors. A plurality of individual supply flow passages (213*a*, 213*b*, 213*c*, 213*d*) formed by the individual flow passage grooves 52 is connected to a common supply flow passage 211 for each color via the communication ports 61. Additionally, a plurality of individual recovery flow passages (214*a*, 214*b*, 214*c*, 214*d*) formed by the individual flow passage grooves 52 is connected to a common recovery flow passage 212 for each color via the communication ports 61. By virtue of such a flow passage configuration, the ink can be concentrated on the recording element substrates 10 located at a central part of a flow passage member via the individual supply flow passages 213 from each common supply flow passages 211. Additionally, the ink can be recovered from the recording element substrates 10 via the individual recovery flow passages 214 to each common recovery flow passage 212.

Figure 9:
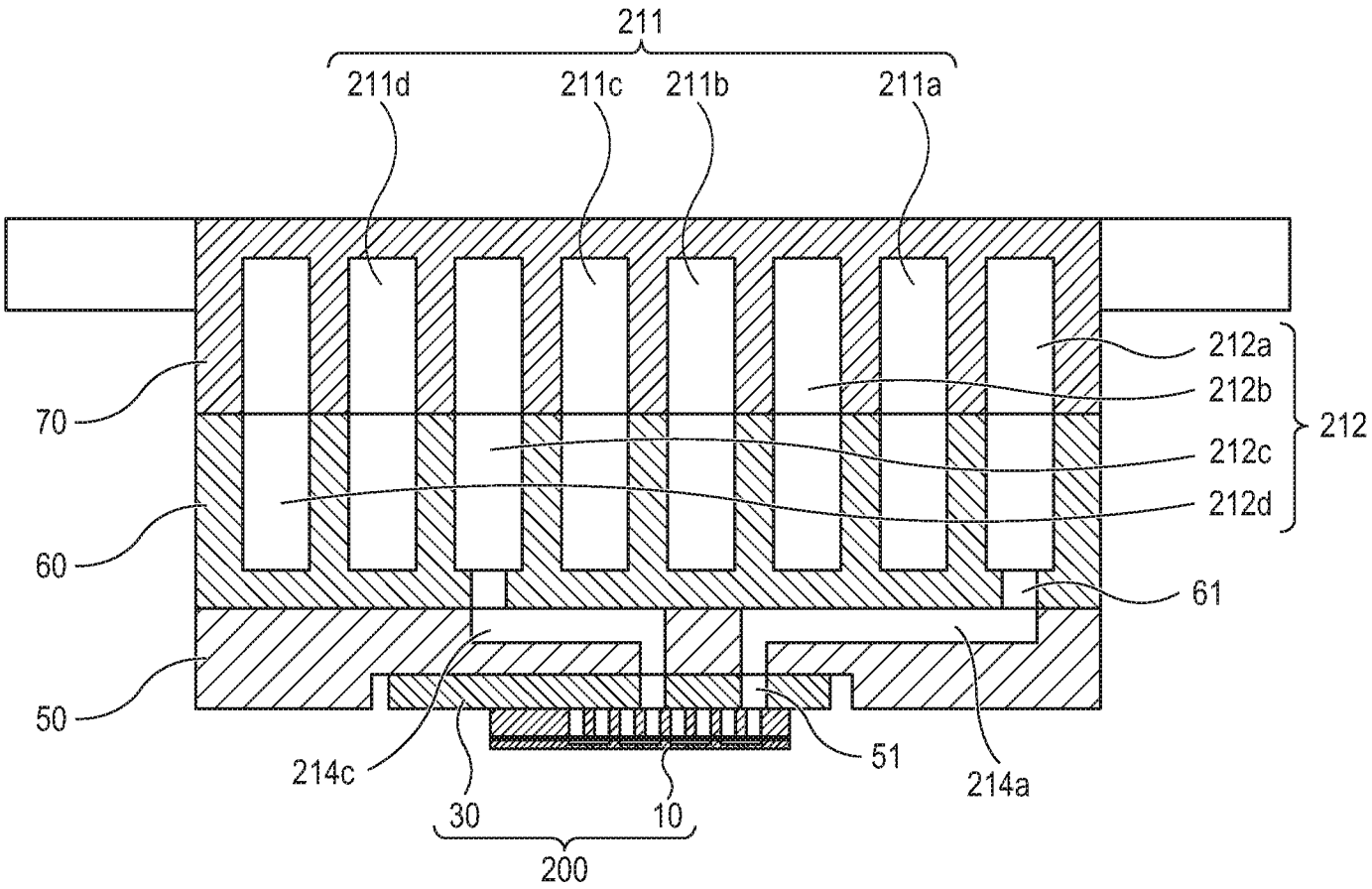
FIG. 9 is a view illustrating a section taken along line IX-IX of FIG. 8.

FIG. 9 is a view illustrating a section taken along IX-IX of FIG. 8. The individual recovery flow passages (214*a*, 214*c*) communicate with a discharge module 200 via the communication ports 51. Although only the individual recovery flow passages (214*a*, 214*c*) are illustrated in FIG. 9, in another section, as illustrated in FIG. 8, the individual supply flow passages 213 and the discharge module 200 communicate with each other. Flow passages for supplying the ink from the first flow passage member 50 to energy generating elements 15 provided in a recording element substrate 10 are formed in a supporting member 30 and the recording element substrate 10 that are included in each discharge module 200. Moreover, flow passages for recovering (recirculating) some or all of the liquid supplied to the energy generating elements 15 in the first flow passage member 50 are formed in the supporting member 30 and the recording element substrate 10.

Here, a common supply flow passage 211 for each color is connected to the negative-pressure control unit 230 (high-pressure side) for the corresponding color via a liquid supply unit 220, and a common recovery flow passage 212 is connected to the negative-pressure control unit 230 (low-pressure side) via the liquid supply unit 220. A differential pressure (pressure difference) is caused between the common supply flow passage 211 and the common recovery flow passage 212 by the negative-pressure control unit 230. For this reason, as illustrated in FIGS. 8 and 9, an ink flow, which flows into the common supply flow passage 211—the individual supply flow passage 213*a*—the recording element substrate 10—the individual recovery flow passage 213*b*—the common recovery flow passage 212 in this order for each ink color is generated within the liquid discharge head of the present embodiment in which the respective flow passages are connected to each other.

<Description of Discharge Module>

Figure 10A:
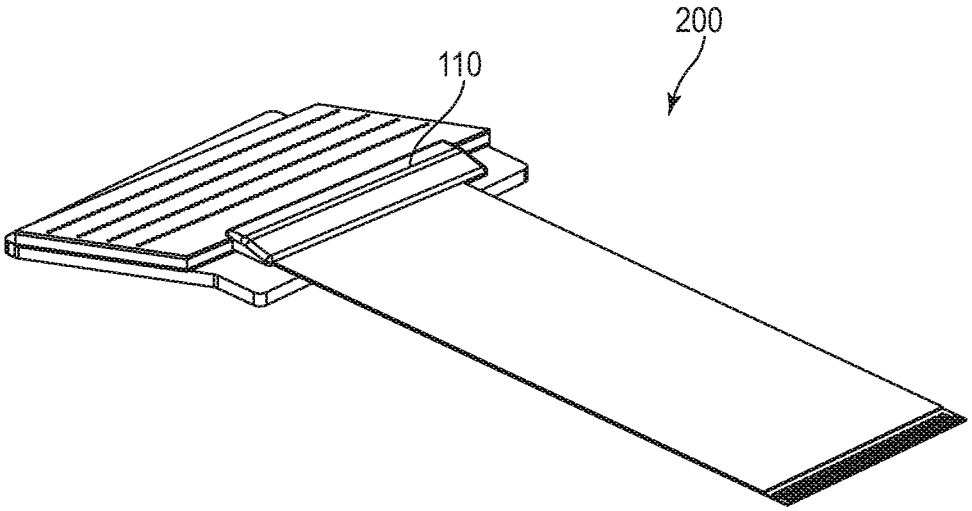
FIG. 10A is a perspective view illustrating one discharge module.
Figure 10B:
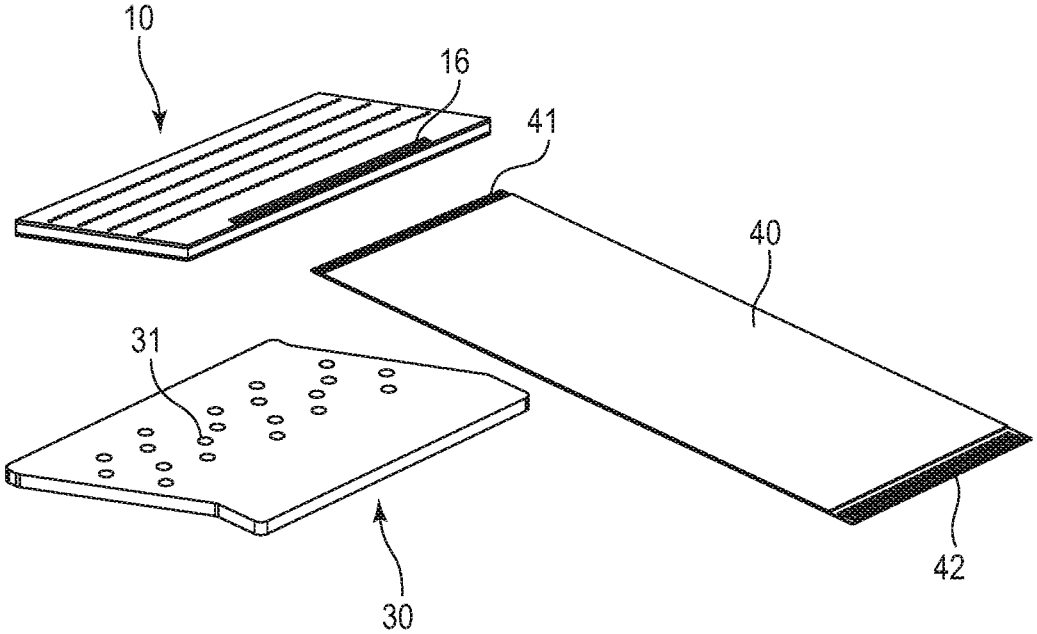
FIG. 10B is an exploded perspective view illustrating one discharge module.

FIG. 10A is a perspective view illustrating one discharge module 200, and FIG. 10B is an exploded view of the discharge module 200. As a method of manufacturing the discharge module 200, first, a recording element substrate 10 and a flexible wiring substrate 40 are bonded onto a supporting member 30 provided with liquid communication ports 31 in advance.

Then, terminals 16 on the recording element substrate 10 and terminals 41 on the flexible wiring substrate 40 are electrically connected to each other by wire bonding, and thereafter, wire-bonded parts (electrical connection parts) are covered and sealed with a sealing material 110. Terminals 42 of the flexible wiring substrate 40 opposite to the recording element substrate 10 are electrically connected to connecting terminals 93 (refer to FIG. 6) of the electrical wiring substrate 90. Since the supporting member 30, is a support body that supports the recording element substrate 10, and is a flow passage member that allows the recording element substrate 10 and the flow passage member 210 to fluidly communicate with each other, a supporting member, which has high flatness and can be joined to the recording element substrate with sufficiently high reliability, is preferable.

Alumina or a resin material can be an example as the material.

<Description of Structure of Recording Element Substrate>

Figure 11A:
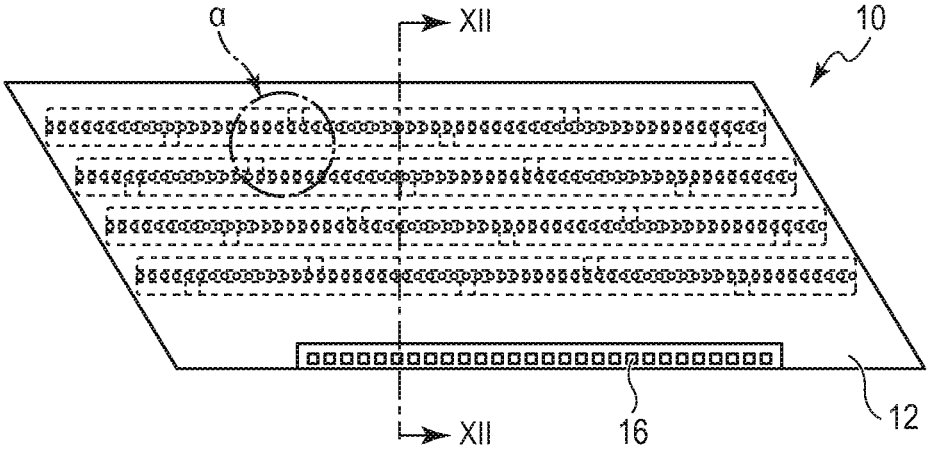
FIG. 11A is a plan view of a recording element substrate.
Figure 11B:
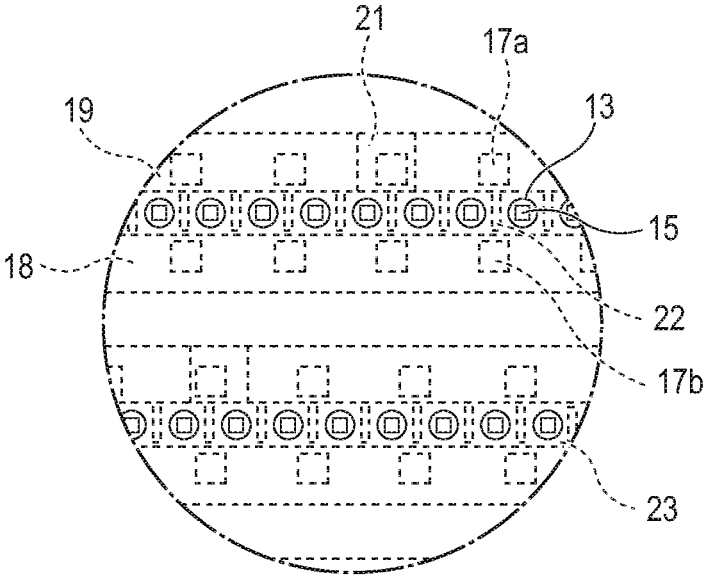
FIG. 11B is a partially enlarged view of the recording element substrate.
Figure 11C:
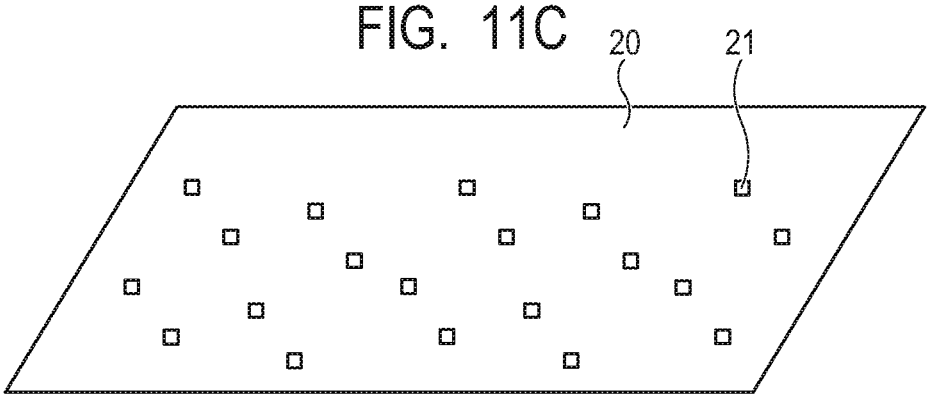
FIG. 11C is a plan view of a back side of the surface illustrated in FIG. 11A.

FIG. 11A is a plan view illustrating a surface of the recording element substrate 10 in which discharge ports 13 are formed, FIG. 11B illustrates an enlarged view of a portion indicated by a of FIG. 11A, and FIG. 11C illustrates a plan view of a back surface of FIG. 11A. Here, the configuration of the recording element substrate 10 in the present embodiment will be described. As illustrated in FIG. 11A, four discharge port lines corresponding to the respective ink colors are formed in a discharge port forming member 12 of the recording element substrate 10. In addition, hereinafter, a direction in which a discharge port line in which a plurality of discharge ports 13 is arranged extends is referred to as a "discharge port line direction". As illustrated in FIG. 11B, an energy generating element 15 that is a heat generating element for bubbling the liquid with heat energy is disposed at a position corresponding to each discharge port 13. A pressure chamber 23 that is a portion of a flow passage 24 (here, not illustrated) including the energy generating element 15 therein is partitioned by a partition wall 22.

The energy generating element 15 is electrically connected to a terminal 16 by electrical wiring (not illustrated) provided in the recording element substrate 10. Also, the energy generating element 15 generates heat on the basis of a pulse signal input via the electrical wiring substrate 90 (refer to FIG. 6) and the flexible wiring substrate 40 (refer to FIG. 10B) from a control circuit of the recording apparatus 1000, and boil the liquid. The liquid is discharged from the discharge port 13 by a bubbling force resulting from this boiling. As illustrated in FIG. 11B, a supply flow passage 18 extends on one side along each discharge port line, and a recovery flow passage 19 extends on the other side along each discharge port line. The supply flow passage 18 and the recovery flow passage 19 are flow passages that extend in the discharge port line direction provided in the recording element substrate 10, and communicate with the discharge ports 13 via supply ports 17*a* and recovery ports 17*b*, respectively.

As illustrated in FIG. 11C, a sheet-like cover plate 20 is laminated on a back surface of the recording element substrate 10 in which the discharge ports 13 are formed, and the cover plate 20 is provided with a plurality of openings 21 that communicates with the supply flow passage 18 and the recovery flow passage 19 to be described below. In the present embodiment, the cover plate 20 is provided with three openings 21 with respect to one supply flow passage 18 and two openings 21 with respect to one recovery flow passage 19. As illustrated in FIG. 11B, each opening 21 of the cover plate 20 communicates with a plurality of communication ports 51 illustrated in FIG. 7A. The cover plate 20 can have sufficient corrosion resistance against the liquid. Additionally, from a viewpoint of preventing color mixing, high accuracy is required for the opening shape and the opening position of the openings 21. For this reason, as the material of the cover plate 20, the openings 21 can be provided by a photolithographic process, using a photosensitive resin material or a silicon plate. In this way, the cover plate 20 converts the pitch of the flow passages depending on the openings 21, preferably has a smaller thickness if pressure loss is taken into consideration, and is preferably made of a film-like member.

Figure 12:
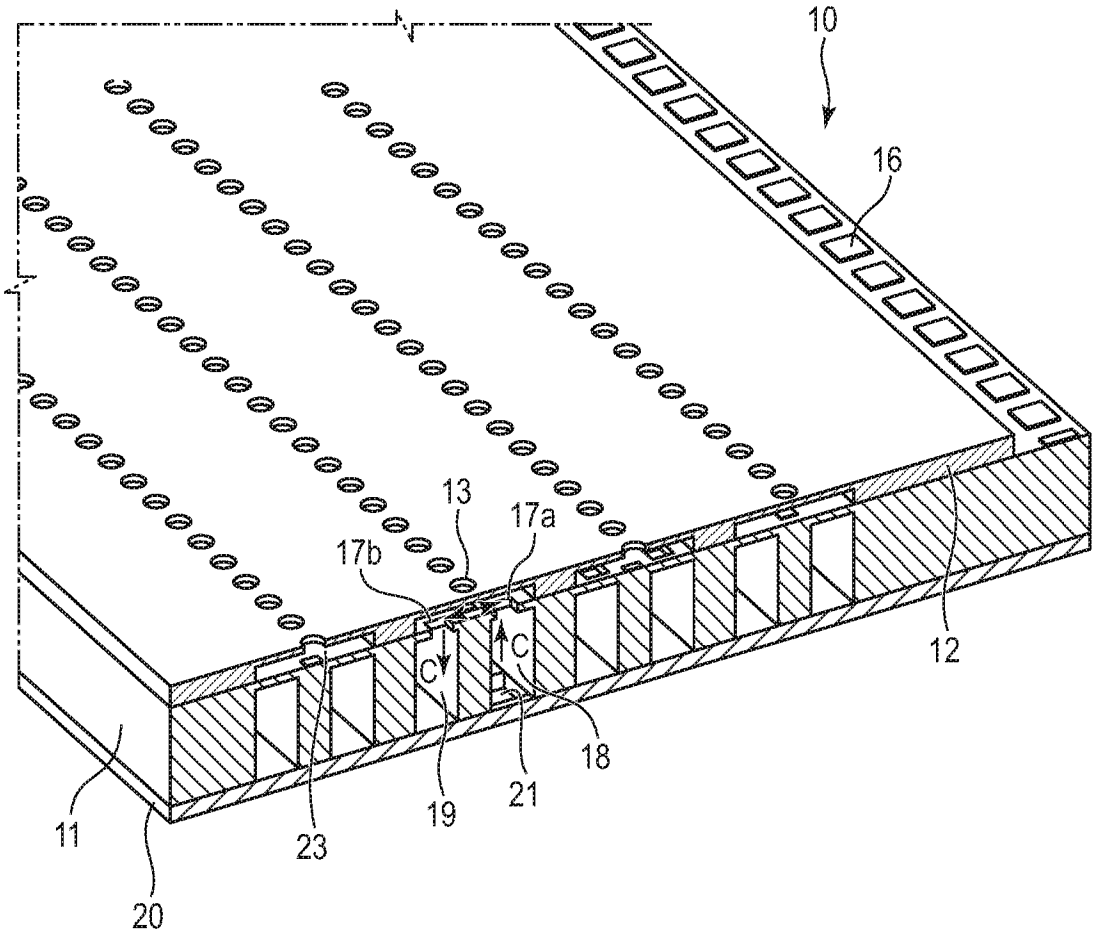
FIG. 12 is a perspective view illustrating a section taken along line XII-XII of FIG. 11A.

FIG. 12 is a perspective view illustrating a section of the recording element substrate 10 and the cover plate 20 taken along XII-XII in FIG. 11A. Here, the flow of the liquid within the recording element substrate 10 will be described. The cover plate 20 has a function as a lid that forms portions of walls of the supply flow passages 18 and the recovery flow passages 19 that are formed in a substrate 11 of the recording element substrate 10. In the recording element substrate 10, the substrate 11 formed of Si and the discharge port forming member 12 formed of photosensitive resin are laminated on each other, and the cover plate 20 is joined to a back surface of the substrate 11. The energy generating elements 15 are formed on one surface side of the substrate 11 (refer to FIG. 11B), and grooves, which constitute the supply flow passages 18 and the recovery flow passages 19 that extend along the discharge port lines, are formed on a back surface side of the substrate 11. The supply flow passages 18 and the recovery flow passages 19, which are formed by the substrate 11 and the cover plate 20, are respectively connected to the common supply flow passages 211 and the common recovery flow passages 212 within the flow passage member 210, and a pressure difference is caused between each supply flow passage 18 and each recovery flow passage 19. When the liquid is discharged from the discharge ports 13 to perform recording, in a discharge port that does not perform the discharge, the liquid within the supply flow passage 18 provided within the substrate 11 flows to the recovery flow passage 19 via a supply port 17*a*, the pressure chamber 23, and a recovery port 17*b* due to this pressure difference (the arrow C of FIG. 12). That is, the liquid is supplied from the supply flow passage 18 to the inside of the flow passage (pressure chamber) 23, flows through the inside of the flow passage, and is recovered from the inside of the flow passage to the outside of the flow passage through the recovery flow passage. Then, the liquid is again supplied from the supply flow passage 18 to the inside of the flow passage. In this way, the liquid inside the flow passage (pressure chamber) 23 can be circulated between the inside and the outside of the flow passage. Due to this flow, in a discharge port 13 and a pressure chamber 23 in which a discharge operation is not performed, viscosity-increased ink, bubbles, foreign matter, and the like, which are caused by evaporation from the discharge port 13, can be recovered to the recovery flow passage 19. Additionally, it is possible to suppress an increase in viscosity of the ink of the discharge ports 13 or the pressure chambers 23, or an increase in the density of a coloring material. The liquid recovered to the recovery flow passage 19 is recovered in order of a communication port 51, an individual recovery flow passage 214, and a common recovery flow passage 212 within the flow passage member 210 through the opening 21 of the cover plate 20 and a liquid communication port 31 (refer to FIG. 10B) of the supporting member 30. Then, the liquid is recovered to the supply path of the recording apparatus 1000. That is, the liquid supplied from the recording apparatus body to the liquid discharge head 3 flows, is supplied, and is recovered in the following order.

The liquid flows into the liquid discharge head 3 from the liquid connection unit 111 of the liquid supply unit 220. Then, the liquid is supplied in order of the joint rubber 100, a communication port 72 and a common flow passage groove 71 that are provided in the third flow passage member, a common flow passage groove 62 and a communication port 61 that are provided in the second flow passage member, and an individual flow passage groove 52 and a communication port 51 that are provided in the first flow passage member.

Thereafter, the liquid is supplied to the pressure chamber 23 via a liquid communication port 31 provided in the supporting member 30, the opening 21 provided in the cover plate 20, and the supply flow passage 18 and the supply port 17*a* that are provided in the substrate 11 in this order. The liquid, which is not discharged from the discharge port 13 in the liquid supplied to the pressure chamber 23, flows through a recovery port 17*b* and a recovery flow passage 19 that are provided in the substrate 11, and the opening 21 provided in the cover plate 20, and the liquid communication port 31 provided in the supporting member 30 in order. Thereafter, the liquid flows through the communication port 51 and the individual flow passage groove 52 that are provided in the first flow passage member, the communication port 61 and the common flow passage groove 62 that are provided in the second flow passage member, the common flow passage groove 71 and the communication port 72 that are provided in the third flow passage member 70, and the joint rubber 100 in this order. Then, the liquid flows from the liquid connection unit 111 provided in the liquid supply unit 220 to the outside of the liquid discharge head 3.

In the first circulation form illustrated in FIG. 2, the liquid, which has flowed in from the liquid connection unit 111, is supplied to the joint rubber 100 after passing through the negative-pressure control unit 230. Additionally, in the second circulation form illustrated in FIG. 3, the liquid recovered from the pressure chamber 23 flows from the liquid connection unit 111 via the negative-pressure control unit 230 to the outside of the liquid discharge head after passing through the joint rubber 100. Additionally, the whole liquid, which has flowed in from one end of the common supply flow passage 211 of the liquid discharge unit 300, is not necessarily supplied to the pressure chamber 23 via an individual supply flow passage 213*a*. That is, in the liquid that has flowed in from one end of the common supply flow passage 211, there is also a liquid that flows from the other end of the common supply flow passage 211 to the liquid supply unit 220 without flowing into the individual supply flow passage 213*a*. By including a path along which the liquid flows without passing through the recording element substrate 10 in this way, a backflow of a circulatory flow of the liquid can be suppressed even in a case where the recording element substrate 10 including a flow passage that is thin and is relatively large in flow assistance as in the present embodiment is used. In this way, in the liquid discharge head 3 of the present embodiment, the increase in viscosity of the liquid in the pressure chamber 23 or a part near the discharge port, or the like can be suppressed. Thus, a discharge error or non-discharge can be suppressed, and consequently, high-quality recording can be performed.

<Description of Positional Relationship Between Recording Element Substrates>

Figure 13:
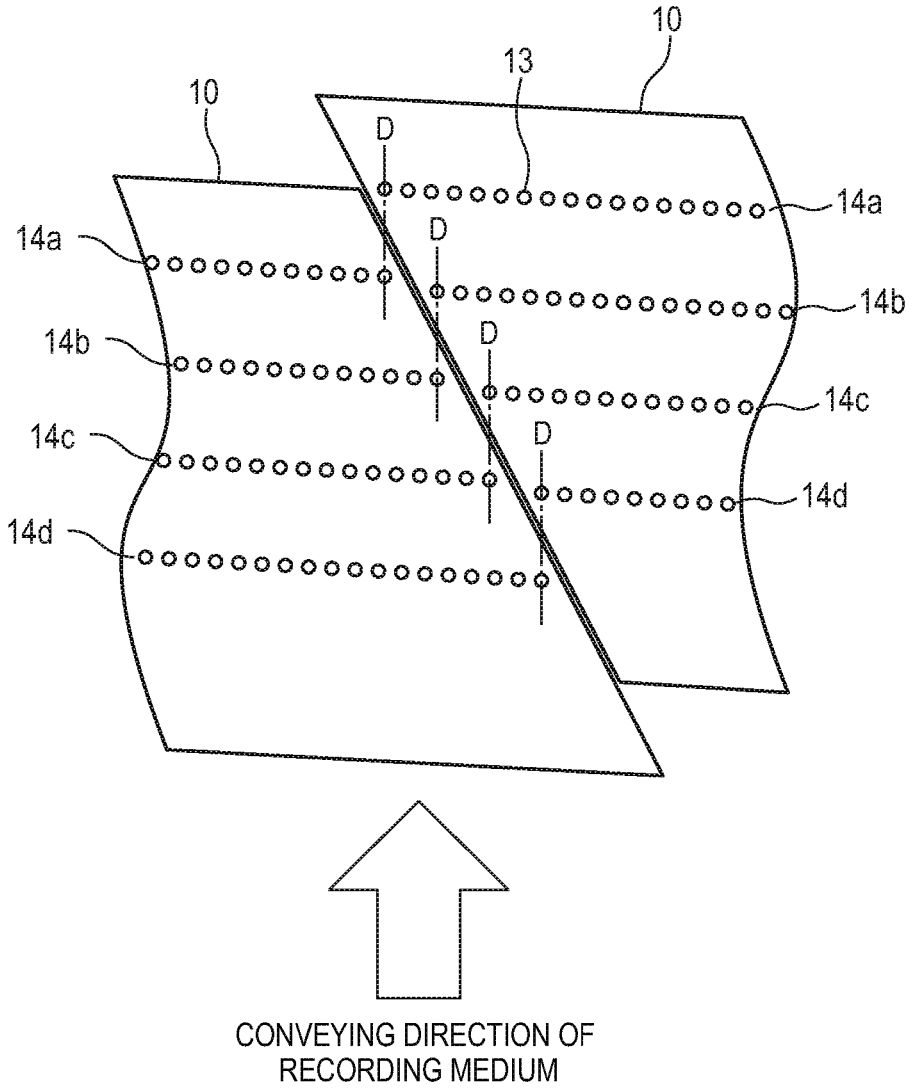
FIG. 13 is a partially enlarged plan view illustrating adjacent parts of recording element substrates.

FIG. 13 is a partially enlarged plan view illustrating adjacent parts of recording element substrates in two adjacent discharge modules 200. In the present embodiment, recording element substrates having a substantially parallelogram shape are used. The respective discharge port lines (14*a* to 14*d*) of each recording element substrate 10 in which the discharge ports 13 are arranged is disposed so as to be tilted at a certain angle with respect to the conveying direction of the recording medium. Also, on discharge port lines in the adjacent parts between the recording element substrates 10, at least one discharge port is overlapped in the conveying direction of the recording medium. In FIG. 13, there is a relationship in which two discharge ports on a line D overlap each other. By virtue of such a configuration, even in a case where the position of the recording element substrate 10 slightly shifts from a predetermined position, black striping or white spotting of a recording image can be made inconspicuous by the drive control of the discharge ports that overlap each other. The plurality of recording element substrates 10 may be disposed on a straight line (in-line) instead of a zigzag arrangement. Even in this case, by virtue of the configuration as illustrated in FIG. 13, countermeasures against the black striping or white spotting in connected parts between the recording element substrates 10 can be performed while suppressing an increase in the length of the recording element substrate 10 in the conveying direction of the recording medium. In addition, in the present embodiment, the principal planes of the recording element substrates have a parallelogram shape. However, the disclosure is not limited to this. For example, even in a case where recording element substrates having an oblong shape, a trapezoidal shape, or other shapes are used, the configuration of the disclosure can be preferably applied.

(Ink Jet Recording Apparatus of Second Form)

Next, the configurations of an ink jet recording apparatus 2000 and a liquid discharge head 2003 of a second form that are different from the ink jet recording apparatus of the above-described first form will be described. In addition, in the following descriptions, only portions different from the recording apparatus of the first form will be described, and description of substantially the same portions as those of the first form will be omitted.

<Description of Ink Jet Recording Apparatus>

Figure 21:
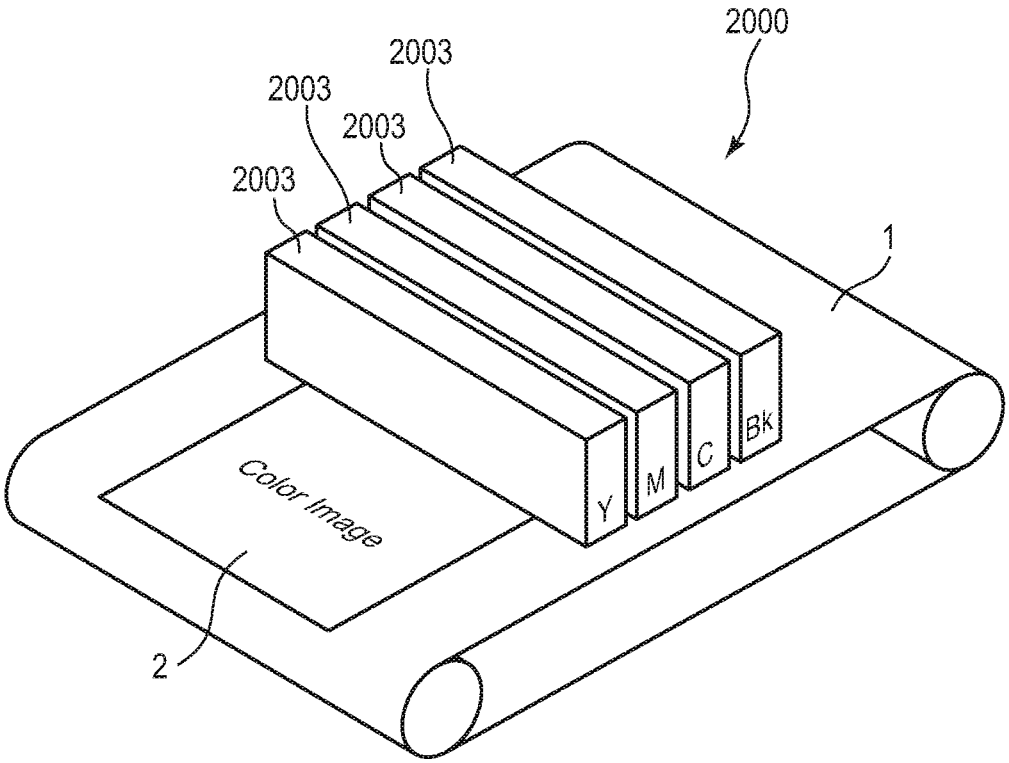
FIG. 21 is a view illustrating an ink jet recording apparatus.

FIG. 21 is a view illustrating the ink jet recording apparatus 2000 of the second form. The recording apparatus 2000 of the present embodiment is different from the first embodiment that full color recording is performed on a recording medium by disposing four liquid discharge heads 2003 for monochrome corresponding to the inks of the cyan C, the magenta M, the yellow Y and the black K in parallel. In the first embodiment, the number of discharge port lines that can be used per one color is one line, whereas in the present embodiment, the number of discharge port lines that can be used per one color is 20 lines. For this reason, extremely high-speed recording is possible by appropriately allocating recording data to a plurality of discharge port lines to perform recording. Moreover, even if there is a discharge port that becomes non-discharge, as discharge is performed in an interpolation manner from discharge ports of another line at a position corresponding to the discharge port in the conveying direction of the recording medium, reliability is improved, and the apparatus is suitable for commercial recording or the like. Similarly to the first embodiment, the supply system, the buffer tank 1003 (refer to FIG. 2 and FIG. 3), and the main tank 1006 (refer to FIG. 2 and FIG. 3) of the recording apparatus 2000 are fluidly connected to each liquid discharge head 2003. Additionally, an electrical control unit, which transmits electrical power and a discharge control signal to the liquid discharge head 2003, is electrically connected to each liquid discharge head 2003.

<Description of Circulation Path>

Similarly to the first embodiment, as a liquid circulation path between the recording apparatus 2000 and the liquid discharge head 2003, the first and second circulation forms illustrated in FIG. 2 or FIG. 3 can be used.

<Description of Liquid Discharge Head Structure>

Figure 14A:
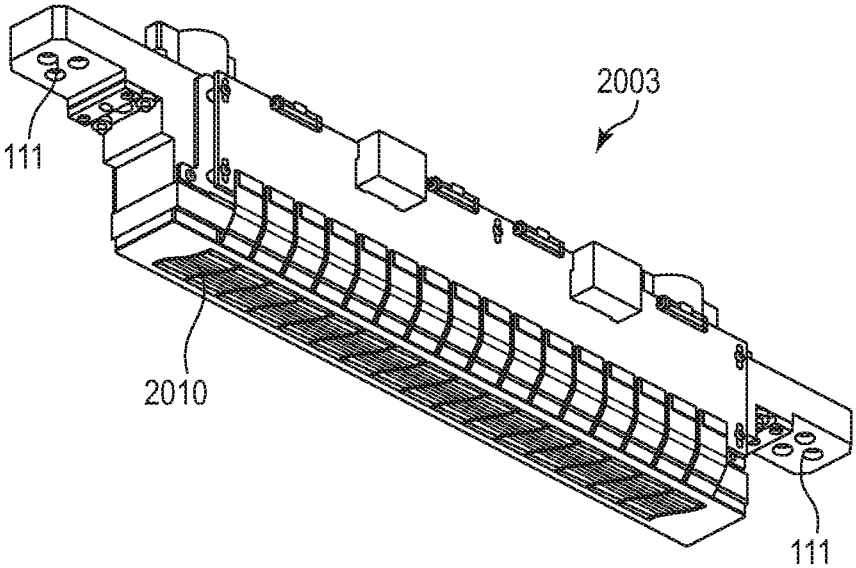
FIG. 14A and FIG. 14B are perspective views illustrating the liquid discharge head.
Figure 14B:
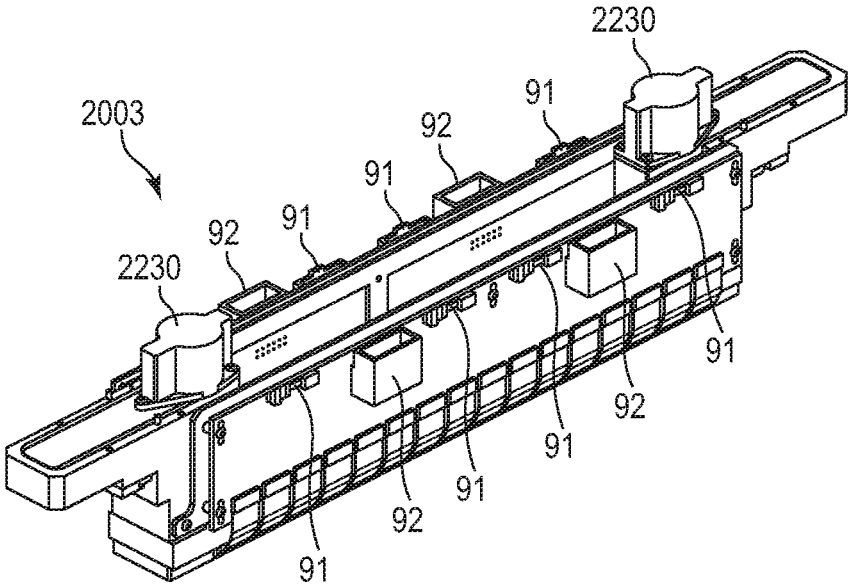

FIGS. 14A and 14B are perspective views illustrating the liquid discharge head 2003 related to the present embodiment. The liquid discharge head 2003 is a line-type recording head that includes sixteen recording element substrates 2010 that are linearly arranged in a longitudinal direction of the liquid discharge head 2003, and discharges one-color ink. The liquid discharge head 2003 includes the liquid connection unit 111, the signal input terminals 91, and the electrical power supply terminals 92 similarly to the first form. However, since the liquid discharge head 2003 of the present form has more discharge port lines than the head of the first form, the signal output terminals 91 and the electrical power supply terminals 92 are disposed on both sides of the liquid discharge head 2003. Accordingly, voltage drop or signal transmission delay, which is caused in wiring parts provided in the recording element substrates 2010, can be reduced.

Figure 15:
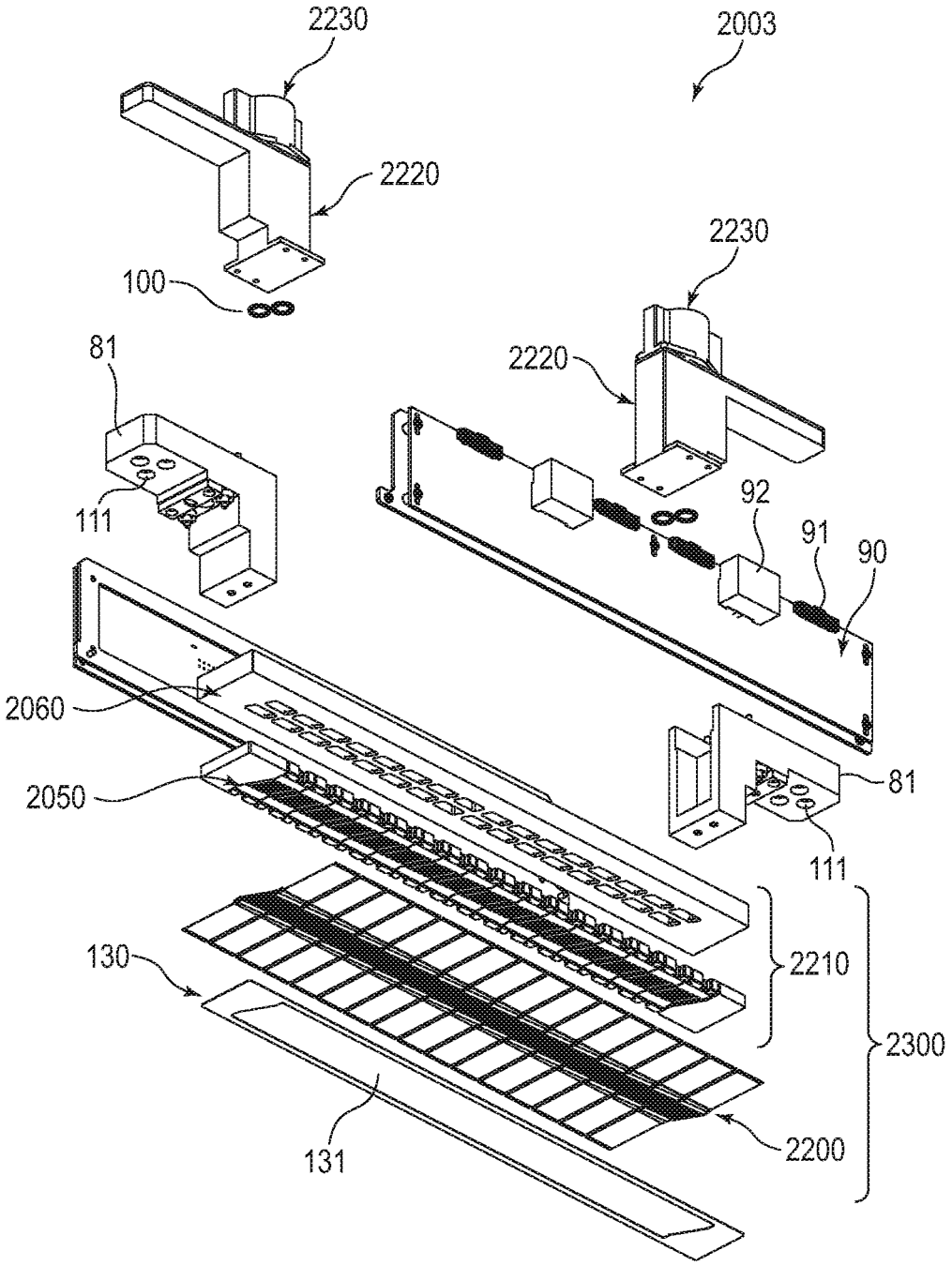
FIG. 15 is an exploded perspective view illustrating the liquid discharge head.

FIG. 15 is an exploded perspective view illustrating the liquid discharge head 2003, and illustrates respective components or units that constitute the liquid discharge head 2003 separately for each function. Although the roles of the respective units and members and the order of liquid circulation within the liquid discharge head are basically the same as those of the first embodiment, the functions of guaranteeing the rigidity of the liquid discharge head are different. In the first embodiment, the rigidity of the liquid discharge head is mainly guaranteed by the liquid discharge unit support part 81. However, in the liquid discharge head 2003 of the second embodiment, the rigidity of the liquid discharge head is guaranteed by a second flow passage member 2060 included in a liquid discharge unit 2300. The liquid discharge unit support part 81 in the present embodiment is connected to both end parts of the second flow passage member 2060, and the liquid discharge unit 2300 is mechanically combined with a carriage of the recording apparatus 2000 to perform positioning of the liquid discharge head 2003. A liquid supply unit 2220 including a negative-pressure control unit 2230, and the electrical wiring substrate 90 are combined with the liquid discharge unit support part 81. Filters (not illustrated) are respectively built within two liquid supply units 2220.

Two negative-pressure control units 2230 are set so as to control pressure with relatively high and low negative pressures that are different from each other. Additionally, as illustrated in FIGS. 14A and 14B, in a case where the negative-pressure control units 2230 on the high-pressure side and the low-pressure side are respectively installed at both end parts of the liquid discharge head 2003, the flows of the liquid in a common supply flow passage and a common recovery flow passage that extend in the longitudinal direction of the liquid discharge head 2003 faces each other. In such a configuration, heat exchange is promoted between the common supply flow passage and the common recovery flow passage, and a temperature difference within the two common flow passages is reduced. Accordingly, there are advantages that a temperature difference in the plurality of respective recording element substrates 2010 provided along the common flow passages decreases, and recording unevenness resulting from the temperature difference does not occur easily.

Next, details of the flow passage member 2210 of the liquid discharge unit 2300 will be described. As illustrated in FIG. 15, the flow passage member 2210 is obtained by laminating a first flow passage member 2050 and a second flow passage member 2060, and distributes the liquid, which is supplied from the liquid supply unit 2220, to the respective discharge modules 2200. Additionally, the flow passage member 2210 functions as a flow passage member for returning the liquid, which is recirculated from the discharge modules 2200, to the liquid supply unit 2220. The second flow passage member 2060 of the flow passage member 2210 is a flow passage member that has the common supply flow passage and the common recovery flow passage formed therein, and has mainly a function of bearing the rigidity of the liquid discharge head 2003. For this reason, as the material of the second flow passage member 2060, sufficient corrosion resistance against the liquid and high machine strength can be provided. Specifically, SUS, Ti, alumina, or the like can be used.

Figure 16A:
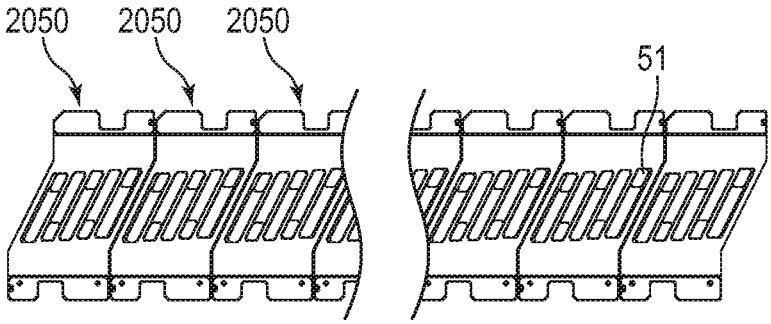
FIG. 16A, FIG. 16B, FIG. 16C, FIG. 16D and FIG. 16E are views illustrating flow passage members that constitute the liquid discharge head.
Figure 16B:
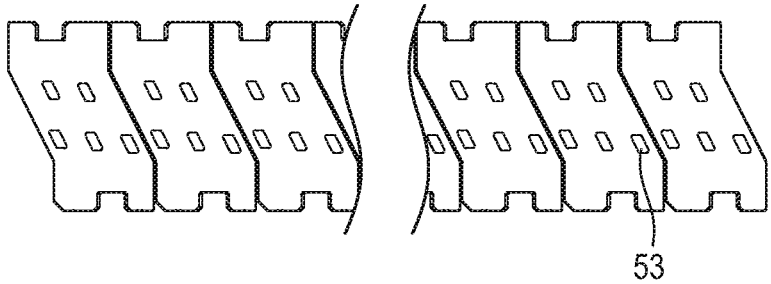

FIG. 16A is a view illustrating the surface of the first flow passage member 2050 on which the discharge modules 2200 are mounted, and FIG. 16B is a view illustrating a back surface of the first flow passage member that abuts against the second flow passage member 2060. Unlike the first form, first flow passage members 2050 in the present form are obtained by adjacently arranging a plurality of members that correspond to the discharge modules 2200, respectively. By taking the structure divided in this way, the plurality of modules can be arranged so as to respond to the length of the liquid discharge head 2003. Thus, for example, the disclosure can be particularly preferably applied to a liquid discharge head of comparatively long scales corresponding to B2 size and a length equal to or larger than the B2 size.

Figure 16C:
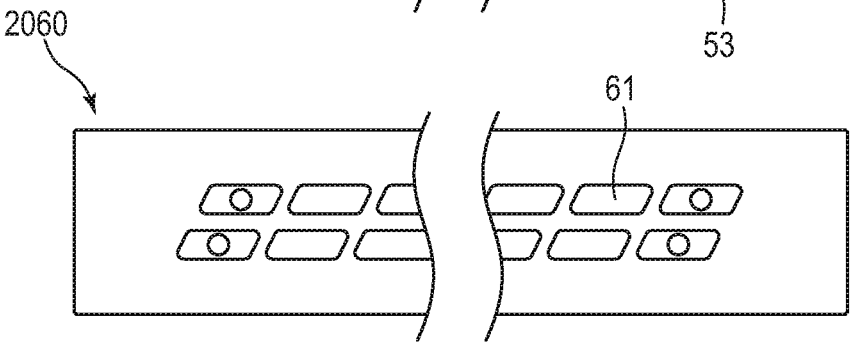
Figure 16D:
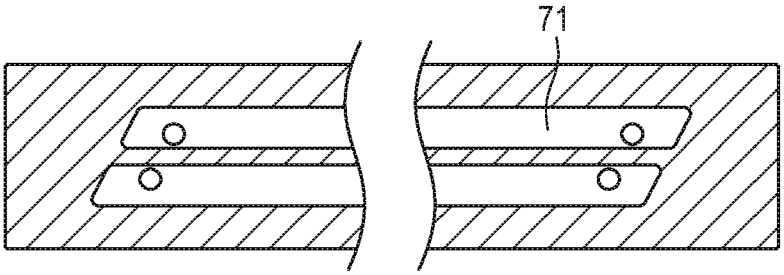
Figure 16E:
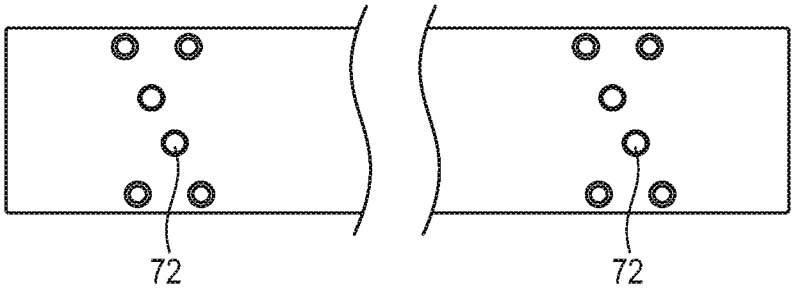

As illustrated in FIG. 16A, the communication ports 51 of the first flow passage members 2050 fluidly communicate with the discharge modules 2200, and as illustrated in FIG. 16B, the individual communication ports 53 of the first flow passage members 2050 fluidly communicate with the communication ports 61 of the second flow passage member 2060. FIG. 16C illustrates the surface of the second flow passage member 60 that abuts the first flow passage members 2050, FIG. 16D illustrates a section of a thickness-direction central part of the second flow passage member 60, and FIG. 16E is a view illustrating the surface of the second flow passage member 2060 that abuts against the liquid supply unit 2220. The functions of the flow passages or communication ports of the second flow passage member 2060 are the same as those for one color, of the first form. One of the common flow passage grooves 71 of the second flow passage member 2060 is a common supply flow passage 2211 illustrated in FIG. 17 to be described below, the other thereof is a common recovery flow passage 2212, and both the common flow passage grooves are respectively provided in the longitudinal direction of the liquid discharge head 2003 and allow the liquid to be supplied from the one end side to the other end side. In the present form, unlike the first form, the flows of the liquid in the common supply flow passage 2211 and the common recovery flow passage 2212 have mutually opposite directions.

Figure 17:
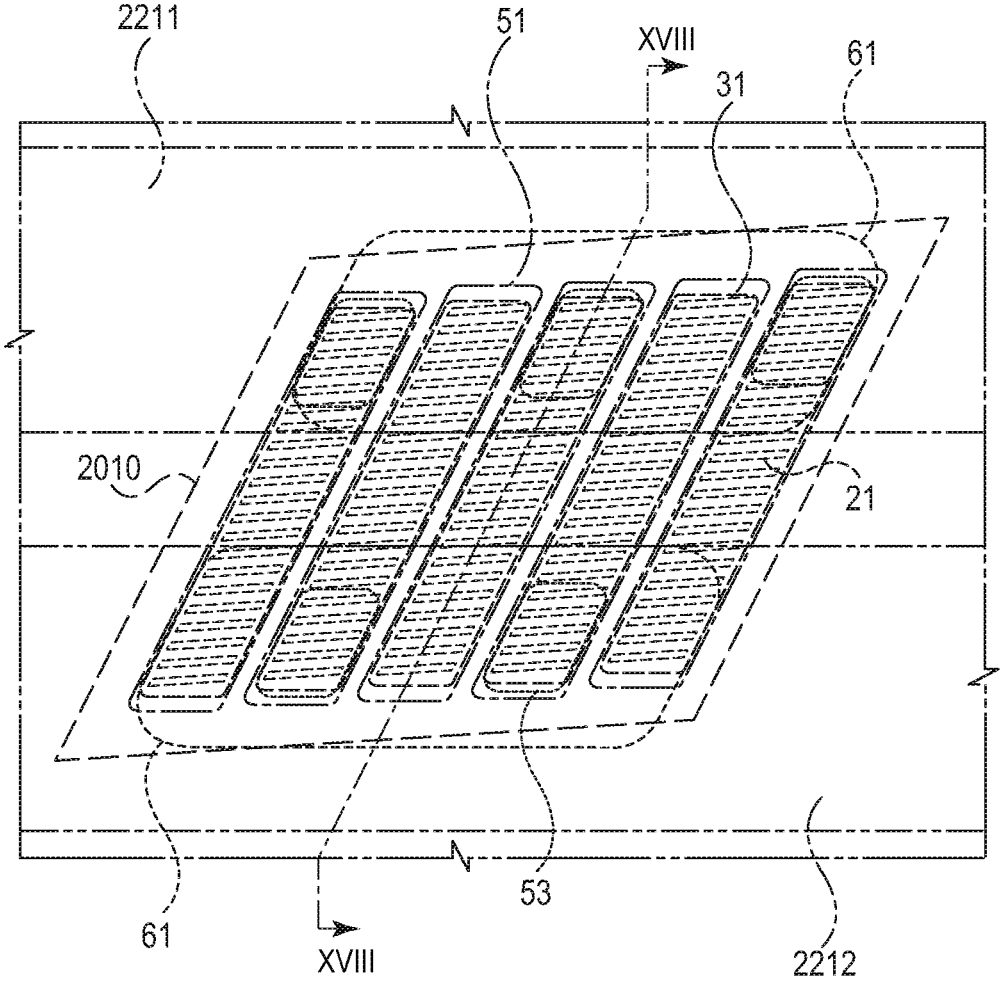
FIG. 17 is a perspective view illustrating a connection relationship of the liquid between the recording element substrate and the flow passage member.

FIG. 17 is a perspective view illustrating a liquid connection relationship between the recording element substrate 2010 and the flow passage member 2210. A set of the common supply flow passage 2211 and the common recovery flow passage 2212 that extend in the longitudinal direction of the liquid discharge head 2003 are provided within the flow passage member 2210.

The communication ports 61 of the second flow passage member 2060 are aligned with and connected to the individual communication ports 53 of the respective first flow passage member 2050. Also, liquid supply paths that allow communication from the communication ports 72 of the second flow passage member 2060 via the common supply flow passage 2211 to the communication ports 51 of the first flow passage members 2050 are formed. Similarly, liquid supply paths that allow communication from the communication ports 72 of the second flow passage member 2060 via the common recovery flow passage 2212 to the communication ports 51 of the first flow passage members 2050 are also formed.

Figure 18:
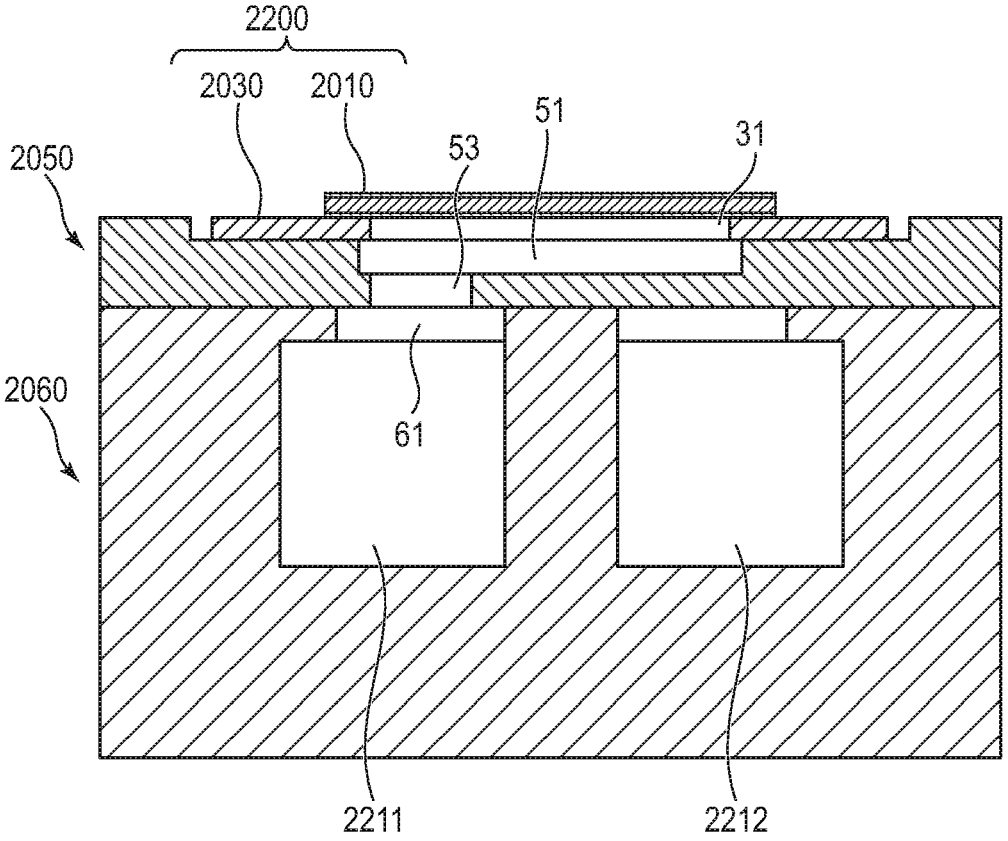
FIG. 18 is a view illustrating a section taken along line XVIII-XVIII of FIG. 17.

FIG. 18 is a view illustrating a section taken along line XVIII-XVIII of FIG. 17. The common supply flow passage 2211 is connected to a discharge module 2200 via a communication port 61, an individual communication port 53, and a communication port 51. Although not illustrated in FIG. 18, in another section, it is clear from FIG. 17 that the common recovery flow passage 2212 is connected to the discharge module 2200 with the same path. Similarly to the first embodiment, in the recording element substrate 2010 of each discharge module 2200, flow passages that communicate with the respective discharge ports are formed, some or all of the supplied liquid can pass through a discharge port that pauses a discharge operation, and be recirculated. Additionally, similarly to the first form, the common supply flow passage 2211 is connected to the negative-pressure control unit 2230 (high-pressure side) via the liquid supply unit 2220, and the common recovery flow passage 2212 is connected to the negative-pressure control unit 2230 (low-pressure side) via the liquid supply unit 2220.

Therefore, due to a pressure difference therebetween, a flow, which passes through a discharge port of the recording element substrate 2010 from the common supply flow passage 2211 and flows into the common recovery flow passage 2212, is generated.

<Description of Discharge Module>

Figure 19A:
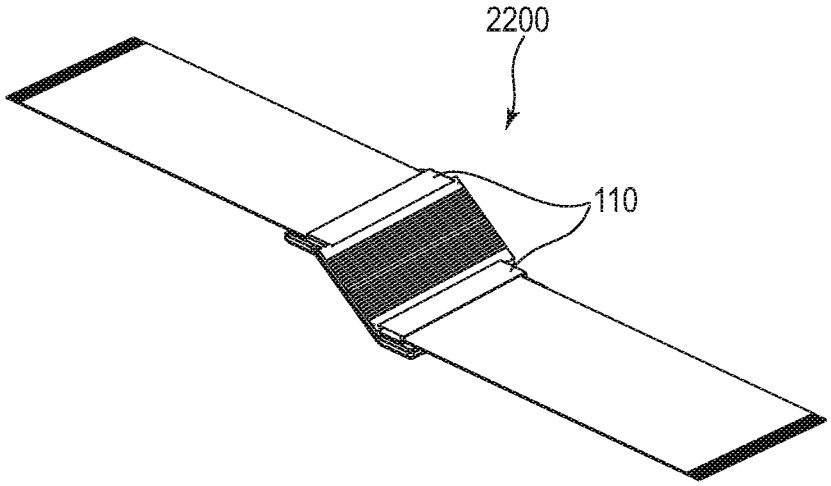
FIG. 19A is a perspective view illustrating a discharge module in the liquid discharge head.
Figure 19B:
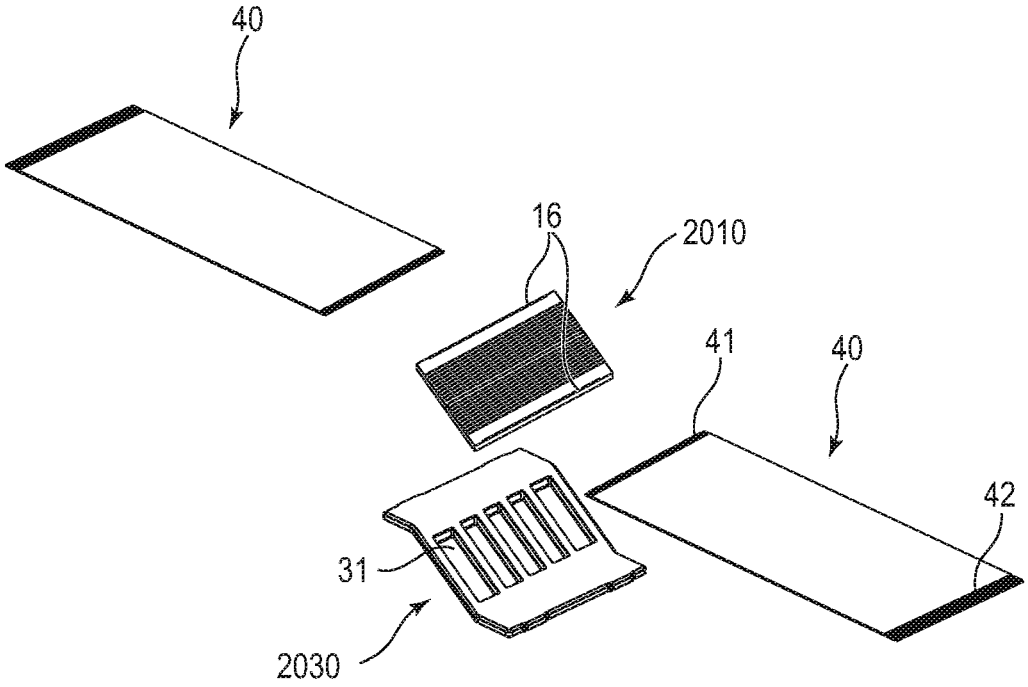
FIG. 19B is an exploded view illustrating the discharge module in the liquid discharge head.

FIG. 19A is a perspective view illustrating one discharge module 2200, and FIG. 19B is an exploded view of the discharge module 2200. A difference from the first form is that a plurality of terminals 16 is disposed at each of both side parts (each of long side parts of the recording element substrate 2010) along a plurality of discharge port line directions of the recording element substrate 2010. As a result, two flexible wiring substrates 40 to be electrically connected to the recording element substrate 2010 are also disposed with respect to one recording element substrate 2010. This is because the number of discharge port lines to be provided in the recording element substrate 2010 is 20 lines, which are markedly larger than the eight lines of the first embodiment and because a maximum distance from the terminals 16 to a recording element is shortened to reduce voltage drop or signal delay which is caused in the wiring parts within the recording element substrate 2010. Additionally, the liquid communication ports 31 of the supporting member 2030 are provided in the recording element substrate 2010 and are open so as to straddle all the discharge port lines. Other points are the same as those of the first embodiment.

<Description of Structure of Recording Element Substrate>

Figure 20A:
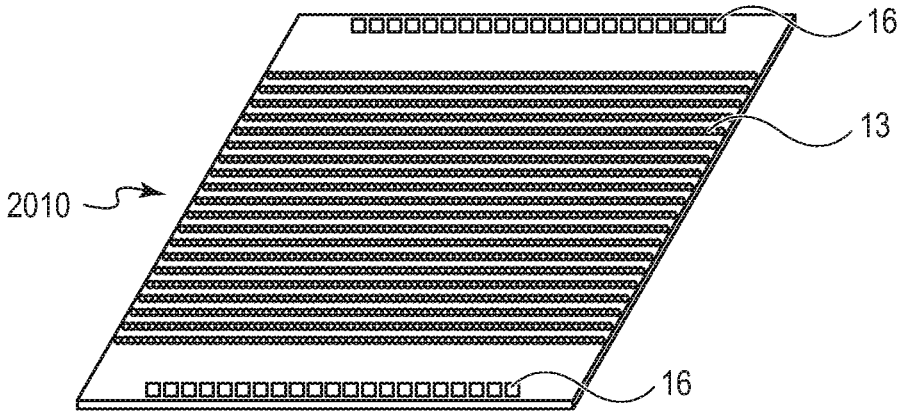
FIG. 20A is a schematic view illustrating the surface of the recording element substrate on which discharge ports are disposed.
Figure 20B:
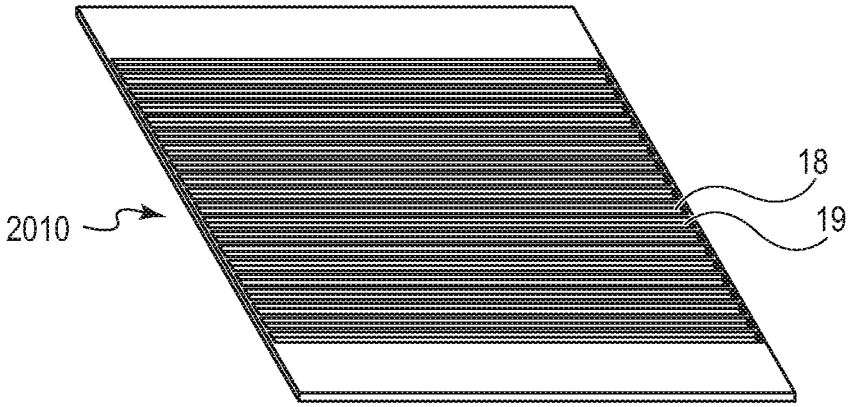
FIG. 20B is a schematic view illustrating a surface of the recording element substrate.
Figure 20C:
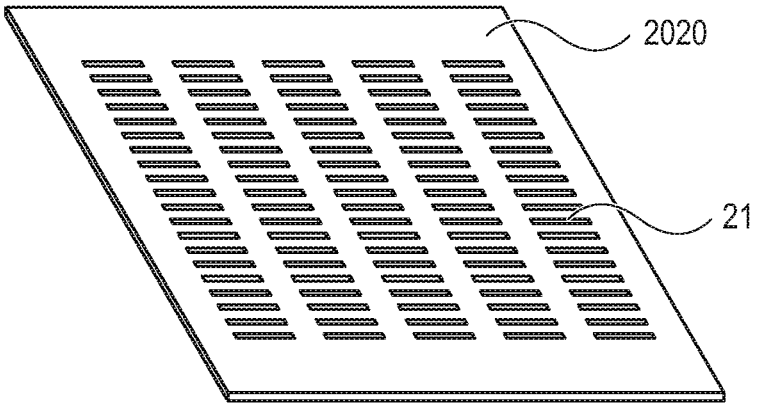
FIG. 20C is a schematic view illustrating a back surface of the surface on which the discharge ports are disposed.

FIG. 20A is a schematic view illustrating the surface of the recording element substrate 2010 in which discharge ports 13 are disposed, and FIG. 20C is a schematic view illustrating a back surface of the surface of FIG. 20A. FIG. 20B is a schematic view illustrating the surface of the recording element substrate 2010 in a case where a cover plate 2020 provided on a backside of the recording element substrate 2010 is removed in FIG. 20C. As illustrated in FIG. 20B, the supply flow passages 18 and the recovery flow passages 19 are alternatively provided along the discharge port line direction on a back surface of the recording element substrate 2010. Although the number of discharge port lines is markedly larger than that in the first embodiment, an essential difference from the first embodiment is that the terminals 16 are disposed at the both side parts along the discharge port line direction of the recording element substrate as mentioned above. The basic configurations, such as the set of the supply flow passage 18 and the recovery flow passage 19 being provided for each discharge port line and the cover plate 2020 being provided with the openings 21 that communicate with the liquid communication ports 31 of the supporting member 2030, are the same as those of the first embodiment.

In addition, the descriptions of the above embodiments do not limit the scope of the disclosure. As one example, a thermal system of generating bubbles by a heat generating element to discharge the liquid has been described in the present embodiment. However, the disclosure can also be applied to liquid discharge heads in which a piezoelectric system and other various liquid discharge systems are adopted.

In the present embodiment, the ink jet recording apparatus (recording apparatus) of the form in which the liquid, such as ink, is circulated between the tank and the liquid discharge head, has been described. However, other forms may be adopted. Another form may be, for example, a form in which the ink within a pressure chamber is made to flow without circulating the ink by providing two tanks on an upstream side and a downstream side of the liquid discharge head and causing the ink from one tank to the other tank.

Additionally, in the present embodiment, an example in which a so-called line-type head having a length corresponding to the width of a recording medium is used has been described. However, the disclosure can also be applied to a so-called serial liquid discharge head that performs recording while performing scanning with respect to the recording medium. The serial liquid discharge head includes, for example, a configuration in which one recording element substrate that discharges black ink and one recording element substrate that discharges color ink are mounted. However, the disclosure is not limited to this. That is, there may be adopted a form in which a short liquid discharge head, which has a plurality of recording element substrates disposed such that discharge ports overlap each other in the discharge port line direction, and is shorter than the width of a recording medium, is created, and the liquid discharge head is made to scan the recording medium.

Next, the first and the second embodiments of the disclosure related to structures of discharge ports and their vicinities in the liquid discharge heads of the first and second forms described above will be described.

First Embodiment

Figure 22A:
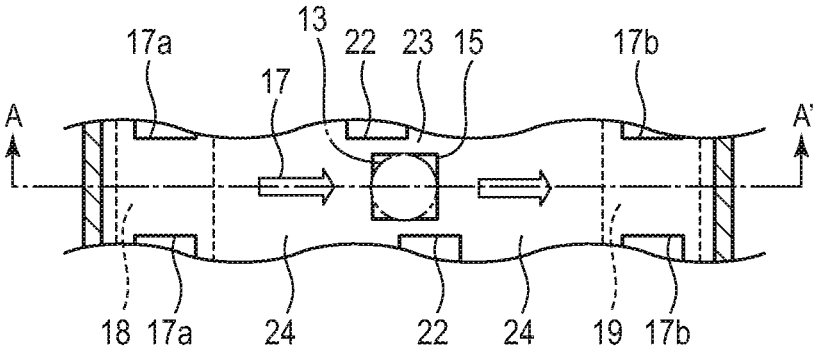
FIG. 22A, FIG. 22B and FIG. 22C are views illustrating the structure of discharge ports and ink flow passages in the vicinity thereof
Figure 22B:
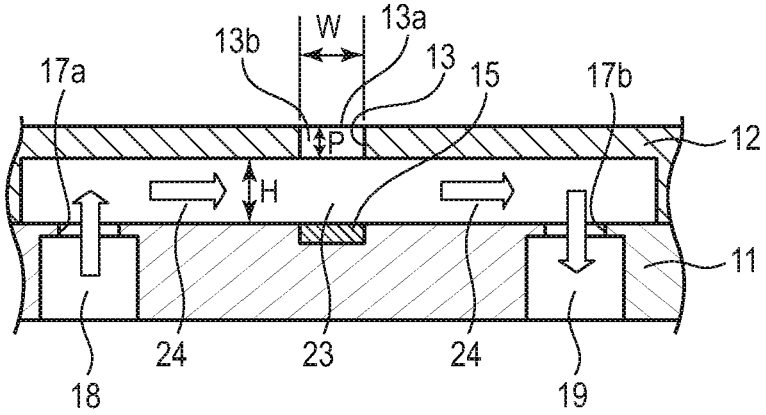
Figure 22C:
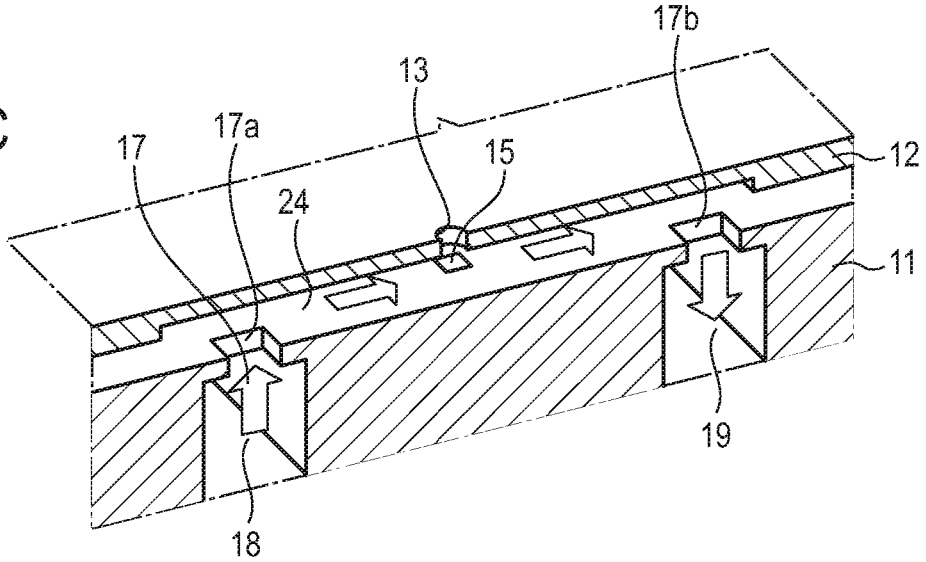

FIGS. 22A to 22C are views illustrating the structure of a discharge port and an ink flow passage in the vicinity thereof in the liquid discharge head related to the first embodiment of the disclosure. FIG. 22A is a plan view of the ink flow passage or the like as seen from a side to which the ink is discharged, FIG. 22B is a sectional view taken along line A-A' in FIG. 22A, and FIG. 22C is a perspective view of the section taken along line A-A' of FIG. 22A.

As illustrated in these views, due to the circulation of the ink described above in FIG. 12 and the like, an ink flow 17 occurs in the pressure chamber 23, provided with an energy generating element 15, on the substrate 11 of the liquid discharge head and a flow passage 24 before and behind thereof. That is, due to a pressure difference that causes an ink circulation, a flow in which the ink supplied from the supply flow passage (supply flow passage) 18 via the supply port 17*a* provided in the substrate 11, passes through the flow passage 24, the pressure chamber 23, and the flow passage 24, and reaches the recovery flow passage (recovery flow passage) 19 via the recovery port 17*b* is caused. In addition, as described above, the pressure chamber 23 is a portion of the flow passage 24.

Along with the flow of the ink described above, during non-discharge, a space from the recording element (energy generating element) 15 to the discharge port 13 thereabove is filled with the ink, and a meniscus (ink interface (liquid surface) 13*a*) of the ink is formed in the vicinity of an end part of the discharge port 13 on the discharge direction side. In addition, although this ink interface is illustrated in a straight line (planar surface) in FIG. 22B, the shape of the ink interface is determined in accordance with a member forming a wall of the discharge port 13 and ink surface tension, and normally becomes a curved line (curved surface) having a concave or convex shape. The ink interface is illustrated in a straight line in order to simplify the illustration. By driving an electric heat conversion element (heater) that is the energy generating element 15 in a state where this meniscus is formed, bubbles are generated in the ink by using the generated heat and the ink can be discharged from the discharge port 13. In addition, although an example in which the heater is applied as the energy generating element has been described in the present embodiment, the disclosure is not limited to this. For example, various energy generating elements, such as a piezoelectric element, are applicable. In the present embodiment, the velocity of an ink flow that flows through the flow passage 24 is, for example, about 0.1 to 100 mm/s, and the influence to be exerted on landing accuracy or the like can be made relatively small even if a discharge operation is performed in a state where the ink has flowed.

<Relationship Between P, W and H>

In the liquid discharge head of the present embodiment, a relationship between a height H of the flow passage 24, a thickness P of an orifice plate (flow passage forming member 12), and a length (diameter) W of a discharge port can be determined as described below.

In FIG. 22B, the height on an upstream side of the flow passage 24 at a lower end (a communication part between the discharge port part and the flow passage) of a portion (hereinafter referred to as a discharge port part 13*b*) having the thickness P of the orifice plate of the discharge port 13 is illustrated as H. Additionally, the length of the discharge port part 13*b* is illustrated as P. Moreover, the length of the discharge port part 13*b* in a flow direction of the liquid within the flow passage 24 is illustrated as W. In the liquid discharge head of the present embodiment, H is 3 to 30 μm, P is 3 to 30 μm and W 6 to 30 μm. Additionally, as for ink, nonvolatile solvent concentration is adjusted to 30%, coloring material concentration is adjusted 3%, and viscosity is adjusted to 0.002 to 0.003 Pa·s.

Figure 43:
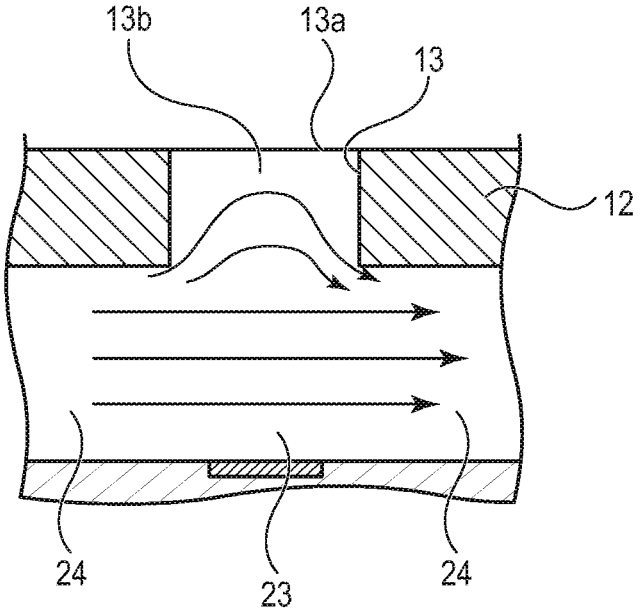
FIG. 43 is a view illustrating a flow aspect of an ink flow of the ink that flows through the inside of the liquid discharge head.

In the present embodiment, the followings are performed in order to suppress the increase in viscosity of the ink resulting from the evaporation of the ink from the discharge port 13. FIG. 43 is a view illustrating a flow aspect of an ink flow 17 in the discharge port 13, the discharge port part 13*b* and the flow passage 24 when the ink flow 17 (refer to FIG. 22A to FIG. 22C) of the ink that flows through the insides of the flow passage 24 and the pressure chamber 23 of the liquid discharge head is brought into a steady state. In addition, in this drawing, the length of arrows does not indicate the magnitude of the velocity of the ink flow. FIG. 43 illustrates a flow when the ink flows into the flow passage 24 at a flow rate of $1.26\times10^{-4}$ ml/min from the supply flow passage 18 in a liquid discharge head in which the height H of the flow passage 24 is 14 μm, the length P of the discharge port part 13*b* is 10 μm, and the length (diameter) W of the discharge port is 17 μm.

The present embodiment has a relationship in which the height H [μm] of the flow passage 24, the length P [μm] of the discharge port part 13*b*, and the length W [μm] of the discharge port part 13*b* in the flow direction of the ink satisfy the following Expression (1).

$$H^{-0.34}\times P^{-0.66}\times W>1.5 \quad (1)$$

In the liquid discharge head of the present embodiment, by satisfying this condition, as illustrated in FIG. 43, the ink flow 17, which flows through the inside of the flow passage 24, flows into the discharge port part 13*b*, reaches a position of at least half of the orifice plate thickness of the discharge port part 13*b*, and then returns to the flow passage 24 again. The ink, which has returned to the flow passage 24, flows into the above-described common recovery flow passage 212 via the recovery flow passage 19. That is, at least a portion of the ink flow 17 reaches a position of ½ or more of the discharge port part 13*b* in a direction from the pressure chamber 23 toward the ink interface 13*a*, and then returns to the flow passage 24. The increase in viscosity of the ink in many regions within the discharge port part 13*b* can be suppressed by this flow. By generating the ink flow within such a liquid discharge head, it is possible that the ink not only in the flow passage 24 but in the discharge port part 13*b* flow out to the flow passage 24. As a result, the ink viscosity increase or an increase in ink coloring material concentration can be suppressed.

Second Embodiment

Figure 23:
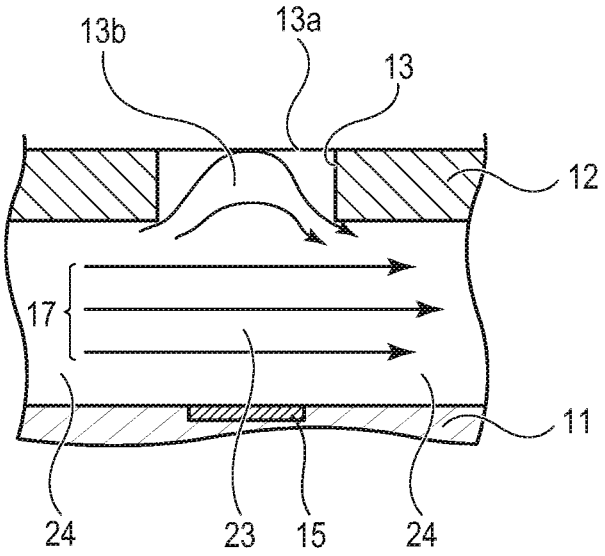
FIG. 23 is a view illustrating a flow aspect of an ink flow of the ink that flows through the inside of the liquid discharge head.

FIG. 23 is a view illustrating a flow aspect of an ink flow of the ink that flows through the inside of a liquid discharge head of the second embodiment of the disclosure, and the same portions as those of the above-described first embodiment will be designated by the same reference signs, and the description thereof will be omitted.

In the present embodiment, the followings are performed in order to further reduce influence, such as the increase in viscosity of the ink resulting from the evaporation of the liquid from the discharge port. FIG. 23 is a view illustrating a flow aspect of the ink flow 17 in the discharge port 13, the discharge port part 13*b* and the flow passage 24 when the ink flow 17 of the ink that flows through the inside of the liquid discharge head is brought into a steady state, similarly to FIG. 43. In addition, in this drawing, the length of arrows does not correspond to the magnitude of the velocity, and is expressed with a certain length irrespective of the magnitude of the velocity. FIG. 23 illustrates a flow when the ink has flowed into the flow passage 24 at a flow rate of $1.26\times10^{-4}$ ml/min from the supply flow passage 18, in a liquid discharge head in which H is 14 μm, P is 5 μm and W is 12.4 μm.

The present embodiment has a relationship in which the height H of the flow passage 24, the length P of the discharge port part 13*b*, and the length W of the discharge port part 13*b* in the flow direction of the ink satisfy Expression (2) to be described below. Accordingly, it is possible to suppress that the ink of which the coloring material concentration has changed or the viscosity has been increased, due to the evaporation of the ink from the discharge port, stagnates in the vicinity of the ink interface 13*a* of the discharge port part 13*b*. That is, in the liquid discharge head of the present embodiment, as illustrated in FIG. 23, the ink flow 17, which flows through the inside of the flow passage 24, flows into the discharge port part 13*b*, reaches the vicinity of the ink interface 13*a* (meniscus position), and then, returns to the flow passage 24 again through the discharge port part 13*b*. The ink, which has returned to the flow passage 24, flows into the above-described common recovery flow passage 212 via the recovery flow passage 19. By generating such an ink flow, the ink not only inside the discharge port part 13*b* that is likely to be influenced by the evaporation but also in the vicinity of the ink interfaces 13*a* in which the influence of the evaporation is particularly remarkable is capable of flowing out to the flow passage 24 without stagnating inside the discharge port part 13*b*. As a result, the ink of particularly a part, which is likely to be influenced by the evaporation, such as ink moisture, in the vicinity of the discharge port, can be made to flow out without being stagnated, and the ink viscosity increase and the increase in the ink coloring material concentration can be suppressed.

Since the present embodiment can suppress the increase in viscosity of at least a portion of the ink interfaces 13*a,* it is possible to further reduce influence on discharge, such as a discharge speed change, compared to a case where the entire area of the ink interface 13*a* is increased in viscosity.

The above-described ink flow 17 of the present embodiment has a velocity component (hereinafter referred to as a positive velocity component) in a flow direction (a direction from the left toward the right in FIG. 23) of the ink within the flow passage 24 at least at a central part (a central part of the discharge port) in the vicinity of the ink interface 13*a*. In addition, in the present specification, the mode of a flow in which the ink flow 17 has the positive velocity component at least at the central part of the ink interface 13*a* is referred to as a "flow mode A". Additionally, as in a comparative example to be described below, the mode of a flow with a negative velocity component in a direction opposite to the positive velocity component at the central part of the ink interface 13*a* is referred to as a "flow mode B".

Figure 24A:
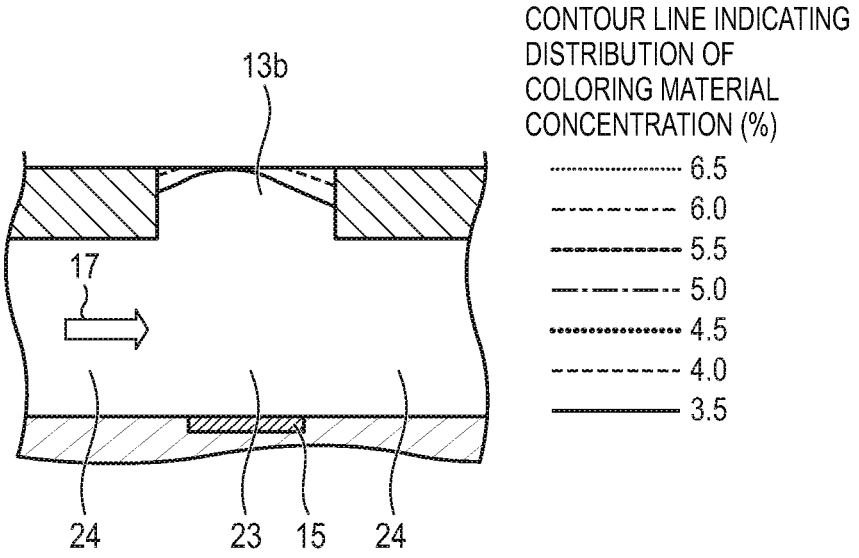
FIG. 24A and FIG. 24B are views illustrating the state of the coloring material concentration of the ink within a discharge port part.
Figure 24B:
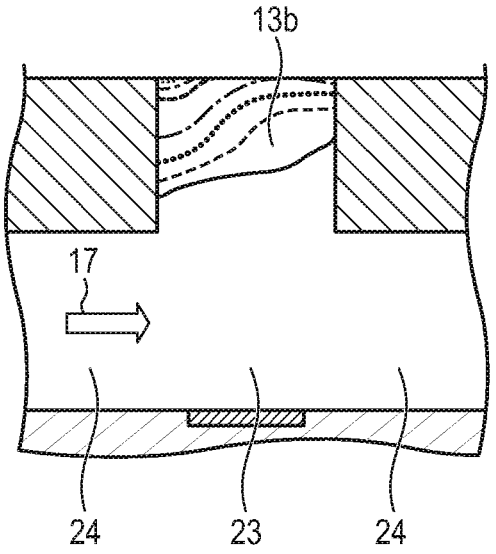

FIGS. 24A and 24B are views illustrating the state of the coloring material concentration of the ink within the discharge port part 13*b,* FIG. 24A illustrates the state of the present embodiment, and FIG. 24B illustrates the state of the comparative example. That is, FIG. 24A illustrates the case of the flow mode A, and FIG. 24B illustrates the case of the above-described flow mode B related to the comparative example in which the flow in the vicinity of the central part of the ink interface 13*a* within the discharge port part 13*b* has the negative velocity component. Also, contour lines illustrated in FIGS. 24A and 24B indicate the distribution of the coloring material concentration in the ink inside the discharge port part 13*b*.

The flow modes A and B are determined depending on the values P, W and H that indicate a structure, such as the flow passage. FIG. 24A illustrates the state of the flow mode A when the ink of $1.26\times10^{-4}$ ml/min has flowed into the flow passage 24 of the liquid discharge head having a shape in which H is 14 μm, P is 5 μm and W is 12.4 μm from the supply flow passage 18. On the other hand, FIG. 24B illustrates the state of the flow mode B when the ink of $1.26\times10^{-4}$ ml/min has flowed into the flow passage 24 of the liquid discharge head having a shape in which H is 14 μm, P is 11 μm and W is 12.4 μm from the supply flow passage 18. In the flow mode B illustrated in FIG. 24B, the coloring material concentration of the ink inside the discharge port part 13*b* is higher than that in the flow mode A illustrated in FIG. 24A. That is, in the flow mode A illustrated in FIG. 24A, the ink within the discharge port part 13*b* can be replaced (made to flow out) up to the flow passage 24 with the ink flow 17 that reaches the vicinity of the ink interface 13*a* with the positive velocity component. Accordingly, the stagnation of the ink inside the discharge port part 13*b* can be suppressed, and as a result, it is possible to suppress a rise in the coloring material concentration or viscosity.

Figure 25:
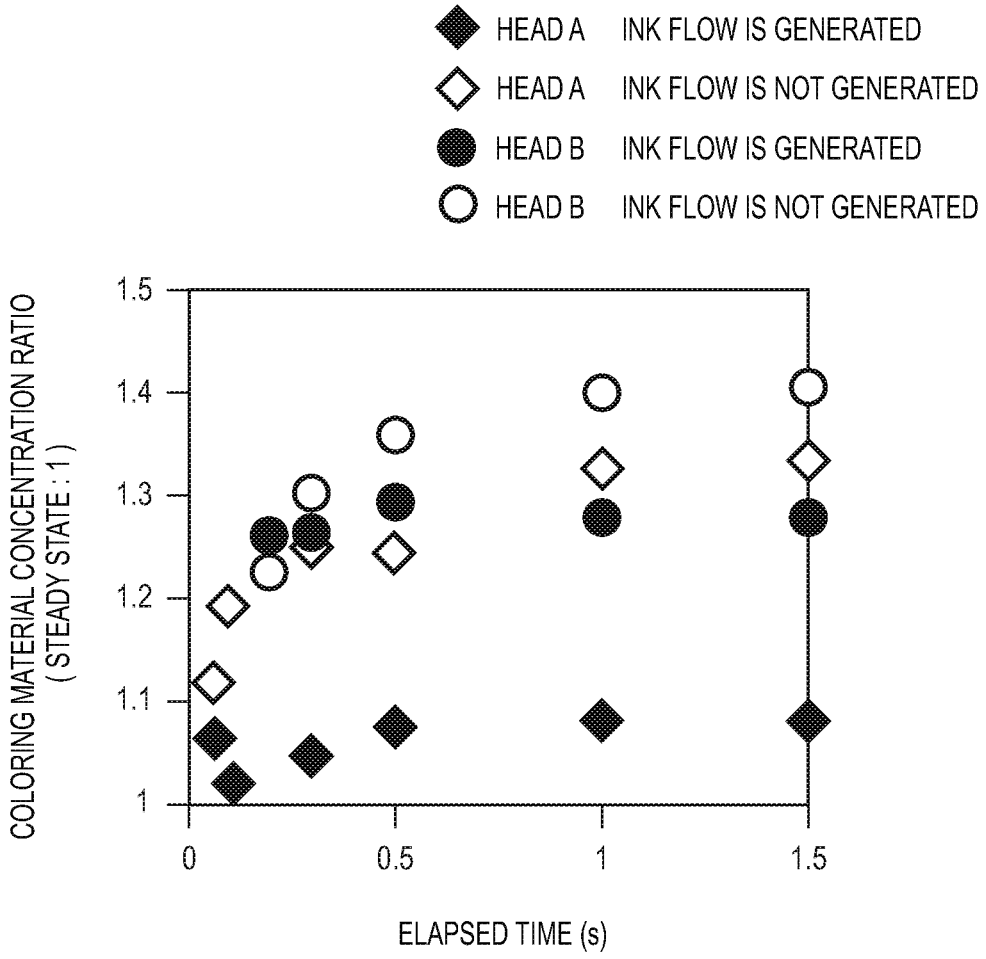
FIG. 25 is a view illustrating comparison of the coloring material concentration of the ink.

FIG. 25 is a view illustrating the comparison between the coloring material concentrations of the inks discharged from the liquid discharge head (head A) that generates the flow mode A and the liquid discharge head (head B) that generates the flow mode B, respectively. FIG. 25 illustrates data in a case where the ink is discharged in a state where the ink flow 17 is generated in the flow passage 24, and in a case where the ink is discharged in a state where there is no flow of the ink into the flow passage without generating the ink flow 17, in each of the head A and the head B. Additionally, in FIG. 25, a horizontal axis represents elapsed time after the ink is discharged from the discharge port, and a vertical axis represents the coloring material concentration ratio of dots that are formed on the recording medium by the discharged ink. This concentration ratio is the ratio of the concentration of a dot formed by the ink discharged after each elapsed time when the concentration of a dot formed by the ink discharged at a discharge frequency of 100 Hz is set to 1.

As illustrated in FIG. 25, in a case where the ink flow 17 is not generated, in both the heads A and B, the concentration ratio is 1.3 or more with an elapsed time of 1 second or more, the coloring material concentration of the ink becomes high in a relatively early time. Additionally, in a case where the ink flow 17 is generated in the head B, the concentration ratio is within a range up to about 1.3, the increase in the coloring material concentration can be further suppressed than that in a case where the ink flow is not generated. However, since the ink of which the coloring material concentration becomes high up to a concentration ratio of 1.3 stagnates in the discharge port part, the effect of suppressing the coloring material concentration change is not sufficient. In contrast, in a case where the ink flow is generated in the head A, the range of the coloring material concentration ratio is 1.1 or less. It can be seen through examination that, if the coloring material concentration change is about 1.2 or less, it is difficult for a person to visually recognize uneven coloring. That is, in the head A, it can be seen that the change in the coloring material concentration can be suppressed to such an extent that the uneven coloring can be visually recognized even if the elapsed time is about 1.5 seconds. In addition, FIG. 25 illustrates a case where the coloring material concentration becomes high along with the evaporation. However, similarly even in a case where the coloring material concentration becomes low along with the evaporation, the liquid discharge head of the present embodiment can suppress the change of coloring material concentration.

Through the present application inventors' study, in the liquid discharge head that generates the flow mode A in the present embodiment, it is known that a relationship between the height H [μm] of the flow passage 24, the thickness P [μm] of the orifice plate (flow passage forming member 12), and the length (diameter) W [μm] of the discharge port satisfy the following Expression (2).

$$H^{-0.34}\times P^{-0.66}\times W>1.7 \quad (2)$$

In the following, the value of the left side of the above Expression (2) is referred to as a determination value J. It can be seen through the present application inventors' study that the liquid discharge head that satisfies Expression (2) is brought into the flow mode A as illustrated in FIG. 23, and the liquid discharge head that generates the flow mode B does not satisfy Relational Expression (2).

Hereinafter, Expression (2) will be described.

Figure 26:
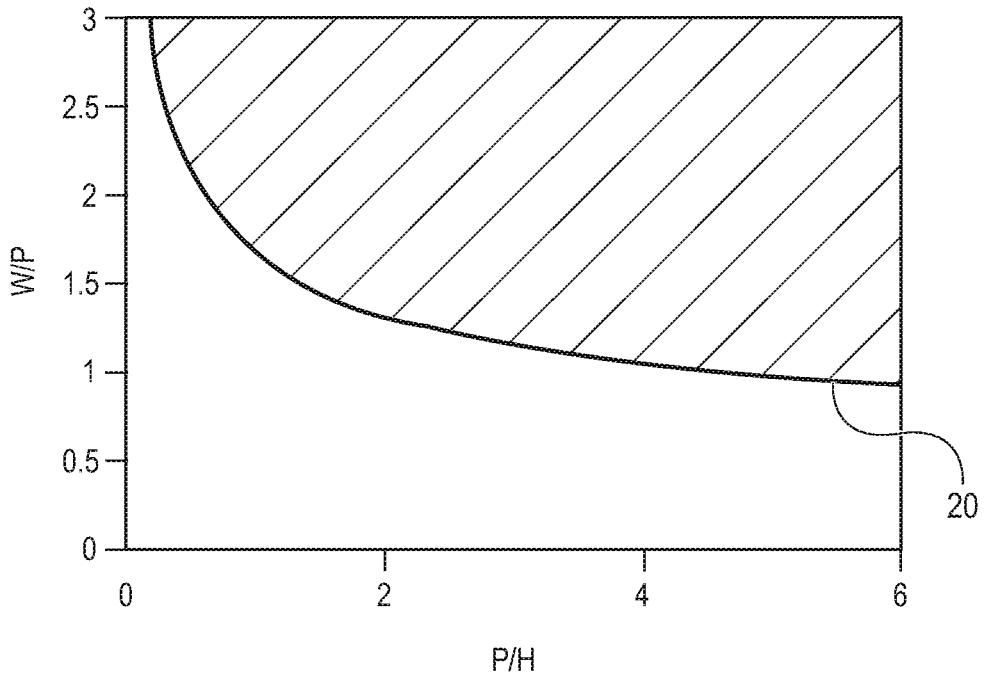
FIG. 26 is a view illustrating a relationship between a liquid discharge head that generates a flow mode of a second embodiment, and a liquid discharge head that generates a flow mode of a comparative example.

FIG. 26 is a view illustrating a relationship between the liquid discharge head that generates the flow mode A of the second embodiment, and the liquid discharge head that generates the flow mode B of the comparative example. A horizontal axis of FIG. 26 represents a ratio (P/H) of P and H, and a vertical axis represents a ratio (W/P) of W and P. A threshold line 20 is a line that satisfies the following Expression (3).

$$(W/P)=1.7\times(P/H)^{-0.34} \quad (3)$$

In FIG. 26, as for the relationship between H, P and W, a liquid discharge head in a region illustrated by hatched lines above the threshold line 20 is brought into the flow mode A, and a liquid discharge head in a region below the threshold line 20 including the threshold line 20 is brought into the flow mode B.

That is, the liquid discharge head that satisfies the following Expression (4) is brought into the flow mode A.

$$(W/P)>1.7\times(P/H)^{-0.34} \quad (4)$$

Since Expression (2) is obtained if Expression (4) is arranged, a head (a head in which the determination value J is 1.7 or more) in which the relationship between H, P and W satisfies Relational Expression (2) is brought into the flow mode A.

The above relationship will be further described with reference to FIGS. 27A to 27D, and FIG. 28. FIGS. 27A to 27D are views illustrating aspects of the ink flow 17 in the vicinity of the discharge port part 13*b* in liquid discharge heads in the regions above and below the threshold line 20 illustrated in FIG. 26. FIG. 28 is a view illustrating whether the flows of liquid discharge heads having various shapes are brought into any of the flow mode A or the flow mode B. In FIG. 28, black circles indicate liquid discharge heads brought into the flow mode A, and x marks indicate liquid discharge heads brought into the flow mode B.

Figure 27A:
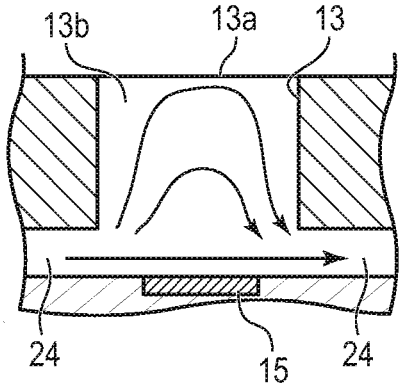
FIG. 27A, FIG. 27B, FIG. 27C and FIG. 27D are views illustrating aspects of the ink flow in the vicinity of the discharge port part in liquid discharge heads in respective regions above and below a threshold line illustrated in FIG. 26.
Figure 28:
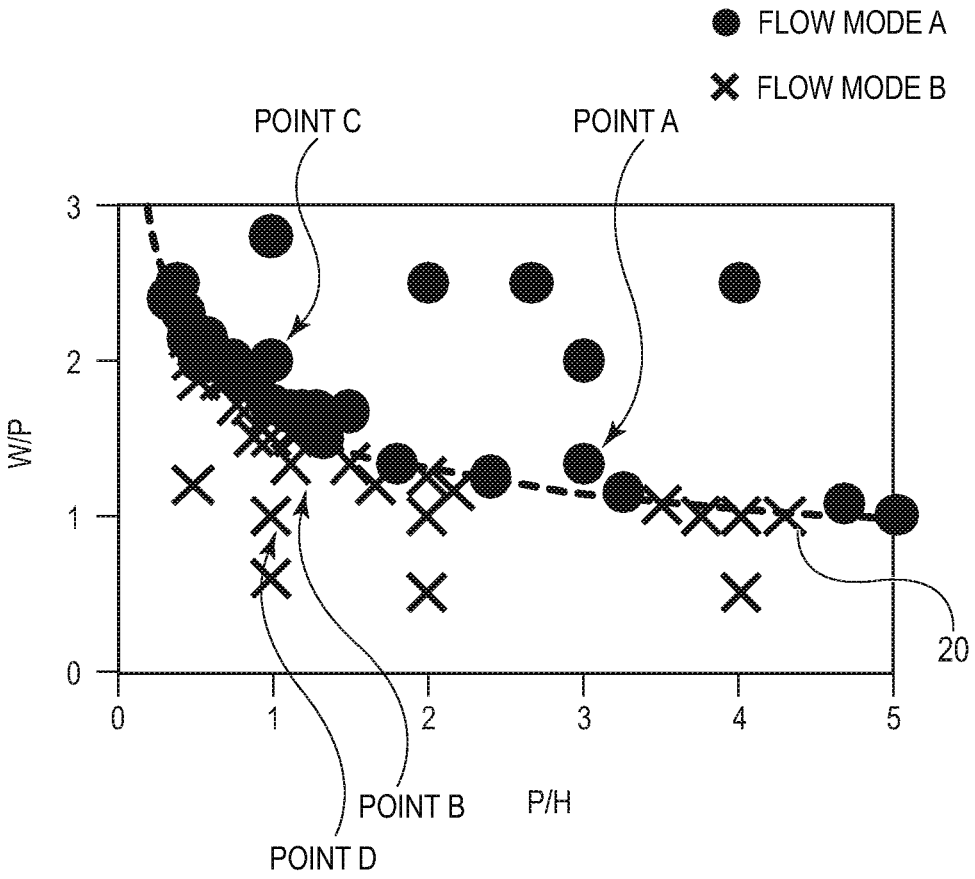
FIG. 28 is a view illustrating whether a flow mode A or a flow mode B is selected.

FIG. 27A illustrates an ink flow in a liquid discharge head in which the determination value J becomes 1.93 and is larger than 1.7, with a shape in which H is 3 μm, P is 9 μm and W is 12 μm. That is, an example illustrated in FIG. 27A is the flow mode A. This head corresponds to point A in FIG. 28.

Figure 27B:
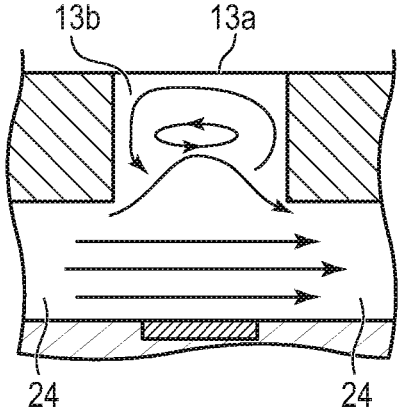

FIG. 27B illustrates an ink flow in a liquid discharge head in which the determination value J becomes 1.39 and is larger than 1.7, with a shape in which H is 8 μm, P is 9 μm and W is 12 μm. That is, this flow is the flow mode B. This head corresponds to point B in FIG. 28.

Figure 27C:
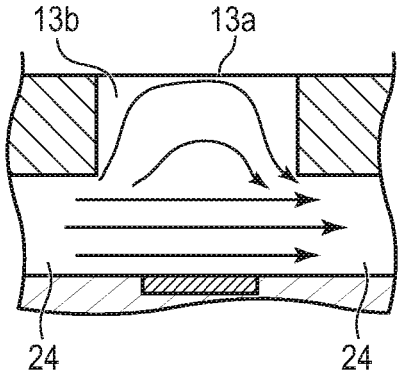

FIG. 27C illustrates an ink flow in a liquid discharge head in which the determination value becomes 2.0 and is larger than 1.7, with a shape in which H is 6 μm, P is 6 μm and W is 12 μm. That is, this flow is the flow mode A. Also, this head corresponds to point C in FIG. 28.

Figure 27D:
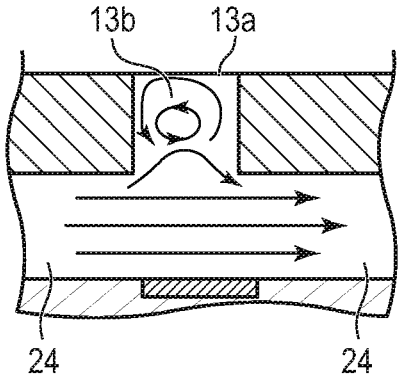

Finally, FIG. 27D illustrates an ink flow in a liquid discharge head in which the determination value becomes 1.0 and is larger than 1.7, with a shape in which H is 6 μm, P is 6 μm and W is 6 μm. That is, this flow is the flow mode B. Also, this head corresponds to point D in FIG. 28.

As described above, the liquid discharge head brought into the flow mode A and the liquid discharge head brought into the flow mode B can be divided with the threshold line 20 of FIG. 26 as a boundary. That is, the liquid discharge head in which the determination value J of Expression (2) is larger than 1.7 is brought into the flow mode A, and the ink flow 17 has the positive velocity component at least at the central part of the ink interface 13*a*.

Next, the comparison between the discharge speeds of ink droplets discharged from the liquid discharge head (head A) that generates the flow mode A and the liquid discharge head (head B) that generates the flow mode B, respectively, will be described.

Figure 29A:
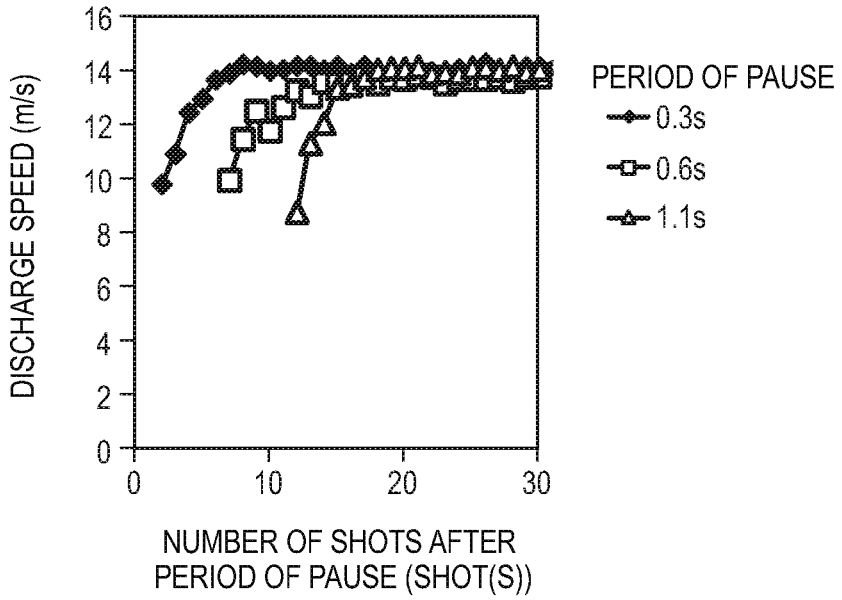
FIG. 29A and FIG. 29B are diagrams illustrating a relationship between the number of shots (the number of times of discharge) after a certain period of pause after discharge from the liquid discharge head in each flow mode and discharge speed at that time.
Figure 29B:
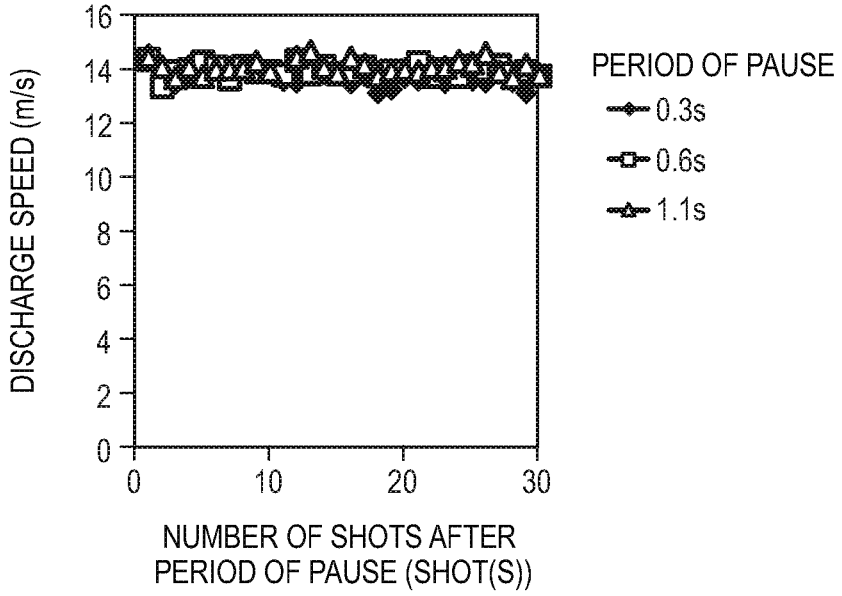

FIGS. 29A and 29B are diagrams illustrating a relationship between the number of shots (the number of times discharge) after a certain period of pause and discharge speed at that time, after discharge from the liquid discharge head in each flow mode.

FIG. 29A illustrates a relationship between the number of shots and discharge speed when pigment ink containing 20 wt % or more of a solid component of which the ink viscosity is about 4 cP at a discharge temperature is discharged using the head B. Even if the ink flow 17 is present, a decrease in the discharge speed occurs until about the twentieth shot depending on pause time. FIG. 29B illustrates a relationship between the number of shots and the discharge speed when the same pigment ink as in the case of FIG. 29A is discharged using the head A, and the decrease in the discharge speed does not occur from the first shot after the pause. Although the ink containing a solid component of 20 wt % or more has been used in the present experiment, the concentration does not limit the disclosure. Although based on the easiness of dispersion of the solid component in ink, the effects of the mode A appear clearly when ink of which the amount of the solid component is substantially 8 wt % or more (8 wt % or more) is discharged.

In the head that generates the flow mode A in this way, discharge speed decrease of ink droplets can be suppressed even in the ink in which the discharge speed is likely to decrease due to the increase in viscosity of the ink resulting from the evaporation of the ink from the discharge port.

In addition, the relationship between P, W and H related to the shape of the flow passage or the like as described above has dominant influence on whether the flow of the ink flow 17 within the discharge port is brought into the flow mode A or brought into the flow mode B. In addition to these conditions, for example, influence of conditions, such as the flow velocity of the ink flow 17, the viscosity of the ink, and the width (the length of the discharge port in a direction orthogonal to W) of the discharge port 13 in a direction perpendicular to a flow direction of the ink flow 17, is extremely small compared to P, W and H. Therefore, the flow velocity of ink or the viscosity of ink may be appropriately set in conformity with required specification of the liquid discharge head (ink jet recording apparatus) or environmental conditions to be used. For example, ink in which the flow velocity of the ink flow 17 in the flow passage 24 is 0.1 to 100 mm/s and the viscosity of the ink is 30 cP or less at the discharge temperature is applicable. Additionally, in a case where the amount of evaporation of the ink from the discharge port is increased due to an environmental change or the like in use, the flow mode A can be brought about by appropriately making the flow rate of the ink flow 17 larger. Even if the flow rate is increased for the liquid discharge head of the flow mode B, the flow mode A is not brought about. That is, whether the mode A is brought about or the flow mode B is brought about is dominated not by the flow velocity of the ink, or the conditions of the viscosity of the ink but by the relationship between H, P and W related to the shape of the above-described liquid discharge head. Additionally, particularly a liquid discharge head in which H is 20 μm or less, P is 20 μm or less and W is 30 μm or less even among various liquid discharge heads brought into the flow mode A allows higher-definition recording, and is preferable.

As described above, the liquid discharge head that generates the flow mode A can make the ink within the discharge port part 13*b*, especially the ink in the vicinity of the ink interface flow out to the flow passage 24 with the ink flow 17 that reaches the vicinity of the ink interface 13*a* with the positive velocity component. From this, the stagnation of the ink inside the discharge port part 13*b* can be suppressed. Accordingly, with respect to the evaporation of the ink from the discharge port, it is also possible to reduce the rise in the coloring material concentration of the ink within the discharge port part.

Additionally, in the present embodiment, the discharge operation of the ink is performed in a state where the ink within the flow passage 24 flows as described above. For this reason, the discharge of the ink is performed in a state where there is a flow of the ink that returns to an ink flow passage after the ink enters the discharge port part 13*b* from the flow passage 24 (pressure chamber 23) and reaches an ink interface.

As a result, even in the recording operation pause state, the state where the rise in the coloring material concentration inside the discharge port part 13*b* is reduced is always brought about. Thus, the discharge of the first shot after the pause of the recording operation pause can be excellently performed, and occurrence of uneven coloring or the like can also be reduced. However, the disclosure is also applicable to liquid discharge heads that perform the discharge operation of the ink in a state where the ink flow of the ink flow passage 24 is stopped. By generating a circulatory flow within an ink flow passage after the pause of the recording operation, the increase in viscosity of the ink inside the discharge port part 13*b* may be reduced, and the discharge of the ink may be performed after the circulatory flow is stopped.

<Viscosity Distribution of Discharge Port Ink Interface>

Figure 35A:
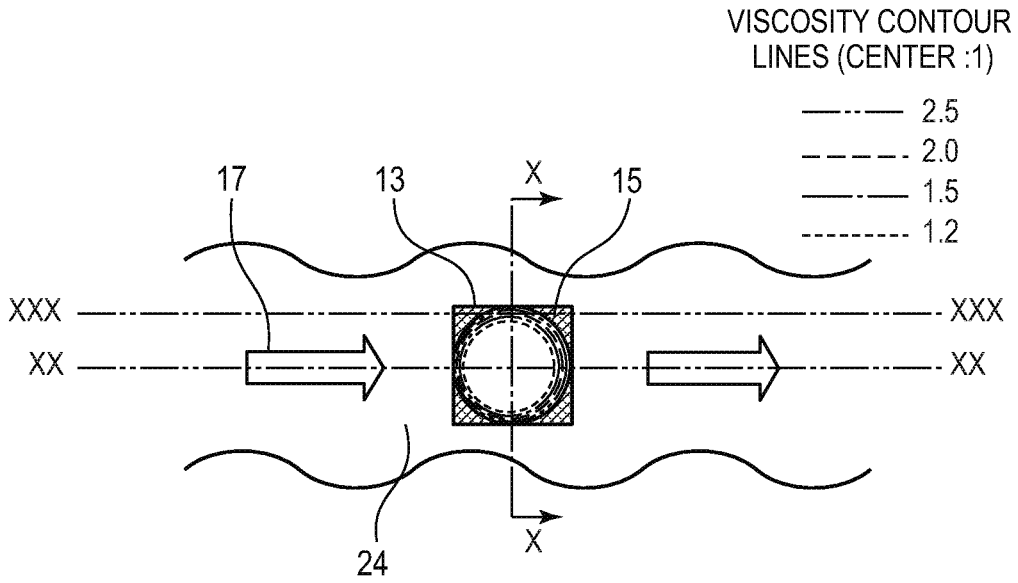
FIG. 35A and FIG. 35B are views illustrating the distribution of viscosity of the liquid in a region of a liquid surface within an opening of the discharge port.

The state (viscosity distribution) of the liquid surface within the opening of the discharge port that is the feature of the disclosure will be described. FIG. 35A is a view illustrating viscosity contour lines of the liquid surface within the opening of the discharge port when a liquid discharge head is seen from a side (a direction in which the ink is discharged from the discharge port) facing the discharge port.

Figure 35B:
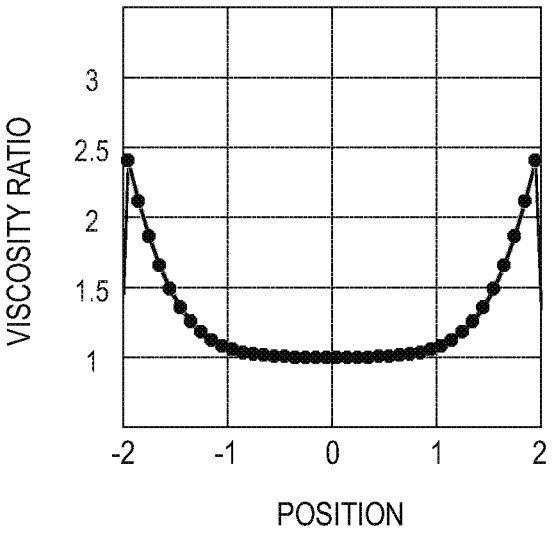

FIG. 35B is a view illustrating a relationship between positions within the discharge port and viscosity in a section taken along X-X of FIG. 35A. The center (here, center of gravity) of the discharge port 13 is a point where a line segment of X-X and a line segment of XX-XX in FIG. 35A intersect each other. This point is a point that becomes a position "0" in the horizontal axis of FIG. 35B. Also, viscosity ratios of other portions within the opening of the discharge port in the liquid surface when the viscosity in the point of this position "0" is 1 are measured, and the ratios are plotted. In addition, portions of "−2" and "2" on the horizontal axis become end parts of the discharge port 13.

As shown in FIGS. 35A and 35B, in the disclosure, the viscosity of ink is changed in the liquid surface within the opening of the discharge port for the ink (liquid). Regions where the viscosities of the ink differ in the liquid surface are referred to as a first region and a second region. In this case, in the disclosure, the viscosity of the ink in the first region is made 1.2 or more times higher than the viscosity of the ink in the second region. As an example, in a meniscus interface region within the opening of the discharge port 13, a region where the viscosity of the ink is the smallest is referred to as the second region, and a region where the viscosity is 1.2 or more times larger than the viscosity of the second region is referred to as the first region. In FIGS. 35A and 35B, a portion in which the position of the horizontal axis illustrated in FIG. 35B is around "0" and the viscosity ratio is about 1 becomes the second region, and a region from around "−1.2" to near "−2" and a region from near "1.2" to around "2" becomes the first region. That is, the vicinity of the central part of the discharge port becomes the second region, and regions on end part sides of the discharge port become the first region. In this case, the viscosity of the ink in the first region is 1.2 or more times higher than the viscosity of the ink in the second region. That is, in the disclosure, although a region where the viscosity of the ink is low as in the second region is formed by circulation in the liquid surface within the opening of the discharge port 13, the first region where the viscosity of the ink is higher than that in the second region is intentionally formed. Although occurrence of clogging resulting from being left for a long time or the like is suppressed by forming the second region by the circulation, the evaporation of the ink from the discharge port can be suppressed by the intentionally formed first region where the viscosity of the ink is high. In the first region where the viscosity of the ink becomes high, the evaporation of the ink does not proceed easily, and more than necessary evaporation of the ink (ink component) from the discharge port can be suppressed. Accordingly, the viscosity of the ink of the entire system is gradually increased, and influence on the discharge of the ink is suppressed. In addition, the first region with high ink concentration influences the discharge of the ink. However, since the first region is formed not in a central region of the discharge port but in a peripheral region thereof as in the present embodiment, the influence on the discharge can be suppressed. On the contrary, by forming the second region with small ink concentration in the central region of the opening of the discharge port, it is possible to excellently maintain discharge characteristics. As described above, by virtue of the configuration of the above-described present embodiment, it is possible to achieve compatibility between the suppression of the clogging of the discharge port and the suppression of the rise in the viscosity (concentration) of the ink of the circulation system.

In addition, the viscosity in the region of the liquid surface of the ink (liquid) means not viscosity in a two-dimensional liquid surface but the viscosity of the ink in a region having a slight thickness (for example, 1 μm) including the liquid surface in the height direction.

The first region can be located on the end part sides (upper and lower end sides of the discharge port 13 of FIG. 35A) of the discharge port in the direction (the direction of arrows of FIG. 35A) orthogonal to the direction in which the ink flows through the inside of the flow passage. On the other hand, the second region can be located on the center side (the center side of the discharge port 13 of FIG. 35A) of the discharge port in the direction orthogonal to the direction in which the ink flows through the inside of the flow passage. Accordingly, the effect of suppressing evaporation can be further enhanced while maintaining discharge characteristics.

In FIG. 35A, in a case where the ink viscosity of the central region of the discharge port is 1, the ink viscosity is about 2.5 in the regions of the end parts of the discharge port. In this way, it is more preferable that the ink viscosity of the end parts of the discharge port is 1.5 times or more, and more preferably 2.0 times or more with respect to the ink viscosity of the central region of the discharge port.

Additionally, in a case where the above circulation is performed, generally, the viscosity of the ink in the vicinity of the center part of the discharge port in the liquid surface within the opening of the discharge port 13 for the ink becomes the smallest. The viscosity of the ink in the central region of the discharge port with the smallest viscosity is defined as Y. In FIGS. 35A and 35B, Y=1 is established. In this case, the percentage of the area of the region where the viscosity of the ink is 1.2Y or more with respect to the opening of the discharge port can be 25% or more to 75% or less. In FIG. 35B, this area percentage is about 50%. By setting an area percentage to 25% or more, a region (first region) with a high viscosity is increased, and the evaporation of components in the ink from the discharge port is suppressed. For example, in a configuration in which the concentration is adjusted with respect to the ink viscosity (or coloring material concentration) of the entire circulation path increasing stepwise, it is possible to reduce the number of times of adjustment. Additionally, although the stagnation of the ink with a high viscosity may occur on the downstream side of the discharge port due to the evaporation, this occurrence can also be suppressed. Preferably, the area percentage is 35% or more. On the other hand, by setting the area percentage to 75% or less, it is possible to suppress that regions with a high viscosity are excessively increased on the liquid surface within the opening of the discharge port, and the ink discharge of the first shot after the ink is discharged and paused becomes less excellent.

Preferably, the area percentage is 60% or less. As described above, the relationship of the viscosity of the ink of the liquid surface within the opening of the discharge port as described above can be appropriately controlled depending on the flow velocity of the ink that flows through the flow passage, the shape of the discharge port, the physical properties of the ink, or the like.

Additionally, as illustrated in FIGS. 35A and 35B, in a case where the radius of the discharge port is 1, the second region becomes a region of 0 to 0.4, and the first region becomes a region of 0.7 to 1. If the viewpoint is changed, the second region is a region of 0.4 from the center toward an outer frame, and the first region becomes a region of 0.3 from the outer frame of the discharge port toward the center.

Figure 44A:
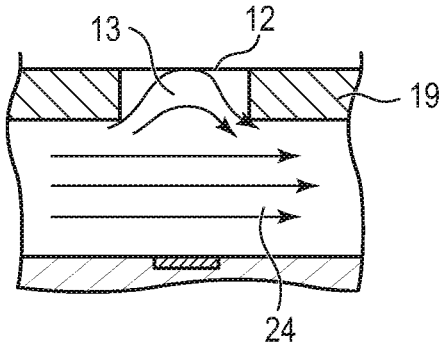
FIG. 44A, FIG. 44B, FIG. 44C and FIG. 44D are views illustrating flow aspects of the ink flow of the ink that flows through the inside of the liquid discharge head.
Figure 44B:
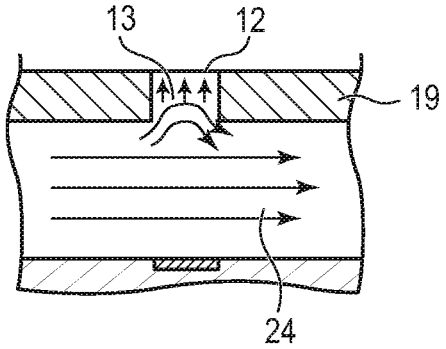
Figure 44C:
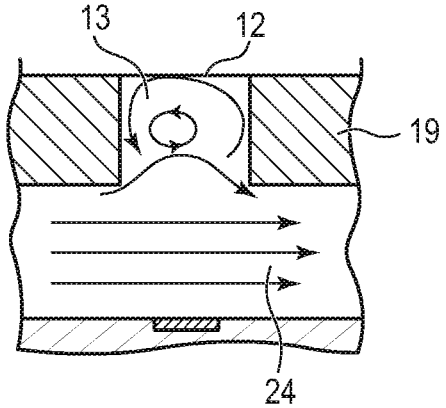
Figure 44D:
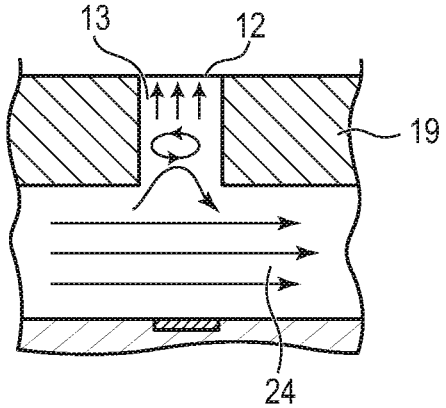

FIGS. 44A to 44D are views illustrating aspects of the ink flow 17 in section XX-XX and section XXX-XXX of FIG. 35A. Although FIGS. 44A to 44D illustrate the same sectional position, discharge port shapes are different, respectively. FIG. 44A and FIG. 44B illustrates cases of liquid discharge heads brought into the aforementioned flow mode A, and FIG. 44C and FIG. 44D illustrate cases of the liquid discharge heads used as the flow mode B. As illustrated in the drawings, since the ink flow 17 reaches a discharge port interface in the central region of the discharge port, the increase in viscosity of the ink is suppressed. The flow resulting from the evaporation is dominant at the end parts of the discharge port, and the increase in viscosity of the ink occurs. Particularly, in the case of the liquid discharge heads of the flow mode A, the ink viscosity increase of the discharge port central part can be further reduced. Therefore, a viscosity difference between the center side and the end part sides of the discharge port becomes large.

In the liquid discharge heads brought into the flow mode A in this way, the viscosity difference between the central side and the end part sides of the discharge port becomes larger. Therefore, the discharge at the first shot being excellently performed after a driving pause, and the viscosity of the entire system being increased can be made excellently compatible with each other.

Additionally, in a case where a liquid discharge head is adjusted in temperature and the ink is discharged, particularly in a case where the ink is heated, the evaporation from the discharge port is promoted. Therefore, a region where the viscosity of the ink is increased, that is, the first region, is easily formed in the opening surface of the discharge port.

<Ink with Small Moisture Content>

Figure 45:
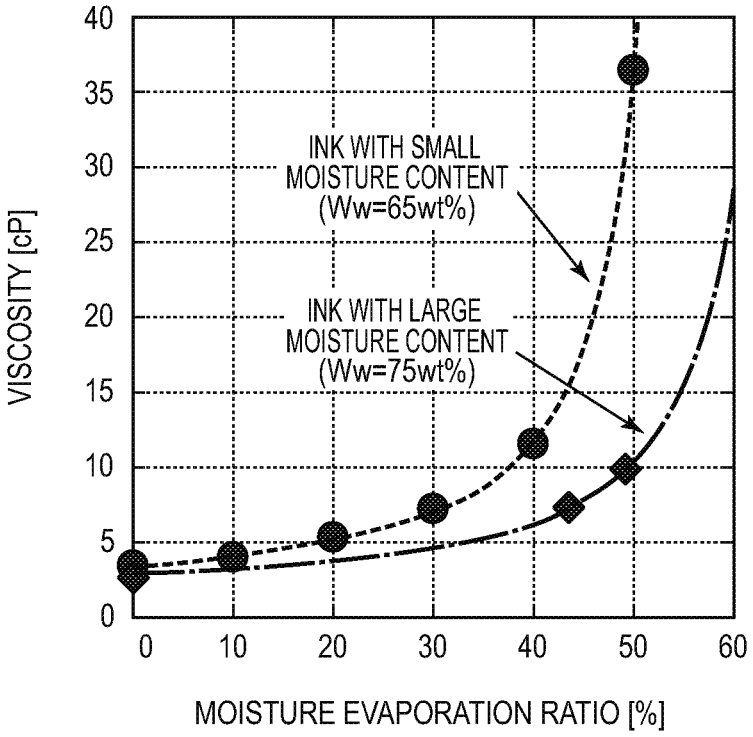
FIG. 45 is a graph illustrating a relationship between the moisture evaporation ratio and viscosity of the ink.
Figure 46:
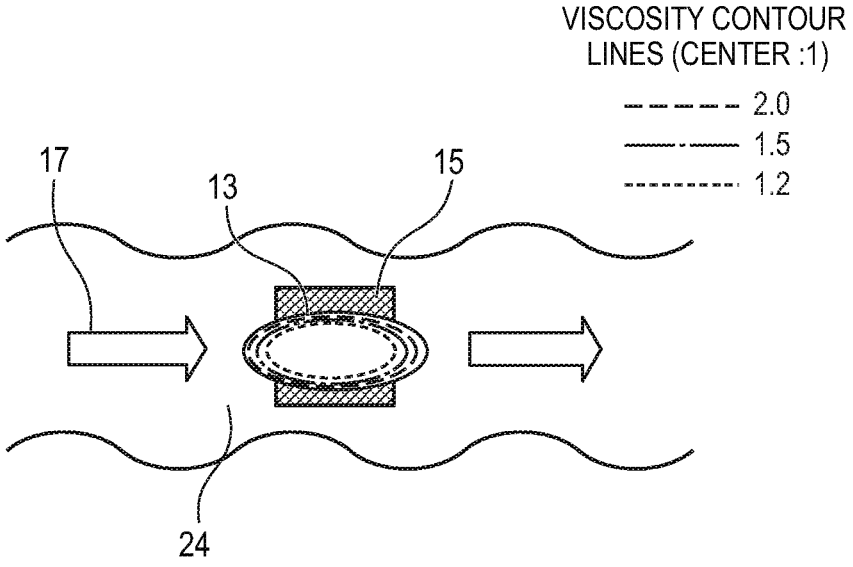
FIG. 46 is a view illustrating the distribution of the viscosity of the liquid in the region of the liquid surface within the opening of the discharge port.

FIG. 45 is a view illustrating an example of moisture contents of inks and viscosity changes accompanying moisture evaporation, and illustrates ink in which the moisture content is 75 wt % and ink which the moisture content is 65 wt % as examples. As illustrated in the drawing, as moisture content in inks is smaller, a viscosity difference when the evaporation proceeds becomes larger. Hence, by using ink with small moisture content for the liquid discharge head of the disclosure, the ink viscosity difference between the center side of the discharge port and the end part sides of the discharge port can be further increased. Particularly ink in which the moisture content in the ink is 65 wt % or less can be used. In addition, although the moisture content is the mass percentage of water with respect to the total mass of ink, the moisture content can also be considered as a substitute of water or in addition to water as long as a liquid that evaporates easily is provided.

A method of increasing the first region with ink in other methods than reducing moisture will be described. If the amount of solid components in the ink is 10 wt % or more, a viscosity rise is likely to occur. Therefore, a region (first region) with a high viscosity is easily formed in the opening surface of the discharge port. Additionally, in a case where the ink contains a pigment, the pigment is stabilized in dispersion by a self-dispersed pigment utilizing the electrostatic repulsion of pigment particles, and a resin-dispersed pigment utilizing steric hindrance resulting from resin adsorption.

In a case where the moisture evaporates and pigment concentration rises, the distance between the particles of the pigments decreases. In that case, in the resin-dispersed pigment, the resin causes inhibition and does not aggregate easily. However, the self-dispersed pigment does not cause inhibition and aggregate easily. Hence, in the self-dispersed pigment, the viscosity rise at the time of moisture evaporation becomes large due to the resin-dispersed pigment. For this reason, if the ink contains the self-dispersed pigment, a region (first region) with a high viscosity is easily formed in the opening surface of the discharge port.

<Discharge Port Shape>

FIG. 46 and FIGS. 47A to 47H are views illustrating patterns of shapes of discharge ports. The discharge port 13 illustrated in FIG. 46 has an elliptical shape in which a longitudinal direction extends in the flow direction of the ink flow 17. In the case of the discharge port having such a shape, a region where the ink increase viscosity is suppressed by the ink flow 17 that flows through the flow passage becomes small, and the region (first region) where the ink viscosity is high can be increased. By adopting the discharge port of which the internal diameter in the flow direction is larger than the internal diameter thereof in the direction intersecting the flow, the effects of the disclosure can be more excellently exhibited.

Figure 47A:
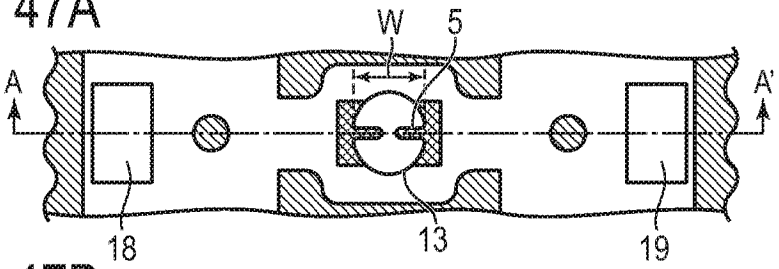
FIG. 47A, FIG. 47B, FIG. 47C, FIG. 47D, FIG. 47E, FIG. 47F, FIG. 47G and FIG. 47H are views for illustrating shapes of the discharge ports.
Figure 47B:
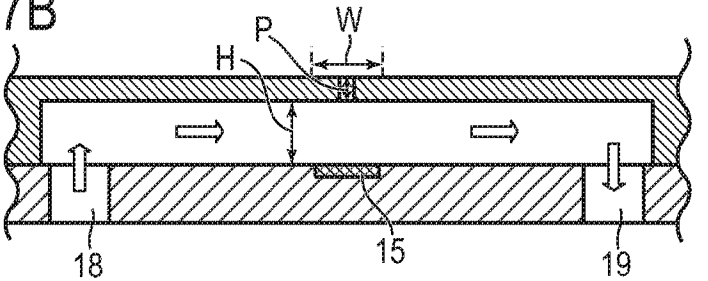
Figure 47C:
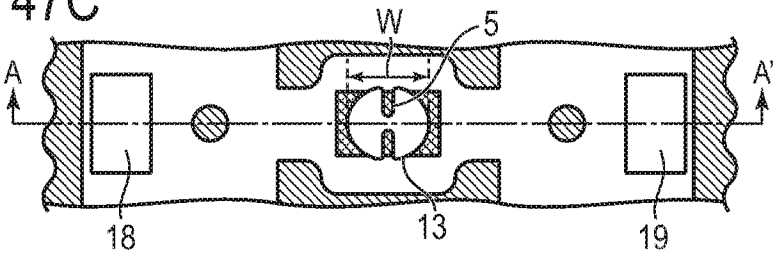
Figure 47D:
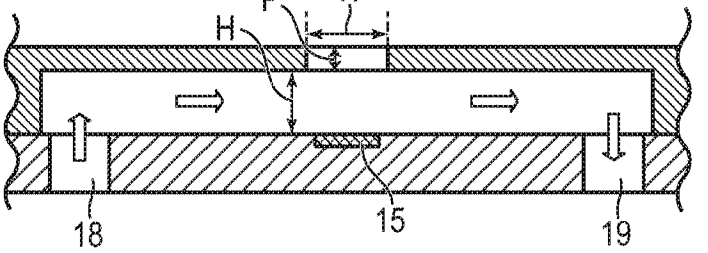
Figure 47E:
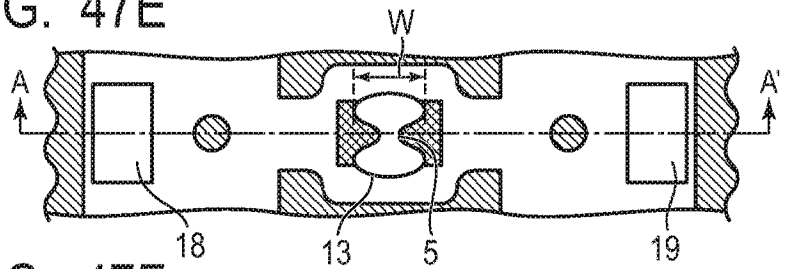
Figure 47F:
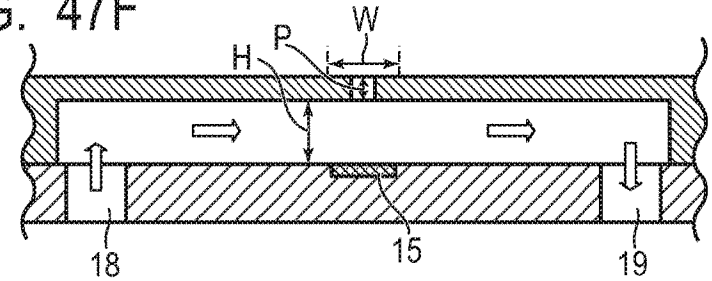
Figure 47G:
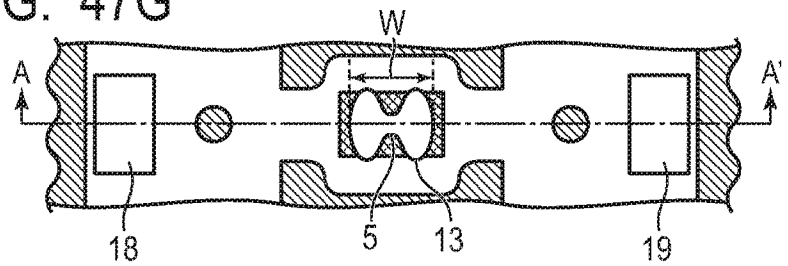
Figure 47H:
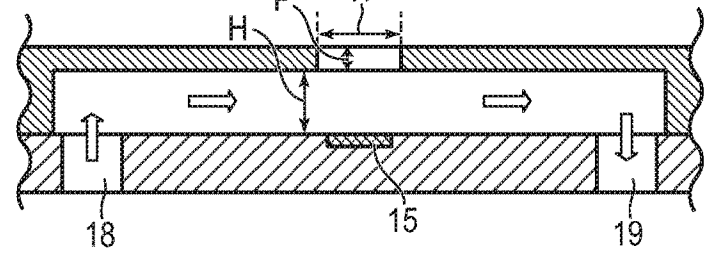

The shapes of discharge ports illustrated in FIGS. 47A to 47H are shapes in which projections 5 are formed at facing positions. The projections 5 continuously extend from a discharge port to the inside of the discharge port. FIG. 47A, FIG. 47C, FIG. 47E, and FIG. 47G are views as seen from positions facing the discharge ports. FIG. 47B, FIG. 47D, FIG. 47F, and FIG. 47H are sectional views taken along A-A'. The projections 5, which protrude in the flow direction of the ink that flows through the inside of a flow passage, are formed in the discharge ports illustrated in FIGS. 47A and 47B. The projections 5, which protrude in the direction intersecting the flow direction of the ink that flows through the inside of the flow passage, are formed in the discharge ports illustrated in FIGS. 47C and 47D. In FIGS. 47E and 47F, the projections 5 have a rounded shape. In all the projections 5, two projections are formed to face each other, and the meniscus of the ink formed between the projections 5 is easily maintained compared to the meniscus of other portions. Therefore, tailing of ink droplets extending from a discharge port can be cut at earlier timing, and generation of mist that is minute droplets generated along with a main droplet can be suppressed.

In the discharge ports of the shapes illustrated in FIGS. 47A to 47H, end parts of a discharge port become long.

Therefore, the area percentages of portions close to the end parts of the discharge port become high with respect to the opening area of the discharge port. Therefore, the region where the ink viscosity increase is suppressed on the opening surface by the flow of the ink becomes small, and the area of the region (first region) having a high ink viscosity can be increased. In the shapes illustrated in FIGS. 47C, 47D, 47G and 47H, that is, in configurations in which each projection 5 protrudes in the direction intersecting the flow direction of the ink that flows through the inside of a flow passage, similarly to that described in FIG. 46, a region where the ink viscosity increase is suppressed becomes small. Therefore, the area of the region (first region) having a high ink viscosity in the opening surface of a discharge port can be increased.

In addition, in cases where the projections 5 are provided as described above, the above-described shapes brought into the above-described flow mode A are preferable in exhibiting the effects.

Additionally, the disclosure does not limit the unit for generating the flow of the ink. A configuration having the generating unit outside a liquid discharge head, or a configuration having the generating unit within the liquid discharge head may be adopted. For example, a method of circulating the ink within a flow passage (pressure chamber) includes a pressure difference system of providing a pressure difference or a micro pump system provided within a flow passage. Although the disclosure is established by any system, the pressure difference system is preferable from a viewpoint that stable and high-flow velocity of a circulatory flow is easily realized.

Third Embodiment

Figure 30:
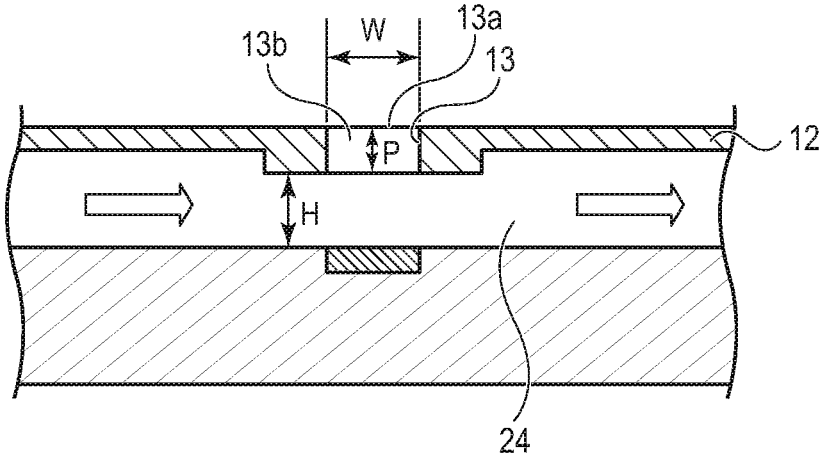
FIG. 30 is a view illustrating a flow aspect of the ink flow of the ink that flows through the inside of the liquid discharge head.

FIG. 30 is a view illustrating a flow aspect of an ink flow of the ink that flows through the inside of a liquid discharge head of a third embodiment of the disclosure, and the same portions as those of the above-described embodiment will be designated by the same reference signs, and the description thereof will be omitted. As illustrated in FIG. 30, in the present embodiment, the height of the flow passage 24 in the vicinity of the discharge port 13 (discharge port part 13*b*) is lower than the height of the flow passage 24 of the other portions. Specifically, the height H of the flow passage 24, on an upstream side in the flow direction of the liquid within the flow passage in a communication part between the flow passage 24 and the discharge port part 13*b*, is lower than the height of the flow passage 24 in the communication part between the flow passage 24 and the supply flow passage 18 (refer to FIG. 22A to FIG. 22C).

In the present embodiment, by making the flow passage height from the communication part between the flow passage 24 and the supply flow passage 18 to the vicinity of the discharge port part and the flow passage height from the vicinity of the discharge port part to the recovery flow passage 19 relatively high, the flow passage resistance of the portion can be made low. Additionally, by making the flow passage height H in the vicinity of the discharge port part 13*b* relatively small, the liquid discharge head of the flow mode A described in the first embodiment can be provided. Generally, if the height of the flow passage 24 is made low as a whole in order to satisfy Expression (2), there is a case where the flow passage resistance from the supply flow passage 18 or the recovery flow passage 19 to the discharge port 13 may become high, and the speed (refill speed) at which the ink which is insufficient due to the discharge may decrease. Therefore, it is possible to secure a required refill speed while making the flow passage height of a required part low to satisfy Expression (2) by virtue of the configuration of the present embodiment.

Fourth Embodiment

Figure 31:
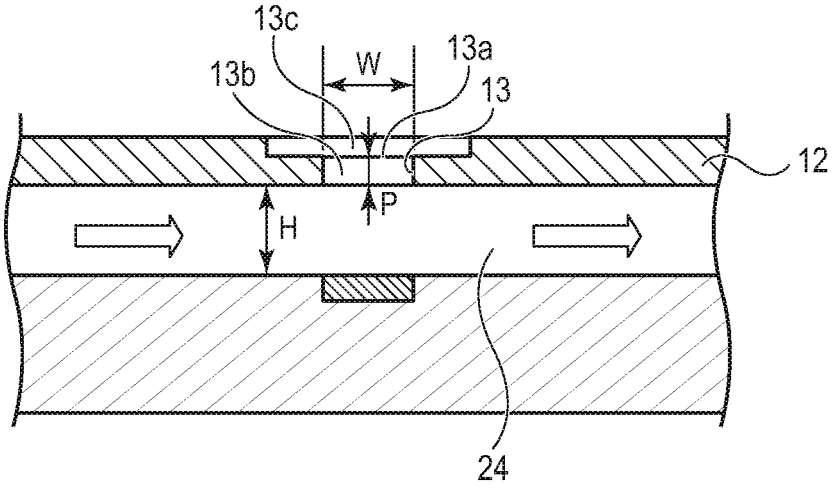
FIG. 31 is a view illustrating a flow aspect of the ink flow of the ink that flows through the inside of the liquid discharge head.

FIG. 31 is a view illustrating a flow aspect of an ink flow of the ink that flows through the inside of a liquid discharge head of a fourth embodiment of the disclosure. In FIG. 31, a recess 13*c* is formed around the discharge port 13 of a front surface of an orifice plate 12. That is, the discharge port 13 is formed within the recess formed in the orifice plate. In a normal state, the meniscus (ink interface 13*a*) of the ink is formed on a boundary surface between the discharge port 13 and the recess 13*c*. The present embodiment also satisfies Expression (2) and has the flow mode A. P in Expression (2) in the present embodiment becomes the length of the discharge port part, that is, the length from a portion in which the meniscus of the ink is formed to the flow passage 24, as illustrated in FIG. 31. That is, the thickness of the orifice plate 12 is smaller than other spots in the vicinity of a spot that is in contact with the discharge port 13. Specifically, the thickness of the orifice plate 12 in the vicinity of the discharge port 13 is smaller than the thickness of the orifice plate in a connecting part between the flow passage 24 and the supply flow passage 18 (refer to FIG. 22A to FIG. 22C).

In the present embodiment, the thickness P of the orifice plate in the vicinity of the discharge port part 13*b* can be made small while keeping the thickness of the orifice plate 12 large to some extent as the entire head. Generally, if the length P of the discharge port part is shortened in order to satisfy Expression (2), the thickness of the entire orifice plate becomes small, and the strength of the orifice plate decreases. However, according to the configuration of the present embodiment, the strength as the entire orifice plate 12 can be secured in addition to the effects of the first embodiment and the second embodiment.

Fifth Embodiment

Figure 32:
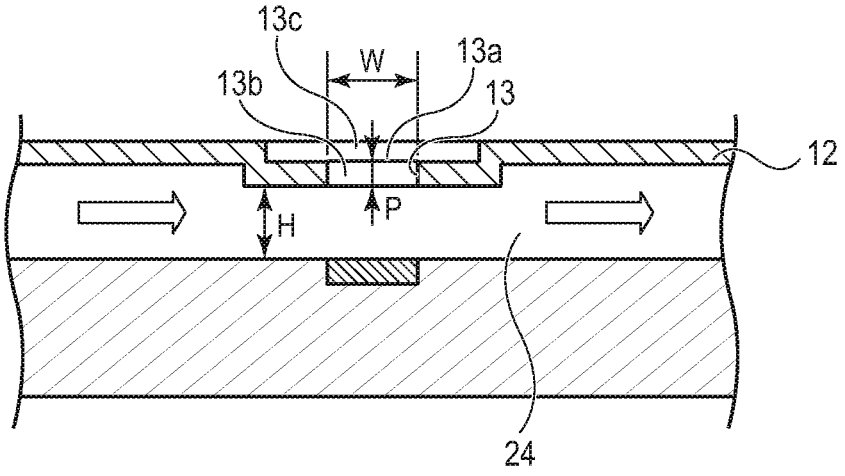
FIG. 32 is a view illustrating a flow aspect of the ink flow of the ink that flows through the inside of the liquid discharge head.

FIG. 32 is a view illustrating a flow aspect of an ink flow of the ink that flows through the inside of a liquid discharge head of a fifth embodiment of the disclosure. As illustrated in FIG. 32, the height of the flow passage 24 becomes lower than other spots in the vicinity of a connection with the discharge port 13, and the recess 13*c* is formed around the discharge port 13 of the front surface of the orifice plate 12. As a specific configuration, the height H of the flow passage 24 on the upstream side in the flow direction of the liquid within the flow passage in the communication part between the flow passage 24 and the discharge port part 13*b*, is lower than the height of the flow passage 24 in the communication part between the flow passage 24 and the supply flow passage 18 (refer to FIG. 22A to FIG. 22C).

In the present embodiment, the flow passage height H in the vicinity of the discharge port can be made low while keeping low the flow passage resistance from the supply flow passage 18 or the recovery flow passage 19 to the discharge port 13, and the length P of the discharge port part 13*b* can also be shortened. Generally, if the height of the flow passage 24 is made lower than other spots in the vicinity of the connection with the discharge port 13, the thickness of the orifice plate 12 in the vicinity of the discharge port 13 may become large along with this, and the length P of the discharge port 13 may become long. In contrast, according to the configuration of the present embodiment, a required refill speed can be secured in addition to the effects of the first embodiment and the second embodiment.

Sixth Embodiment

Figure 33:
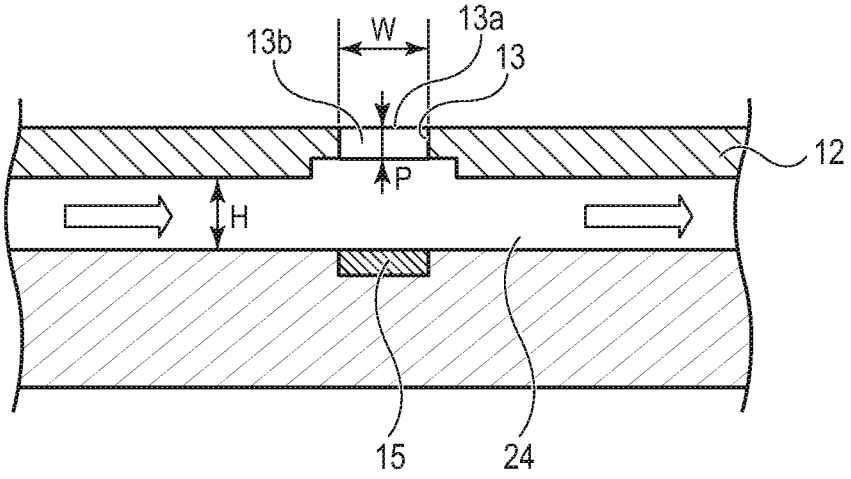
FIG. 33 is a view illustrating a flow aspect of the ink flow of the ink that flows through the inside of the liquid discharge head.

FIG. 33 is a view illustrating a flow aspect of an ink flow of the ink that flows through the inside of a liquid discharge head of a sixth embodiment of the disclosure. As illustrated in FIG. 33, the liquid discharge head of the present embodiment has a stepped part in the communication part between the flow passage 24 and the discharge port part 13*b*. In the present embodiment, a portion from the discharge port 13 to a part where the stepped part is formed is the discharge port part 13*b*, and the discharge port part 13*b* is connected to the flow passage 24 via a part (a portion of the flow passage) having a larger diameter than this portion. Therefore, P W, and H in the present embodiment are defined as illustrated in the drawing. Even in the liquid discharge head having such a shape, Expression (2) is satisfied and the flow mode A is generated.

By forming the part from the flow passage toward the discharge port as a multi-stage configuration in this way, the flow assistance in the direction from the energy generating element 15 to the discharge port 13 can be made relatively small. The configuration of the present embodiment is preferable, for example, in a case where 5 pl or less of small droplets are discharged, in addition to the effects of the first embodiment and the second embodiment.

Seventh Embodiment

Figure 34:
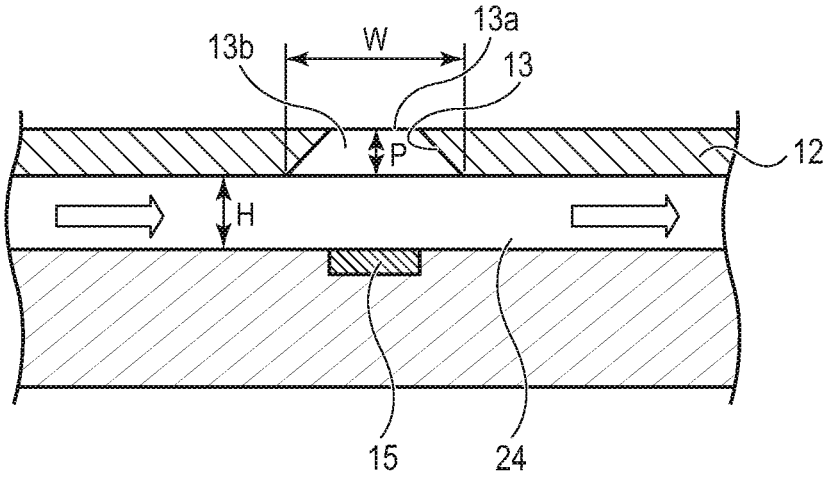
FIG. 34 is a view illustrating a flow aspect of the ink flow of the ink that flows through the inside of the liquid discharge head.

FIG. 34 is a view illustrating a flow aspect of an ink flow of the ink that flows through the inside of a liquid discharge head of a seventh embodiment of the disclosure. As illustrated in FIG. 34, the discharge port part 13*b* that allows the discharge port 13 and the flow passages 24 to communicate with each other has a truncated cone shape. Specifically, the opening diameter of the discharge port part 13*b* on the flow passage side is larger than the opening diameter of the discharge port part 13*b* on the discharge port 13 side, and a side wall has a tapered shape. By virtue of this configuration, the flow assistance in the direction from the energy generating element 15 to the discharge port 13 can be made relatively small. In the present embodiment, as for W of Expression (2), as illustrated in FIG. 34, the length of the communication part between the discharge port part 13*b* and the flow passage 24 is defined as W. The configuration of the present embodiment is a preferable configuration, for example, when 5 pl or less of small droplets are discharged, in addition to the effects of the first embodiment.

Eighth Embodiment

Figure 36A:
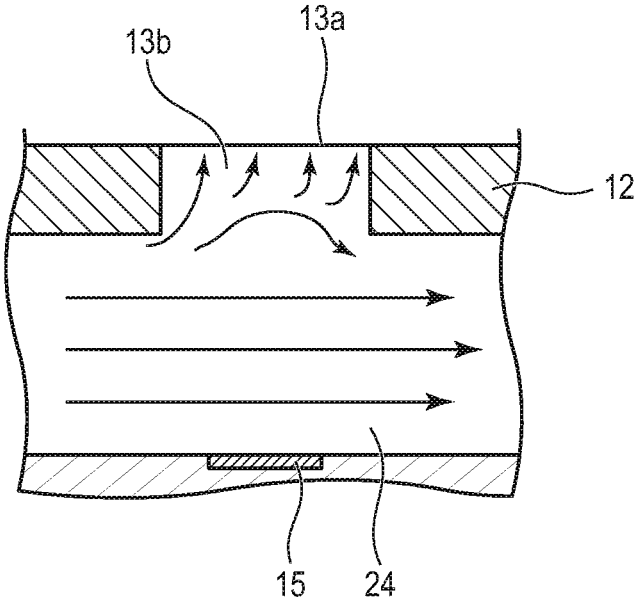
FIG. 36A and FIG. 36B are views illustrating flow aspects of individual flow modes of the ink that flows through the inside of the liquid discharge head.
Figure 36B:
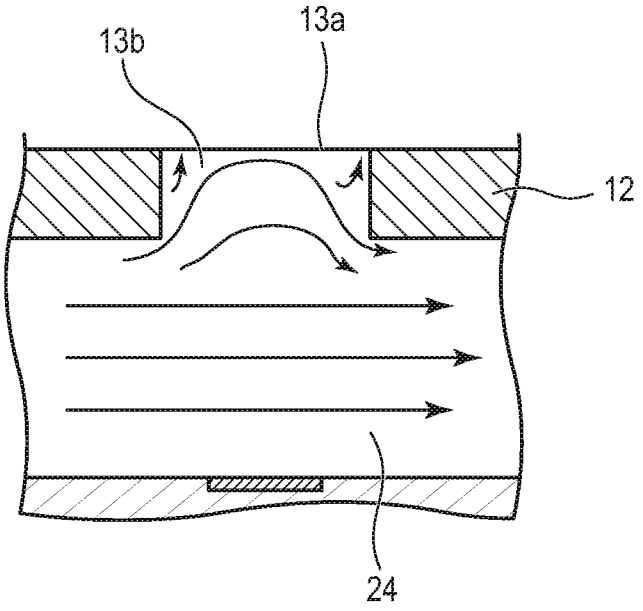
Figure 37A:
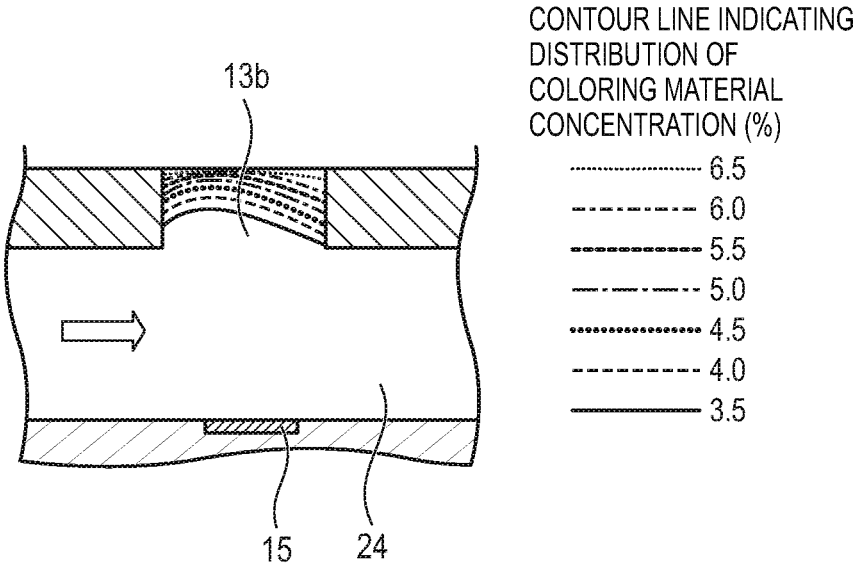
FIG. 37A and FIG. 37B are views illustrating the state of the coloring material concentration of the ink within the discharge port part.
Figure 37B:
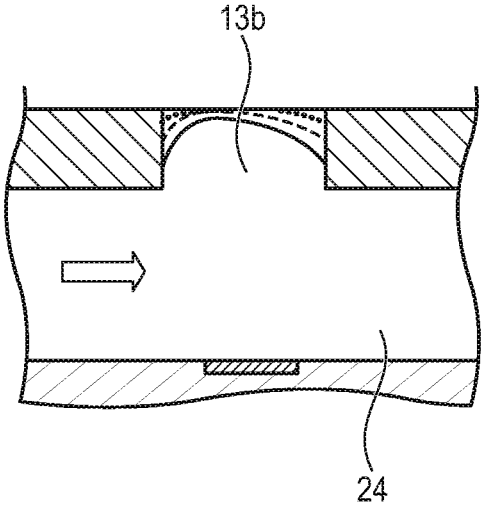

FIG. 36A, FIG. 36B, FIG. 37A, FIG. 37B and FIG. 38 are views illustrating a liquid discharge head related to an eighth embodiment of the disclosure. The present embodiment is an embodiment in which the second to seventh embodiments are further improved, and does not limit the aforementioned embodiments. A relationship between the evaporation amount of the ink moisture or the like from the ink interface 13*a* formed in the discharge port 13, and the flow rate of the ink flow 17 will be described with reference to FIG. 36A, FIG. 36B, FIG. 37A and FIG. 37B. In a case where the amount of evaporation from the ink interface 13*a* is relatively large due to environmental conditions or the like and the flow rate of the ink flow 17 is not sufficient with respect to the evaporation amount, as illustrated in FIG. 36A, a flow toward the ink interface 13*a* is dominant as the flow of the ink within the discharge port part 13*b*. In this way, a flow mode, in which the flow of the ink in the discharge port part 13*b* is directed to the ink interface 13*a* becomes dominant, is hereinafter referred to as a flow mode C. When the flow mode C is generated, as illustrated in FIG. 37A, the coloring material concentration within the discharge port part becomes relatively high due to the evaporation. In contrast, in a case where the ink flow 17 is sufficient with respect to the evaporation amount even if the evaporation amount is large, the flow mode A is brought about as illustrated in FIG. 36B. Accordingly, as illustrated in FIG. 37B, the coloring material concentration within the discharge port part becomes relatively low. That is, in the liquid discharge head that satisfies Expression (2) described in the first embodiment, even if the amount of evaporation from the ink interface 13*a* increases due to the environmental conditions or the like when using the liquid discharge head, the flow mode A can be brought about by making the flow rate of the ink flow 17 sufficiently large. Accordingly, it is possible to suppress that the ink of which the coloring material concentration change or the like has occurred due to the evaporation of the ink from the discharge port stagnates in the discharge port part 13*b*.

The case of a liquid discharge head that does not satisfy Expression (2) will be described as a comparative example. In this example, no matter how much the flow rate of the ink flow 17 is increased, the flow mode A is not obtained. That is, in order to bring about the flow mode A, it is necessary to satisfy Expression (2).

Here, if the amount of the ink flow 17 is increased even in the case of the liquid discharge head that satisfies Expression (2), the pressure loss becomes large along with that. For this reason, it is necessary to increase the pressure difference between the common supply flow passage 211 and the common recovery flow passage 212 (refer to FIG. 2 and FIG. 3). Additionally, the pressure difference up to each discharge port within the liquid discharge head becomes large, and it is difficult to make the discharge characteristics uniform. Therefore, from these viewpoints, it is desirable that the flow rate of the ink flow 17 is made as small as possible.

Thus, necessary minimum flow velocity conditions of the ink flow 17 in order to bring about the flow mode A will be described.

In the present embodiment, in a liquid discharge head in which H is 3 to 6 μm, P is 3 to 6 μm and W is 17 to 25 μm, the following conditions are taken in order to suppress that the ink of which the coloring material concentration change has occurred due to the evaporation stagnates inside the discharge port part 13*b*. That is, a relationship between an average flow velocity V17 of the ink flow 17 and an average evaporation flow velocity V12 from the ink interface 13*a* is expressed by the following Expression (5).

$$V17 \geq 27 \times V12 \quad (5)$$

It can be seen through the present application inventors' study that a liquid discharge head that satisfies Expression (5) is brought into the flow mode A. Since a liquid discharge head in which H is 3 to 6 μm, P is 3 to 6 μm and W is 17 μm or more satisfies Expression (2), the flow mode A can be brought about by circulating a sufficient amount of ink with respect to the evaporation amount. The above Expression (5) is an expression showing a circulation flow rate required in order to bring about the flow mode A. Expression (5) will be described with reference to FIG. 38.

Figure 38:
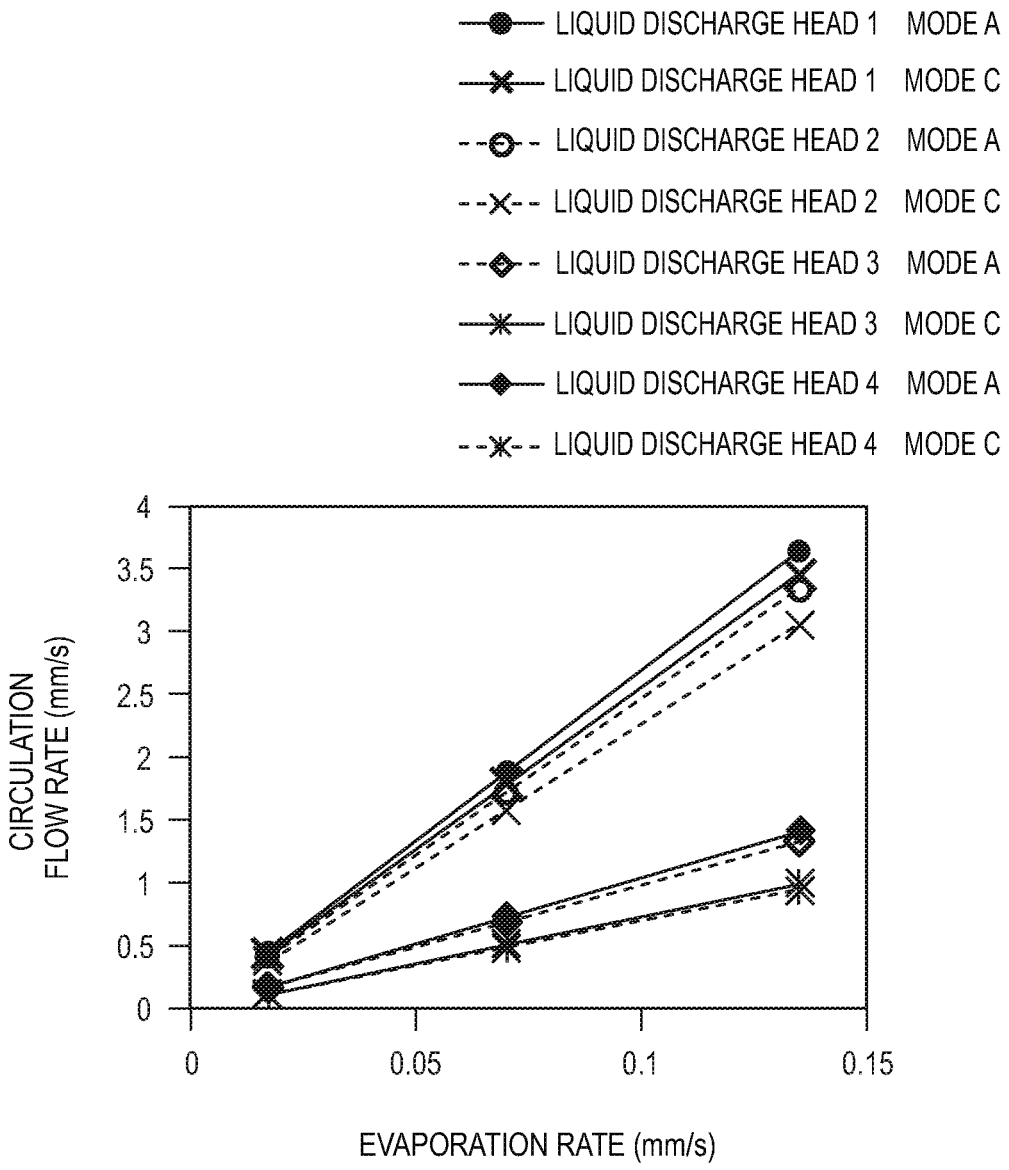
FIG. 38 is a view illustrating a relationship between evaporation rate and circulation flow rate in the individual flow modes.

FIG. 38 is a view illustrating a relationship between the evaporation rate and the circulation flow rate that are brought into the flow mode A, and a relationship between the evaporation rate and the circulation flow rate that are brought into the flow mode C. A horizontal axis of FIG. 38 represents the evaporation rate V12, and the vertical axis represents the flow velocity V17 of an ink flow resulting from the circulation, and data for each flow mode are shown regarding liquid discharge heads 1 to 4 having four shapes. In the liquid discharge head 1, H is 6 μm, P is 6μm and W is 17 μm, and the determination value J is 2.83. In the liquid discharge head 2, H is 6 μm, P is 6μm and W is 21 μm, and the determination value J is 3.5. In the liquid discharge head 3, H is 5 μm, P is 3μm and W is 21 μm, and the determination value J is 5.88. In the liquid discharge head 4, H is 5 μm, P is 3μm and W is 25 μm, and the determination value J is 7.0.

It can be seen from FIG. 38 that, in one certain liquid discharge head, the circulation flow rate V17 required in order to bring about the flow mode A instead of the flow mode C is proportional to the evaporation flow velocity V12. Additionally, it can be seen that, as the determination value J is smaller, the circulation flow rate required in order to bring about the flow mode A is larger. Moreover, in the liquid discharge head in which H is 3 to 6 μm, P is 3 to 6μm and W is 17 to 25 μm, it can be seen that, in a case where the determination value J is 2.83 (liquid discharge head 1) that is the smallest, the flow mode A is brought about if the circulation flow rate is made to be 27 times or more the evaporation flow velocity. Therefore, in the liquid discharge head in which H is 3 to 6 μm, P is 3 to 6μm and W is 17 μm or more, it is possible to suppress that the flow mode A is brought about by satisfying Expression (5), and the ink of which the coloring material concentration change has occurred due to the evaporation stagnates in the discharge port part 13*b*.

That is, it is possible to reduce occurrence of color unevenness of an image accompanying the liquid evaporation or the like from the discharge port 13. For example, in present application inventors' experiments, the amount of evaporation from a circular discharge port of which W is 18 μm is about 140 pl/s, and the average evaporation flow velocity is approximately $1.35\times10^{-4}$ m/s. Thus, in this case, the circulation flow rate of about 0.0036 m/s or more on average is required. Here, the evaporation amount refers to an evaporation amount when the ink of the discharge port part 13*b* changes in concentration.

Similarly, in a liquid discharge head in which H is 8 μm, P is 8μm and W is 17 μm, and the determination value J is 2.13, the flow mode A is brought about by setting the average flow velocity V17 of the ink flow 17 to 50 times or more the average evaporation flow rate V12 from the ink interface 13*a*. Therefore, in a liquid discharge head in which H is 8μm or less, P is 8μm or less and W is 17 μm or more, the flow mode A can be brought about by setting the average flow velocity V17 of the ink flow 17 to 50 times or more the average evaporation flow rate V12 from the ink interface 13*a*. Accordingly, it is possible to suppress that the ink of which the coloring material concentration change or the like has occurred due to the evaporation stagnates within the discharge port part 13*b*. As a result, it is possible to reduce occurrence of color unevenness or the like of an image accompanying the liquid evaporation or the like from the discharge port 13. Similarly to the above, in a case where the amount of evaporation from the circular discharge port of which W is 18 μm is about 140 pl/s, the circulation flow rate of about 0.0067 m/s or more on average is required.

Similarly, in a liquid discharge head in which H is 15 μm is 7 μm and W is 17 μm, and the determination value J is 1.87, the flow mode A is generated by setting the average flow velocity V17 of the ink flow 17 to 50 times or more the average evaporation flow rate V12 from the ink interface 13*a*. Therefore, in a liquid discharge head in which H is 15 μm or less, P is 7 μm or less and W is 17 μm or more, the flow mode A can be brought about by setting the average flow velocity V17 of the ink flow 17 to 100 times or more the average evaporation flow rate V12 from the ink interface 13*a*. Similarly to the above, in a case where the amount of evaporation from the circular discharge port of which W is 18 μm is about 140 pl/s, the circulation flow rate of about 0.0135 m/s or more on average is required.

Next, configurations of different liquid discharge heads will be described. The present liquid discharge head is a liquid discharge head in which H is 14 μm or less, P is 12 μm or less, W is 17 μm or more, and H, P, and W satisfy Expression (2). The liquid discharge head satisfies the following Expression (6) in order to suppress that the ink of which the coloring material concentration change or the like has occurred due to the evaporation of the ink from the discharge port stagnates in the discharge port part 13*b*. That is, the average flow velocity V17 of the circulatory flow 17 and the average evaporation flow velocity V12 from the ink interface 13*a* satisfy the following Expression (6).

$$V17 \geq 900 \times V12 \quad (6)$$

In a liquid discharge head (determination value J is 1.7) in which H is 12.3 μm, P is 9 μm and W is 17 μm, the flow mode A can be brought about by setting the average flow velocity V17 of the ink flow 17 to 900 times the average evaporation flow velocity V12 from the ink interface 13*a*. Similarly, even in a liquid discharge head (determination value J is 1.7) in which H is 10 μm, P is 10 μm and W is 17 μm, the flow mode A can be brought about by setting the average flow velocity V17 of the ink flow 17 to 900 times the average evaporation flow velocity V12 from the ink interface 13*a*. Similarly, even in a liquid discharge head (determination value J is 1.7) in which H is 8.3 μm, P is 11 μm and W is 17 μm, the flow mode A of the circulatory flow 17 can be brought about by setting the average flow velocity V17 of the ink flow 17 to 900 times the average evaporation flow velocity V12 from the ink interface 13*a*. Similarly, even in a liquid discharge head (determination value J is 1.7) in which H is 7 μm, P is 12 μm and W is 17 μm, the flow mode A of the circulatory flow 17 can be brought about by setting the average flow velocity V17 of the ink flow 17 to 900 times the average evaporation flow velocity V12 from the ink interface 13*a*.

Therefore, the liquid discharge head in which H is 14 μm or less, P is 12 μm or less, W is 17 μm or more, and H, P, and W satisfy Expression (2) is brought into the flow mode A by satisfying Expression (6).

The conditions for bringing the above eighth embodiment into the flow mode A is summarized as follows.

H is 14 μm or less, P is 12 μm or less and W is 17 μm or more to 30 μm or less, and the flow velocity of the liquid of the flow passage is 900 times or more the evaporation rate from the discharge port.

Alternatively, H is 15 μm or less, P is 7 μm or less and W is 17 μm or more to 30 μm or less, and the flow velocity of the liquid of the flow passage is 100 times or more the evaporation rate from the discharge port.

Alternatively, H is 8 μm or less, P is 8 μm or less and W is 17 μm or more to 30 μm or less, and the flow velocity of the liquid of the flow passage is 50 times or more the evaporation rate from the discharge port.

Alternatively, H is 3 μm or more to 6 μm or less, P is 3 μm or more to 6 μm or less and W is 17 μm or more to 30 μm or less, and the flow velocity of the liquid of the flow passage is 27 times or more the evaporation rate from the discharge port.

Here, the definition of the flow velocity of the above liquid is a range where the mode A is brought out even in a shape that is the least likely to be brought into the mode A in the respective head shape ranges, and means even a case where the mode A is brought about at a flow velocity smaller than the flow velocity in the other shapes of the respective head shape ranges.

Ninth Embodiment

FIG. 39A, FIG. 39B, FIG. 39C, FIG. 40, FIG. 41A, FIG. 41B, FIG. 41C and FIG. 42 are views for illustrating the liquid discharge head related to the ninth embodiment of the disclosure, and the present embodiment relates to a relationship between two types of following characteristics and flow passage shapes including discharge ports.

Characteristic 1) Flow mode of ink flow

Characteristic 2) Discharge droplet discharged from discharge port

Particularly, a relationship with the above characteristics will be described taking three types of following discharge port shapes in which the discharge amount Vd is about of 5 pl as examples.

Flow passage shape A) H=14 μm, P=11 μm, W=16 μm (J=1.34)

Flow passage shape B) H=09 μm, P=11 μm, W=18 μm (J=1.79)

Flow passage shape C) H=14 μm, P=06 μm, W=18 μm (J=2.30)

Here,

H: Height of flow passage 24 on upstream side in flow direction of liquid within flow passage 24 (refer to FIG. 22A to FIG. 22C)

P: Length of discharge port part 13*b* in a direction in which liquid is discharged from discharge port 13 (refer to FIG. 22A to FIG. 22C)

W: Length of discharge port part 13*b* in flow direction of liquid within flow passage 24 (refer to FIG. 22A to FIG. 22C)

Z: Effective length of inscribed circle of discharge port 13.

Here, since the shape of the discharge port 13 is circular (refer to FIG. 22A to FIG. 22C), the effective diameters Z and W of the inscribed circle of the discharge port 13 are equal to each other.

Additionally, the reason why Vd of 5 pl is taken as an example is that, in a case where the discharge amount is large, a plurality of main droplets and a plurality sub droplets (hereinafter also referred to as satellites) are more likely to be generated, and these cause image quality deterioration.

Figure 39A:
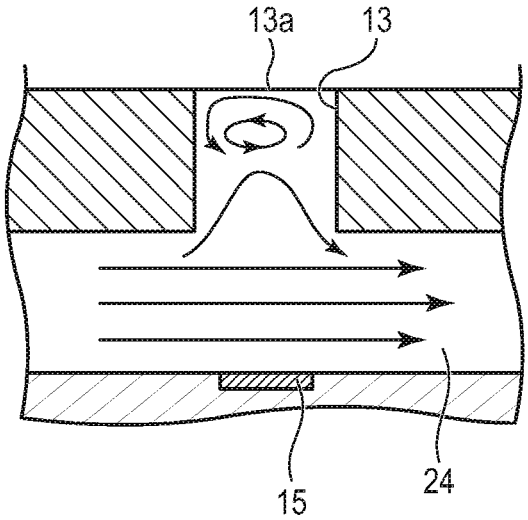
FIG. 39A, FIG. 39B and FIG. 39C are views illustrating flow modes of three flow passage shapes.
Figure 39B:
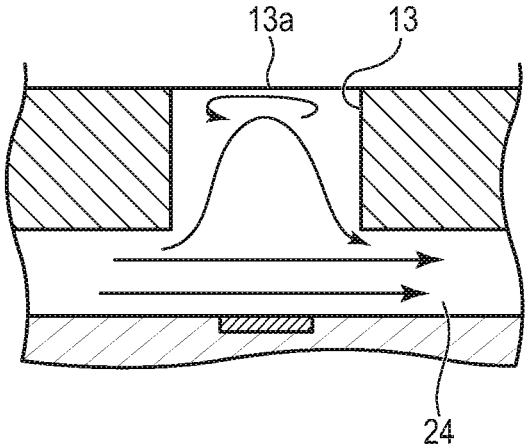
Figure 39C:
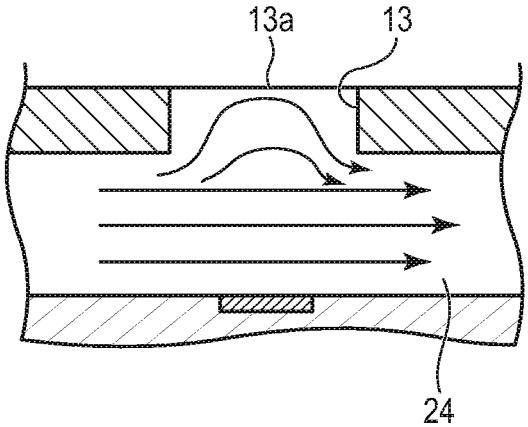
Figure 40:
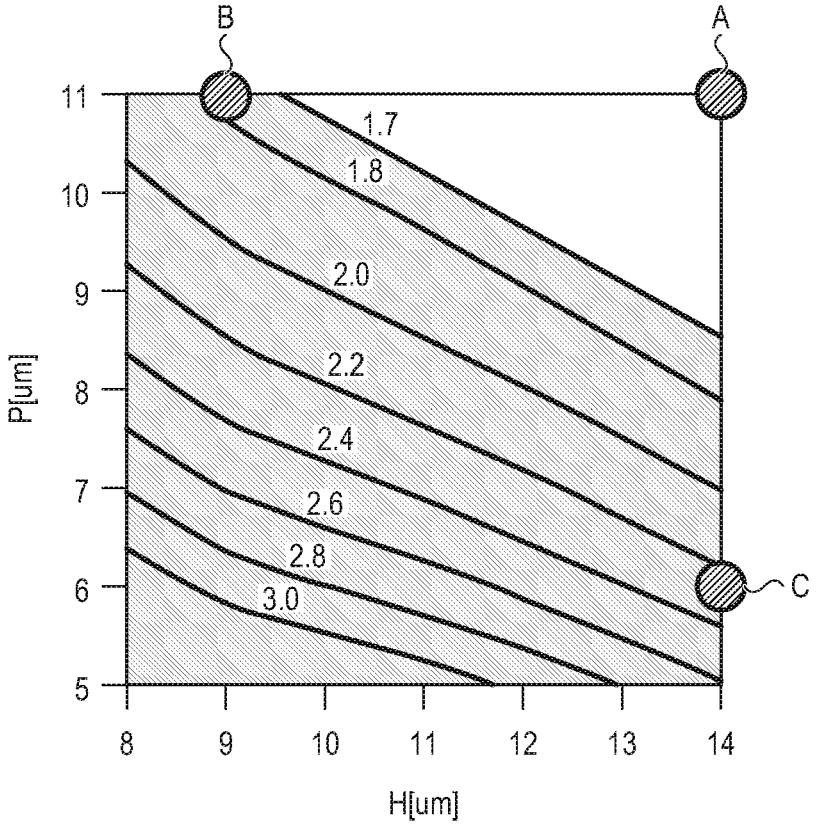
FIG. 40 is a contour view illustrating flow mode determination values in a case where discharge port diameter is changed.

FIG. 39A to FIG. 39C are views illustrating flow modes of three flow passage shapes A to C, and FIG. 40 is a contour view illustrating values of the determination value J in a case where the discharge port diameter is changed such that the discharge amount Vd is discharged at about 5 pl with H on a horizontal axis and P on a vertical axis.

The flow passage shape A has the determination value J=1.34 and generates the flow mode B as illustrated in FIG. 39A. A dimension (hereinafter also referred to as OH) obtained by H and P of the flow passage shape A is 25 μm. However, in order to increase the determination value J, it is necessary to make H or P small and to lower OH. In the case of OH=20 μm, the flow passage shape B in which only H is made small has the determination value J=1.79 and generates the flow mode A as illustrated in FIG. 39B. Additionally, the flow passage shape C in which only P is made small has the determination value J=2.30 and generates the flow mode A similarly as illustrated in FIG. 39C. In addition to this, the ink flow in the flow passage shape C enters the discharge port more easily than that in the flow passage shape B, and the stagnation of the ink inside the discharge port part 13*b* can be further suppressed. Hence, the following shape is given about the flow mode of the ink flow.

Figure 41A:
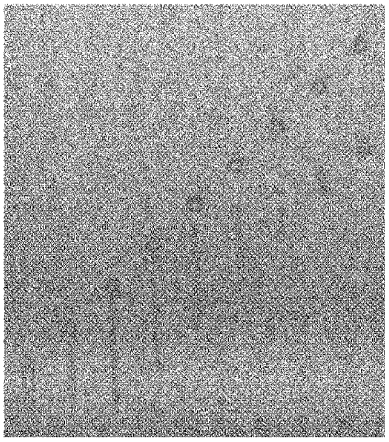
FIG. 41A, FIG. 41B and FIG. 41C are views illustrating results obtained by observing discharge droplets of the discharge ports for each flow passage shape.
Figure 41B:
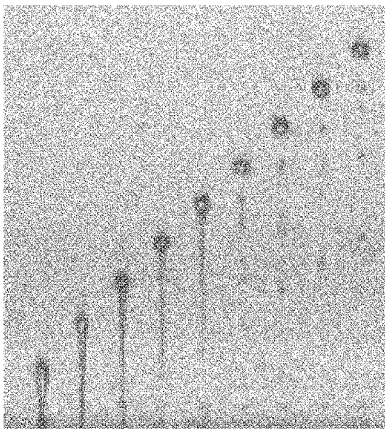
Figure 41C:
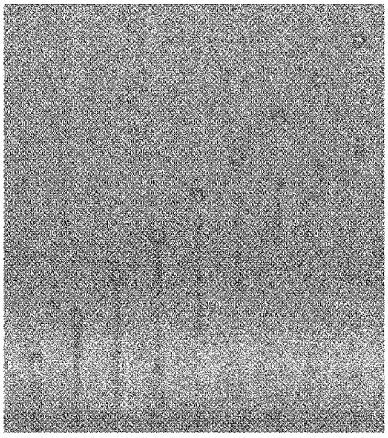
Figure 42:
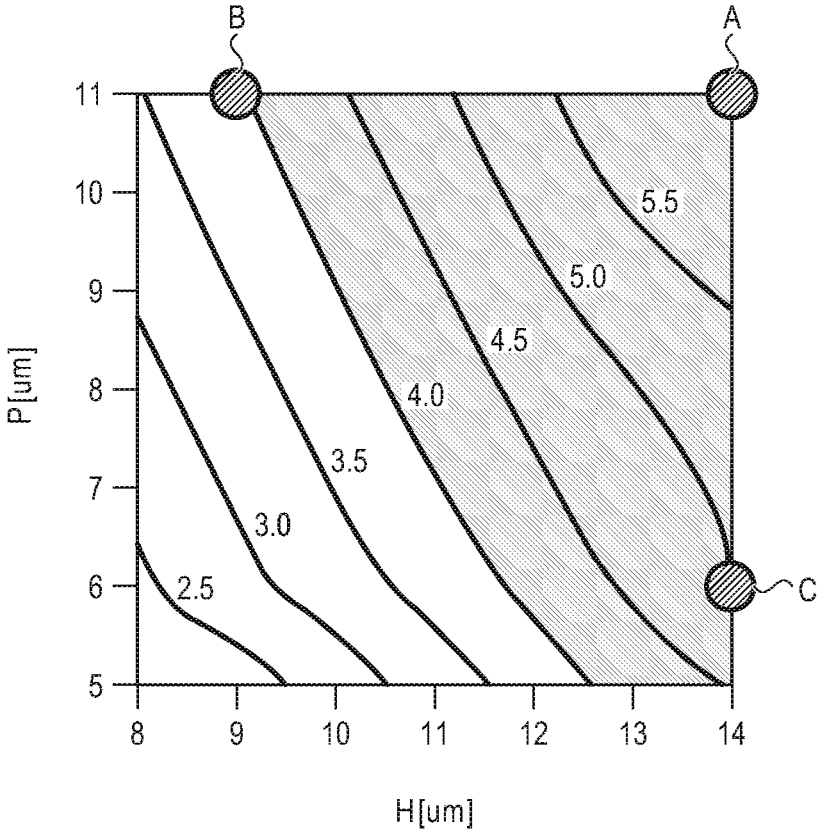
FIG. 42 is a contour view illustrating the time for which bubbles communicate with the ambient air in a case where the discharge port diameter is changed.

Shape characteristic (1) In the case of equal OH, P can be made small (refer to FIG. 40). Shape characteristic (2) OH (refer to FIG. 40) can be lowered. On the other hand, FIG. 41A to FIG. 41C are views illustrating results obtained by observing respective discharge droplets of the three types of flow passage shapes A to C. FIG. 42 is a contour view illustrating values obtained by calculating the time for which bubbles in a case where the discharge port diameter is changed such that the bubbles are discharged with a discharge amount Vd of about 5 pl communicate with the atmosphere (hereinafter, referred to as Tth) with H on a horizontal axis and P on a vertical axis.

FIGS. 41A and 41C illustrate a case where two types of the main droplet and a satellite are generated as the discharge droplets. On the other hand, FIG. 41B illustrates a case where the main droplet and a plurality of satellites are generated. The flow passage shape A has Tth=5.8 us, and the flow passage shape C has Tth=4.5 us. On the other end, the flow passage shape B has Tth=3.8 us, and Tth becomes small (refer to FIG. 42). Generally, in a case where the discharge amount Vd is large as in the present embodiment, a plurality of satellites is generated if Tth is small. This is because, if Tth is small, that is, the ambient air communication is promoted, an elongated tail (tailing) is likely to be generated, and many knots accompanying destabilization of the tail are generated. As a result, the elongated tail cannot be contracted as one, and a plurality of satellites is generated as illustrated in FIG. 41B. Therefore, the following suppressions can be given to the satellites.

Shape characteristic (3) In the case of equal OH, P can be made small (refer to FIG. 42).

Shape characteristic (4) the OH (refer to FIG. 42) can be increased.

As described above, the increase in the determination value J required for suppressing the stagnation of the ink within the discharge port part 13*b* includes Shape characteristic A) lowering OH, and Shape characteristic B) making P smaller than H in the case of equal OH and additionally, the increase in the determination value Tth required for suppressing a main droplet and a satellite includes Shape characteristic C) increasing OH, and Shape characteristic D) making P smaller than H in the case of equal OH, Since the shape characteristic A) and the shape characteristic C) to show conflicting characteristics, it is desirable to satisfy the following conditions for a compatibility solution. Determination value J of flow mode>1.7, and Determination value Tth of ambient air and communication time>4.0 μs.

Therefore, a range as illustrated in FIG. 42 can be provided. Here, when the determination value Tth satisfies the above conditions, in a diagram illustrated in FIG. 42, the determination value Tth is approximated to $$Tth=0.350\times H+0.227\times P^{-0.100}\times Z.$$

In a case where the above H or P is small or in a case where Z is increased, Tth becomes small, and a plurality of satellites is likely to be generated. Particularly, since H has a sensitivity of about 1.5 times that of P, in the case of equal OH, making P small suppresses a decrease in Tth and can suppress generation of satellites. Therefore, the above conditions can be expressed by the following expression. The above conditions can be expressed by $$0.350\times H+0.227\times P^{-0.100}\times Z>4 \quad (7)$$

By using the shape characteristic of the discharge port of the above establishment range, it is possible to satisfy a circulation effect (stagnation suppression of the ink within the discharge port part 13*b*) in a discharge amount Vd of 5 ng, and the suppression of generation of satellites.

As described above, in the disclosure, the flow mode A can be brought about by satisfying Expression (2) described in the second embodiment, the stagnation of the ink within the discharge port part 13*b* can be suppressed, and thereby, it is possible to reduce the rise in the coloring material concentration, or the like. The flow velocity of the ink that flows through the flow passage 24 may be appropriately set depending on the conditions, environments, or the like under which the liquid discharge head is used according to the way of thinking described in the present embodiment.

In addition, although an example in which portions of the supply flow passage and outflow passage are formed in the substrate and these flow passages pass through the substrate is shown, these flow passages do not need to pass through the substrate. For example, these flow passages may be formed only on the substrate. Additionally, the above respective embodiments show an example in which a pump, which is a power source that performs circulation, is provided on the body of the liquid discharge apparatus that is the outside of the liquid discharge head. However, a configuration in which the power source is provided in the liquid discharge head 3 may be adopted. Particularly, a configuration in which the recording element substrate 10 (FIG. 10B) including the recording element is provided with a micro pump (micro-actuator) composed of a heat generating element, a piezoelectric element, or the like may be adopted, or a form in which a pump on the apparatus body and a micro pump on the head side may be used together may be adopted.

In a case where the micro pump is provided in the recording element substrate, a common liquid chamber (not illustrated) that holds the liquid, a first flow passage (not illustrated) that allows the pressure chamber 23 and the common liquid chamber to communicate with each other, and a second flow passage (not illustrated) that allows the pressure chamber 23 and the common liquid chamber to communicate with each other are included. A configuration in which the micro pump is provided in the second flow passage may be applied. The second flow passage can be formed as a substantially U-shaped flow passage having a bent part.

In addition, the disclosure is not limited to the above embodiments, and can be variously changed and modified without departing from the technical idea and scope of the disclosure.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2018-190399, filed Oct. 5, 2018, which is hereby incorporated by reference herein in its entirety.

What is claimed is:

1. A liquid discharge head comprising:

a discharge port for discharging a liquid;

a flow passage in which an energy generating element, which generates an energy to be used for discharging the liquid, is disposed;

a discharge port part that allows the discharge port and the flow passage to communicate with each other;

a supply flow passage for supplying the liquid from an outside of the flow passage to an inside of the flow passage; and a recovery flow passage for recovering the liquid from the inside of the flow passage to the outside of the flow passage, wherein the flow passage, the supply flow passage, and the recovery flow passage are configured such that the liquid inside the flow passage is capable of being circulated between the inside of the flow passage and the outside of the flow passage by supplying the liquid from the supply flow passage to the inside of the flow passage, causing the fluid to flow through the inside of the flow passage, and recovering the liquid from the inside of the flow passage to the outside of the flow passage through the recovery flow passage, and wherein an opening of the discharge port is configured such that a liquid surface of the liquid within the opening of the discharge port has a first region and a second region, and that a viscosity of the liquid in the first region is equal to or greater than 1.2 times a viscosity of the liquid in the second region.

2. The liquid discharge head according to claim 1, wherein in a direction orthogonal to a direction in which the liquid flows through the inside of the flow passage, the first region is located on an end part side of the discharge port, and the second region is located on a center side of the discharge port.

3. The liquid discharge head according to claim 1, wherein the opening of the discharge port is configured such that a percentage of the area of a region where the viscosity of the liquid is greater than or equal to 1.2Y in the liquid surface within the opening of the discharge port with respect to the opening of the discharge port is greater than or equal to 25% and less than or equal to 75% when the viscosity of the liquid in a central region of the discharge port in the liquid surface of the liquid within the opening of the discharge port is Y.

4. The liquid discharge head according to claim 1, wherein in a case where a height of the flow passage on an upstream side in a flow direction of the liquid within the flow passage is H [μm], a length of the discharge port part in a direction in which the liquid is discharged from the discharge port is P [μm], and a length of the discharge port part in the flow direction of the liquid within the flow passage is W [μm] in a communication part between the flow passage and the discharge port part, $$H^{-0.34}\times P^{-0.66}\times W>1.5$$

is satisfied.

5. The liquid discharge head according to claim 1, wherein in a case where a height of the flow passage on an upstream side in a flow direction of the liquid within the flow passage is H [μm], a length of the discharge port part in a direction in which the liquid is discharged from the discharge port is P [μm], and a length of the discharge port part in the flow direction of the liquid within the flow passage is W [μm] in a communication part between the flow passage and the discharge port part, $$H^{-0.34} \times P^{-0.66} \times W > 1.7$$

is satisfied.

6. The liquid discharge head according to claim 1, wherein the supply flow passage and the supply flow passage are configured such that a moisture content of the liquid to be supplied from the supply flow passage to the inside of the flow passage is less than or equal to 65 wt %.

7. The liquid discharge head according to claim 1, wherein the liquid discharge head adjusts the liquid in temperature.

8. A liquid discharge apparatus comprising:

a liquid discharge head, the liquid discharge head including a discharge port for discharging a liquid;

a flow passage in which an energy generating element, which generates an energy to be used for discharging the liquid, is disposed;

a discharge port part that allows the discharge port and the flow passage to communicate with each other;

a supply flow passage for supplying the liquid from an outside of the flow passage to an inside of the flow passage; and a recovery flow passage for recovering the liquid from the inside of the flow passage to the outside of the flow passage, wherein the flow passage, the supply flow passage, and the recovery flow passage are configured such that the liquid inside the flow passage is capable of being circulated between the inside of the flow passage and the outside of the flow passage by supplying the liquid from the supply flow passage to the inside of the flow passage, causing the fluid to flow through the inside of the flow passage, and recovering the liquid from the inside of the flow passage to the outside of the flow passage through the recovery flow passage, and wherein an opening of the discharge port is configured such that a liquid surface of the liquid within the opening of the discharge port has a first region and a second region, and that a viscosity of the liquid in the first region is greater than or equal to 1.2 times a viscosity of the liquid in the second region.

9. The liquid discharge apparatus according to claim 8, wherein in a direction orthogonal to a direction in which the liquid flows through the inside of the flow passage, the first region is located on an end part side of the discharge port, and the second region is located on a center side of the discharge port.

10. The liquid discharge apparatus according to claim 8, wherein the opening of the discharge port is configured such that a percentage of the area of a region where the viscosity of the liquid is greater than or equal to 1.2Y in the liquid surface within the opening of the discharge port with respect to the opening of the discharge port is greater than or equal to 25% and less than or equal to 75% when the viscosity of the liquid in a central region of the discharge port in the liquid surface of the liquid within the opening of the discharge port is Y.

11. The liquid discharge apparatus according to claim 8, wherein in a case where a height of the flow passage on an upstream side in a flow direction of the liquid within the flow passage is H [μm], a length of the discharge port part in a direction in which the liquid is discharged from the discharge port is P [μm], and a length of the discharge port part in the flow direction of the liquid within the flow passage is W [μm] in a communication part between the flow passage and the discharge port part, $$H^{-0.34} \times P^{-0.66} \times W > 1.5$$

is satisfied.

12. The liquid discharge apparatus according to claim 8, wherein in a case where a height of the flow passage on an upstream side in a flow direction of the liquid within the flow passage is H [μm], a length of the discharge port part in a direction in which the liquid is discharged from the discharge port is P [μm], and a length of the discharge port part in the flow direction of the liquid within the flow passage is W [μm] in a communication part between the flow passage and the discharge port part, $$H^{-0.34} \times P^{-0.66} \times W > 1.7$$

is satisfied.

13. The liquid discharge apparatus according to claim 8, wherein the supply flow passage and the supply flow passage are configured such that a moisture content of the liquid to be supplied from the supply flow passage to the inside of the flow passage is less than or equal to 65 wt %.

14. The liquid discharge apparatus according to claim 8, wherein the liquid discharge head adjusts the liquid in temperature.

* * * * *